US007710444B2

(12) United States Patent
Hirayama et al.

(10) Patent No.: US 7,710,444 B2
(45) Date of Patent: May 4, 2010

(54) IMAGE FORMING APPARATUS FOR FORMING A LATENT IMAGE ON AN IMAGE CARRIER

(75) Inventors: Hiroshi Hirayama, Shiojiri (JP); Tsugio Gomi, Fujimi-machi (JP); Kazunori Sakurai, Chino (JP)

(73) Assignee: Seiko Epson Corporation, Tokyo (JP)

( * ) Notice: Subject to any disclaimer, the term of this patent is extended or adjusted under 35 U.S.C. 154(b) by 972 days.

(21) Appl. No.: 11/338,836

(22) Filed: Jan. 25, 2006

(65) Prior Publication Data

US 2006/0176538 A1 Aug. 10, 2006

(30) Foreign Application Priority Data

| | | |
|---|---|---|
| Feb. 9, 2005 | (JP) | 2005-032777 |
| Mar. 25, 2005 | (JP) | 2005-087923 |
| Mar. 25, 2005 | (JP) | 2005-087927 |
| Mar. 29, 2005 | (JP) | 2005-094778 |

(51) Int. Cl.
*B41J 2/45* (2006.01)

(52) U.S. Cl. ..... 347/238

(58) Field of Classification Search ..... 347/230, 347/238, 241, 242, 245, 256–258, 263
See application file for complete search history.

(56) References Cited

U.S. PATENT DOCUMENTS 5,049,905 A 9/1991 Tomoyori et al.
6,801,232 B2 10/2004 Nagamine et al.

FOREIGN PATENT DOCUMENTS

| | | | |
|---|---|---|---|
| JP | A-53-104242 | | 9/1978 |
| JP | A-54-119253 | | 9/1979 |
| JP | 62085217 | A * | 4/1987 |
| JP | A-62-280064 | | 12/1987 |
| JP | A-63-172288 | | 7/1988 |
| JP | A-3-294875 | | 12/1991 |
| JP | 05-027563 | A | 2/1993 |
| JP | 05241399 | A * | 9/1993 |
| JP | A-5-241399 | | 9/1993 |
| JP | 07-178956 | A | 7/1995 |
| JP | 07178956 | A * | 7/1995 |
| JP | 07237317 | A * | 9/1995 |
| JP | A-7-237317 | | 9/1995 |
| JP | A-8-76559 | | 3/1996 |
| JP | B2-2509605 | | 4/1996 |
| JP | A-2000-255100 | | 9/2000 |
| JP | A-2000-338753 | | 12/2000 |
| JP | A-2001-130047 | | 5/2001 |
| JP | A-2002-361931 | | 12/2002 |

* cited by examiner

*Primary Examiner*—Hai C Pham
(74) *Attorney, Agent, or Firm*—Oliff & Berridge, PLC

(57) ABSTRACT

An image forming apparatus includes an image carrier that has an image carrier surface moving in a direction; a supporting member that faces the image carrier; a plurality of light emitting elements which are provided on a surface of the supporting member facing the image carrier and emit light to form a latent image on the image carrier; a roller which is arranged on the surface of the supporting member facing the image carrier such that a rotational shaft thereof extends in a direction traversing an image carrier surface; and an urging unit which urge the supporting member against the image carrier so that the roller comes into contact with the image carrier.

8 Claims, 28 Drawing Sheets

IMAGE FORMING APPARATUS FOR FORMING A LATENT IMAGE ON AN IMAGE CARRIER

CROSS-REFERENCE TO RELATED APPLICATIONS

The present application claims priority to Japanese Patent Application Nos. 2005-032777 filed in Japan on Feb. 9, 2005; 2005-087923 filed in Japan on Mar. 25, 2005; 2005-087927 filed in Japan on Mar. 25, 2005; and 2005-094778 filed in Japan on Mar. 29, 2005; which are hereby expressly incorporated by reference in their entireties.

BACKGROUND

The present invention relates to an image forming apparatus (image printing apparatus) in which a latent image is formed on an image carrier by light emitted from light emitting elements.

In general, an image forming apparatus includes an image carrier and a head facing the surface of the image carrier. A photoreceptor drum is generally used as the image carrier. A plurality of light emitting elements formed of a light emitting material, such as an organic EL (electroluminescent) material, is formed on a surface of the head facing the photoreceptor drum. A latent image is formed on the surface of the photoreceptor drum by light emitted from each light emitting element.

In the image forming apparatus according to the related art, when light emitted from each light emitting element reaches the surface of the photoreceptor drum to form a latent image (hereinafter, referred to as a 'spot image') in each region on the surface, a large variation in the area or shape of the latent image may occur. When a large variation occurs in the area or shape of the spot image, it is difficult to form a high-resolution latent image composed of fine pixels. The large variation in the area or shape of the spot image may occur due to a difference in distances between the surface of the photoreceptor drum and the light emitting elements. In order to solve this problem, JP-A-7-178956 discloses a structure in which a guide member coming into contact with the surface of a photoreceptor drum is fixed to a head, and JP-A-5-27563 discloses a structure in which end surfaces of light emitting elements come into contact with the surface of a photoreceptor drum.

However, in these structures, there is a fear that the head may be elastically deformed by friction force acting on the head (including the guide member and the light emitting elements) from the photoreceptor drum, which is generated by the rotation of the photoreceptor drum, and then restored to the original shape thereof when the stress of the head exceeds a threshold value, that is, the head may be vibrated. When the photoreceptor drum is driven at high speed, the vibration of the head becomes more remarkable. When the head is vibrated, a gap between the photoreceptor drum and each light emitting element is changed, which results in a large variation in the area or shape of the spot image with the passage of time. In addition, in these structures, there is a fear that the surfaces of the head and the photoreceptor drum may be rapidly worn away by friction therebetween, resulting in a large variation in gap between each light emitting element and the photoreceptor drum. That is, there is a fear that the area or shape of the spot image may be greatly varied with the passage of time.

SUMMARY

An advantage of some aspects of the invention is that it provides an image forming apparatus capable of reducing a variation in the area or shape of a spot image.

According to an aspect of the invention, an image forming apparatus includes an image carrier that has an image carrier surface moving in a direction; a supporting member that faces the image carrier; a plurality of light emitting elements which are provided on a surface of the supporting member facing the image carrier and emit light to form a latent image on the image carrier; a roller which is arranged on the surface of the supporting member facing the image carrier such that a rotational shaft thereof extends in a direction traversing an image carrier surface; and an urging unit which urges the supporting member against the image carrier so that the roller comes into contact with the image carrier. According to this structure, since the supporting member is urged against the image carrier so that the roller comes into contact with the image carrier, a gap between the image carrier and the light emitting elements formed on the supporting member is maintained at a predetermined value. In addition, since the roller having a rotational shaft extending in the direction traversing the image carrier surface comes into contact with the image carrier, the roller rotates with the movement of the image carrier surface. Therefore, it is possible to prevent the vibration of the roller and the supporting member or the light emitting elements formed on the supporting member, and to reduce the degree of abrasion of a contact portion between the image carrier and the head. Thus, it is possible to reduce a variation in the area or shape of a spot image. In addition, even when a foreign material is caught between the image carrier and the roller, it can be rapidly removed therebetween by the rotation of the roller. Accordingly, it is possible to prevent the damage of the image carrier surface due to the foreign material being continuously stuck to the image carrier surface. These effects contribute to forming (printing) a stable and high-quality image.

Further, in the above-mentioned structure, it is preferable that the urging unit include a plurality of elastic members that is provided on a surface of the supporting member opposite to the image carrier to press the supporting member against the image carrier. According to this structure, it is possible to uniformly urge the supporting member against the image carrier with a simple structure.

Furthermore, in the above-mentioned structure, it is preferable that the urging unit include a frame member which has surfaces facing side surfaces of the supporting member; and elastic members which are provided between the side surfaces of the supporting member and the frame member. According to this structure, it is possible to reduce a space on the side of the supporting member opposite to the image carrier. In addition, in this structure, the urging unit may include elastic members which press the frame member against the image carrier. According to this structure, it is possible to reliably urge the supporting member against the image carrier.

Moreover, in the above-mentioned structure, preferably, a groove is formed in the surface of the supporting member facing the image carrier so as to extend in a direction traversing the image carrier surface, and the roller is accommodated in the groove such that an outer circumferential surface thereof partially protrudes, toward the image carrier, from the surface of the supporting member facing the image carrier. According to this structure, since a portion of the roller is accommodated in the groove, the thickness of the head including the supporting member, the roller, and the light emitting elements can be reduced. However, in this structure, the supporting member may be bent toward the roller to cause the bottom of the groove to come into contact with the roller. In this case, the rotation of the roller may be interrupted by friction caused by the contact therebetween. Therefore, it is preferable that an auxiliary roller be arranged in the bottom of the groove such that an outer circumferential surface thereof comes into contact with the outer circumferential surface of the roller. According to this structure, since the auxiliary roller rotates with the rotation of the roller, it is possible to smoothly rotate the roller. When the auxiliary is not provided, it is possible to smoothly rotate the roller by reducing a friction coefficient of the image carrier surface facing the roller of the supporting member or by forming the supporting member with a high-rigidity material to prevent the deformation thereof.

Further, in the above-mentioned structure, it is preferable that a plurality of the rollers be arranged in the supporting member so as to be opposite to each other with the plurality of light emitting elements interposed therebetween. According to this structure, it is possible to uniformly press the supporting member against the image carrier, and thus to maintain a uniform gap between the light emitting elements and the image carrier. In this structure, it is also preferable that the plurality of light emitting elements be arranged in the direction traversing the image carrier surface, and that the rollers be arranged so as to face the surface of the image carrier over the whole width of the image carrier. According to this structure, it is possible to maintain a uniform gap between the light emitting elements and the image carrier, and to shield light emitted from the light emitting elements by using the roller positioned at both sides of each light emitting element. Therefore, even when the light emitted from the light emitting elements is diffused, it is possible to selectively radiate light emitted from the light emitting elements onto a region of the image carrier interposed between the rollers.

Furthermore, in the above-mentioned structure, it is preferable that the image forming apparatus further include optical elements which are provided between the image carrier and the light emitting elements. For example, condensing lenses for condensing light emitted from the light emitting elements are provided between the image carrier and the light emitting elements. According to this structure, it is possible to effectively emit light from the light emitting elements to the image carrier. In this structure, since the are of a spot image (the area of a region where light emitted from the light emitting element is incident) is markedly changed according to a gap between the image carrier and the light emitting element, an error of the gap between the image carrier and the light emitting element allowable to form a spot image having a predetermined area on the image carrier surface is small, compared with a structure in which the lenses are not provided. According to this aspect, as described above, since it is possible to maintain a substantially uniform gap between the image carrier and the light emitting element, the structure in which the lenses are provided between the light emitting element and the image carrier also makes it possible to accurately form a desired spot image on the image carrier surface.

According to another aspect of the invention, an image forming apparatus includes an image carrier which has a curved image carrier surface moving in a direction (sub-scanning direction); a transmissive sliding member which has a sliding surface coming into surface contact with the image carrier surface, the sliding surface having a curvature substantially equal to that of the image carrier surface; and light emitting elements which are fixed to a surface of the sliding member opposite to the image carrier and which emit light to the image carrier surface to form a latent image on the image carrier. In this structure, the image carrier surface means the surface of the image carrier on which light emitted from the light emitting elements is incident. For example, the image carrier surface is an outer circumferential surface of a cylinder or hollow cylinder or an inner circumferential surface of a hollow cylinder. According to this structure, the light emitting elements are fixed on one surface of the sliding member, and the sliding surface of the sliding member, having a curvature substantially equal to that of the image carrier surface, comes into contact with the image carrier surface. Therefore, as compared with the structure in which the surface of the guide member or the end surface of the light emitting element comes into line contact with the surface of the image carrier, it is possible to accurately arrange the sliding member in a desired posture and at a desired position, and to accurately maintain the desired posture and position of the sliding member by preventing the vibration of the head. That is, it is possible to adjust the gap between the light emitting elements and the image carrier with high accuracy. Thus, the above-mentioned structure makes it possible to reduce a variation in the area or shape of a spot image. As a result, a high-quality image can be stably formed (printed).

Further, in the above-mentioned structure, preferably, the sliding member is arranged on the outside of the image carrier such that the sliding surface thereof comes into surface contact with the image carrier surface, which is an outer circumferential surface of a substantially cylindrical member (that is, a surface of the cylindrical member opposite to a center line thereof). According to this structure, it is possible to easily arrange the sliding member.

Furthermore, in the above-mentioned structure, preferably, the image carrier surface is an inner circumferential surface of a substantially cylindrical member, and the sliding member is arranged on the inside of the image carrier such that the sliding surface thereof comes into surface contact with the image carrier surface. According to this structure, it is possible to reduce a space require for arranging the sliding member.

Moreover, in the above-mentioned structure, it is preferable that the image forming apparatus further include an urging unit which urges the sliding member against the image carrier. According to this structure, it is possible to reliably maintain the posture or position of the sliding member with respect to the image carrier. In this aspect, elastic members, such as springs or rubber, are used for the urging unit. In this structure, the sliding member may be directly urged by the elastic members, or it may be indirectly urged against the image carrier by pressing a member fixed to the sliding member.

Further, in the above-mentioned structure, it is preferable that the light emitting elements be formed on the surface of the sliding member opposite to the sliding surface thereof and that a sealing member be formed on the surface of the sliding member opposite to the sling surface thereof so as to cover the light emitting elements. That is, in a structure in which a transmissive board having the light emitting element formed thereon transmits light emitted from the light emitting elements (a so-called bottom emission type), the board having the light emitting elements formed thereon can be used as the sliding member. According to this structure, it is possible to reduce the number of components and thus to achieve a reduction in manufacturing costs and a decrease in the number of manufacturing processes, compared with a structure in which the sliding member and the board having the light emitting elements formed thereon are composed of different members. Further, in this structure, preferably, a sealing member is formed on the surface of the sliding member opposite to the sliding surface so as to cover the light emitting elements. This structure makes it possible to prevent the deterioration of the light emitting elements due to permeation of air or water.

Furthermore, in the above-mentioned structure, it is preferable that the sliding member have an inclined surface which is positioned between the sliding surface and a side surface thereof located on the upstream side in a rotational direction of the image carrier and that the inclined surface be tilted such that an elevation angle with respect to the image carrier surface is an acute angle. In the structure in which the sliding surface and the side surface of the sliding member positioned on the upstream side in the rotational direction of the image carrier intersect each other at an acute angle, the image carrier surface may be damaged by collision with the edge of the sliding member. In contrast, according to this aspect, since the inclined surface is provided between the side surface and the sliding surface of the sliding member, it is possible to prevent the damage of the image carrier surface due to collision with the sliding member.

Moreover, in the above-mentioned structure, it is preferable that the image forming apparatus further include lenses which are provided between the image carrier surface and the light emitting elements to condense light emitted from the light emitting elements. According to this structure, it is possible to improve the utilization efficiency of light emitted from the light emitting elements. That is, it is possible to more reduce the amount of light required for forming a latent image on the image carrier, compared with the structure in which the lenses are not provided. Thus, it is possible to reduce power consumption and to prevent the deterioration of the light emitting elements.

Further, in the above-mentioned structure, preferably, the sliding member has, on the surface thereof facing the image carrier surface, a first portion in which the light emitting elements are formed and second portions which are positioned at both sides of the first portion in a direction traversing the image carrier surface and which protrude from the first portion toward the image carrier surface. In addition, preferably, the sliding surface is surfaces of the second portions facing the image carrier surface. According to this structure, the light emitting elements and the image carrier surface are separated from each other at a gap corresponding to a step difference between the first and second portions, which makes it possible to prevent the damage or deterioration of the light emitting elements due to contact with the image carrier surface.

Furthermore, in the above-mentioned structure, preferably, the image forming apparatus further includes a substrate which has the light emitting elements formed on a surface thereof facing the image carrier surface, and the sliding member is fixed to the substrate so as to be interposed between the light emitting elements and the image carrier. According to this structure, the substrate and the light emitting elements formed thereon are fixed on one surface of the sliding member, and the sliding surface of the sliding member, having a curvature substantially equal to that of the image carrier surface, comes into surface contact with the image carrier surface. Therefore, as compared with the structure in which the surface of the guide member or the end surface of the light emitting element comes into line contact with the surface of the image carrier, it is possible to accurately arrange the sliding member and the substrate in desired postures and at desired positions, and to accurately maintain the desired postures and positions of the sliding member and substrate by preventing the vibration of the head. That is, it is possible to adjust the gap between the light emitting elements and the image carrier with high accuracy. Thus, in this structure, it is preferable that the sliding member be composed of a sealing member for covering the light emitting elements together with the substrate. The sealing member seals the light emitting elements to protect them from the air.

Moreover, according to still another aspect of the invention, an image forming apparatus includes an image carrier which has an image carrier surface moving in a predetermined direction; a main substrate; light emitting elements which are formed on the main substrate and emit light to form a latent image on the image carrier surface; and a sealing substrate which overlaps the main substrate to seal the light emitting elements. In the image forming apparatus, the main substrate or the sealing substrate constitutes a contact surface coming into contact with the image carrier surface. Cylindrical optical waveguides, each having an end surface constituting a portion of the contact surface, are provided in the substrate constituting the contact surface. The other end surfaces of the optical waveguides cover the light emitting elements. Each optical waveguide guides light incident on the other end surface thereof to the one end surface by specularly reflecting the light from an outer circumferential surface thereof. In the image forming apparatus according to this aspect, the optical waveguides are provided in the substrate facing the image carrier, and the one end surface of each optical waveguide constitutes a portion of the contact surface coming into contact with the image carrier surface. Therefore, the other end surface of each optical waveguide is closer to the light emitting element than the one end surface thereof. In addition, the other end surfaces of the optical waveguides cover the light emitting elements. Most of light components emitted from the light emitting element to the substrate are incident on the other end surface of the cylindrical optical waveguide. The incident light is guided to the one end surface of the optical waveguide without leaking to the outside of the outer circumferential surface of the optical waveguide. Thus, a spot image having the same shape and size as those of the end surface of the optical waveguide is formed on the contact surface.

In general, when the light emitting element formed of a light emitting material, such as an organic EL material, contacts the air, the life span thereof is considerably shortened. Therefore, sealing the light emitting elements is indispensable. The sealing is performed by overlapping the sealing substrate with the main substrate having the light emitting elements formed thereon. Light emitted from the light emitting elements reaches the surface of the image carrier through one of the substrates. The light emitting elements are surface-emitting elements, and light emitted from a light emitting surface (light emitting layer) is diffused while traveling. Meanwhile, in order to ensure a sealing function, the main substrate and the sealing substrate need to have predetermined thicknesses. In general, light emitted from the light emitting surface is largely diffused at a point of time when it is emitted from the substrate. For example, when the light emitting surface has a diameter of 50 μm and a distance from the light emitting surface to the light emission surface of the substrate is 50 μm, a spot image having a diameter of about 100 μm is formed on the light emission surface. When a spot image having a large diameter is formed, the brightness of the spot image is lowered. In order to improve the brightness of the spot image while maintaining the size thereof, it is necessary to improve the brightness of the light emitting surface.

For example, in the above-mentioned structure, in order to raise the brightness level of the spot image to the brightness level of the light emitting surface, it is necessary to raise the brightness of the light emitting surface by four times, which causes the life span of the light emitting element to be shortened. In addition, the larger the diameter of the spot image is, the lower the resolution of the spot image becomes.

When a latent image is formed, the surface of the image carrier moves. Therefore, in contact exposure in which the head comes into contact with the image carrier, a portion of the head coming into contact with the image carrier is worn away. When the contact portion of the head is worn away, an optical path from the light emitting element to the surface of the image carrier varies. As described above, in general, the variation of the optical path causes a change of the size a spot image. That is, a variation in the area or shape of a spot image occurs due to abrasion.

In contrast, in the image forming apparatus according to this aspect, light emitted from the light emitting element is guided, without leaking to the outside of the outer circumferential surface of the optical waveguide, to form a spot image, which makes it possible to achieve a high-definition spot image. In addition, since a spot image having the same size and shape as those of the end surface of the optical waveguide is formed on the contact surface, it is possible to reduce a variation in the area or shape of a spot image. Further, even when the optical waveguide is shortened due to the abrasion of the contact portion, the shape and size of the spot image formed on the contact surface are hardly varied, since the optical waveguide is a cylindrical member which guides light by specularly reflecting the light from the outer circumferential surface thereof and the central axis thereof extends in a direction where the contact surface recedes due to abrasion. Thus, it is possible to reduce a variation in the area or shape of the spot image, and thus to stably form a high-definition spot image. As can be seen from the above description, according to the image forming apparatus of this aspect, regardless of the contact exposure in which the head comes into contact with the image carrier, it is possible to guide light emitted from the light emitting elements without largely diffusing light in a transmissive substrate, and thus stably form a high-definition spot image. As a result, it is possible to stably form (printing) a high-quality image.

Further, in the above-mentioned structure, it is preferable that the optical waveguides are provided so as to pass through the substrate constituting the contact surface. This structure more reliably prevents the diffusion of light emitted from the light emitting elements.

Furthermore, in the above-mentioned structure, preferably, a concave portion is formed in a surface of the substrate constituting the contact surface which faces the image carrier, and an optical waveguide plate is fixed in the concave portion. In addition, preferably, the optical waveguides are formed in the optical waveguide plate. According to this structure, it is possible to more reduce the number of manufacturing processes and manufacturing costs, compare with the structure in which the optical waveguides are formed so as to pass through the substrate constituting the contact surface. As will be described below, this structure can ensure a sealing function. A member having the optical waveguides formed therein may be deformed due to a difference between thermal shrinkage (expansion) of the optical waveguides and thermal shrinkage (expansion) of peripheral portions thereof. In the structure in which the optical waveguides are formed so as to pass through the substrate, a bonding surface of the optical waveguide and the peripheral portion thereof extends from an internal space on the light emitting side to an external space. When a gap is formed along the bonding surface due to the deformation, the sealing function is deteriorated. In contrast, in the structure in which the optical waveguide plate is fixed in the concave portion, the optical waveguides are formed in a member other than the substrate. Therefore, even when a gap is formed along the bonding surface between the optical waveguide and a peripheral portion thereof, the sealing function is not deteriorated since the bonding surface does not extend to the internal space. In addition, since the optical waveguides are formed in the optical waveguide plate, not in the main substrate and the sealing substrate, it is possible to reduce a possibility that the main substrate or the sealing substrate will be deformed due to the difference.

Moreover, in the above-mentioned structure, it is preferable that the substrate constituting the contact surface be the sealing substrate. A method of cutting the substrate can be used to the optical waveguides in the substrate. However, in this aspect, when the method is used, it is preferable to cut the sealing member, not the main substrate requiring a high degree of utilization efficiency of light. Therefore, the utilization efficiency of the mains substrate is not lowered, which is effective in the mass production.

Further, in the above-mentioned structure, it is preferable that the substrate constituting the contact surface be the main substrate. According to this structure, it is possible to more reduce a distance from the light emitting layer to the optical waveguide, compared with the structure in which the substrate constituting the contact surface is the sealing substrate. This structure contributes to an improvement in brightness.

BRIEF DESCRIPTION OF THE DRAWINGS

The invention will be described with reference to the accompanying drawings, wherein like numbers reference like elements.

DETAILED DESCRIPTION OF EMBODIMENTS

Figure 1:
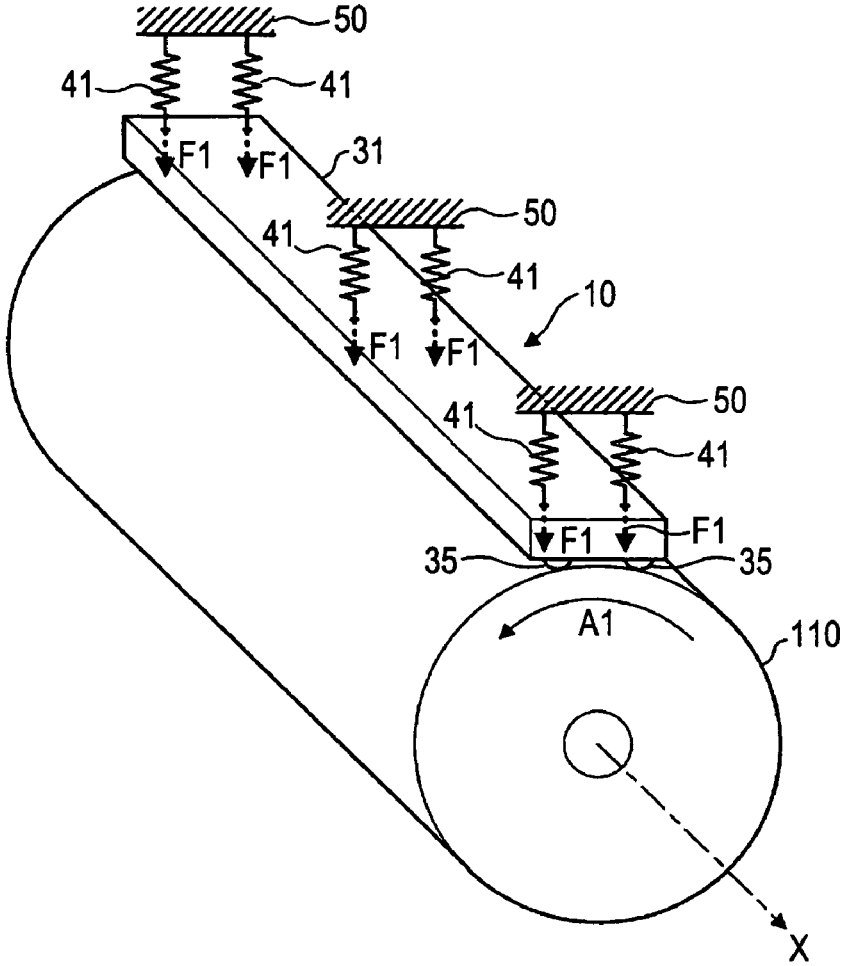
FIG. 1 is a perspective view illustrating the structure of a portion of an image forming apparatus according to a first embodiment of the invention.

In the drawings used for describing the following preferred embodiments of the invention, scales and dimensions of components are different from actual scales and dimensions thereof.

First Embodiment

FIG. 1 is a perspective view illustrating the structure of a portion of an image forming apparatus according to a first embodiment of the invention. The image forming apparatus is used for a printing unit of, for example, a printer, a duplicating machine, or a facsimile. As shown in FIG. 1, the image forming apparatus includes a cylindrical photoreceptor drum 110 which is supported so as to rotate in the direction of arrow A1 and a head 10 which is arranged to face the side surface of the photoreceptor drum 110. When the photoreceptor drum 110 rotates, the surface thereof is advanced. Hereinafter, the direction of a rotational axis of the photoreceptor drum 110 (that is, the direction of a bus of the photoreceptor drum 110 (the main scanning direction)) is referred to as 'a drum axis direction X'.

Figure 2:
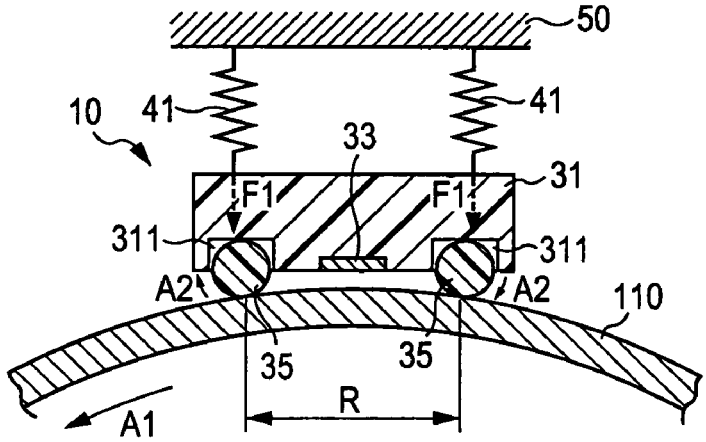
FIG. 2 is a cross-sectional view illustrating the structure of a head and a peripheral portion of the head of the image forming apparatus according to the first embodiment.
Figure 3:
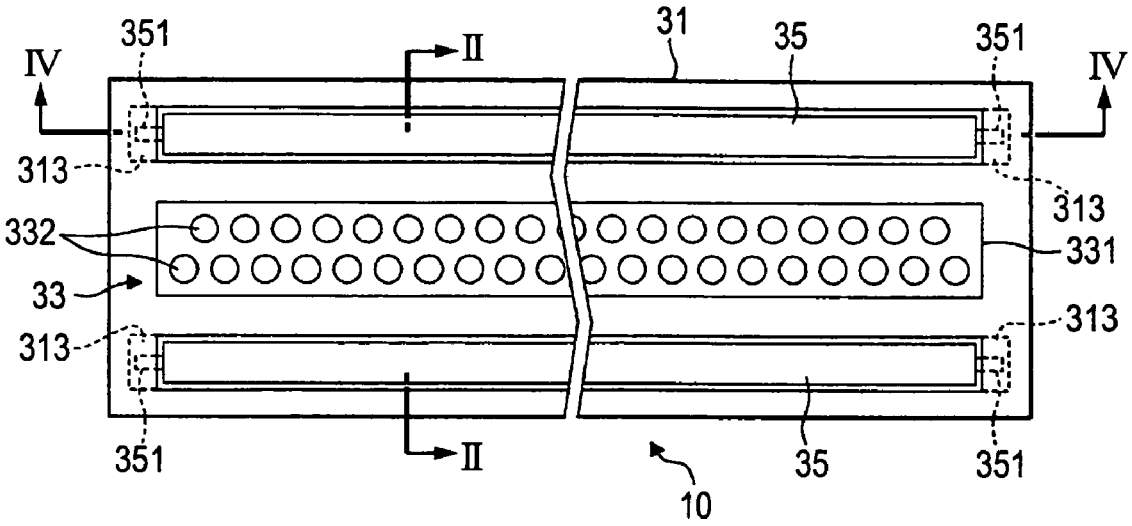
FIG. 3 is a plan view illustrating a surface of the head facing a photoreceptor drum in the image forming apparatus according to the first embodiment.

FIG. 2 is a cross-sectional view illustrating the sectional structure of the components shown in FIG. 1, taken along a direction perpendicular to the drum axis direction X. FIG. 3 is a plan view illustrating an upper surface of the head 10 corresponding to the photoreceptor drum 110. The cross-sectional view taken along the line II-II of FIG. 3 corresponds to FIG. 2. As shown in FIGS. 1 to 3, the head 10 includes a supporting member 31 having a substantially rectangular shape, and a light-emitting device 33 and two rollers 35 which are arranged in portions of the supporting member 31 opposite to the photoreceptor drum 110. The supporting member 31 is formed of, for example, plastic, and the longitudinal direction thereof extends along the drum axis direction X.

The light emitting device 33 emits light to form a latent image on the photoreceptor drum 110. As shown in FIG. 3, the light emitting device 33 includes a substrate 331 having a substantially rectangular shape whose longitudinal direction is the drum axis direction X and a plurality of light emitting elements 332 arranged on the surface of the substrate 331 in an array shape. Each light emitting element 332 is formed by interposing a light emitting layer formed of an organic EL material between an anode and a cathode. As shown in FIG. 3, the light emitting elements 332 are arranged in two rows or in island shapes along the drum axis direction X, and selectively emit light corresponding to an image to be printed on a recording medium, such as a sheet. Light emitted from each light emitting element 332 is incident on the surface of the photoreceptor drum 110. Then, the exposure causes a latent image corresponding to a desired image to be formed on the surface of the photoreceptor drum 110. The arrangement pattern of the light emitting elements 332 is not limited to that shown in FIG. 3. For example, the light emitting elements may be arranged in other patterns, such as in one row or three or more rows.

Meanwhile, each roller 35 is composed of a cylindrical black member having a diameter of about 1 mm to 2 mm, and is formed of a resin material, such as plastic. The total length of the roller 35 is equal to or larger than the width of the photoreceptor drum 110 (dimensions in the drum axis direction X).

Further, grooves 311 are formed in a surface of the supporting member 31 opposite to the photoreceptor drum 110 at both sides of the light emitting device 33. Each groove 311 is a concave portion having a width larger than the diameter of the roller 35 (about 1 mm to 2 mm), and extends in the drum axis direction X, corresponding to the arrangement of the light emitting device 33. Each roller 35 is provided in the groove 311. Therefore, the rotational axis of the roller 35 extends a direction traversing the surface of the photoreceptor drum 110 (that is, a direction parallel to the drum axis direction X). In addition, as described above, since the total length of the roller 35 is equal to or larger than the width of the photoreceptor drum 110, the roller 35 is opposite to the entire surface of the photoreceptor drum 110 in the widthwise direction.

Figure 4:
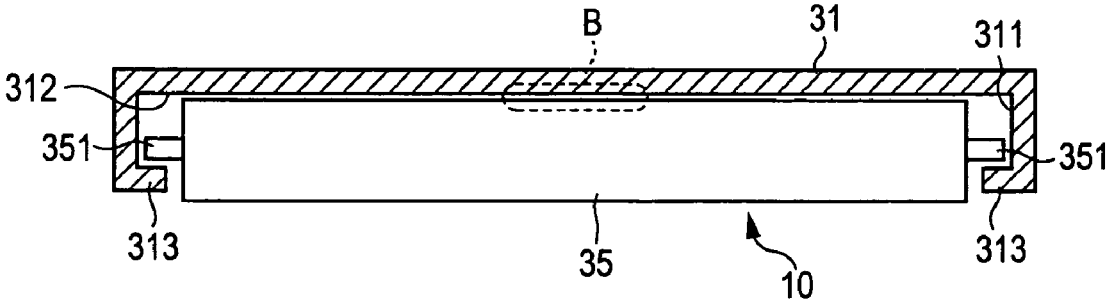
FIG. 4 is a cross-sectional view taken along the line IV-IV of FIG. 3.

FIG. 4 is a cross-sectional view taken along the line IV-IV of FIG. 3. As shown in FIGS. 3 and 4, a shaft portion 351 extending along a center line of the roller 35 is formed at both end surfaces of each roller 35. Meanwhile, cover portions 313 are formed at end portions of the supporting member 31 in the longitudinal direction of each groove 311 such that each of them is opposite to a bottom 312 of the groove 311 with the shaft portion 351 interposed therebetween. The cover portions 313 prevent the rollers 35 from falling off from the supporting member 31.

As shown in FIGS. 2 and 4, the diameter of the roller 35 is larger than the depth of the groove 311. Therefore, a portion of the outer circumferential surface of the roller 35 accommodated in the groove 311 which is opposite to the photoreceptor drum 110 protrudes from the supporting member 31 toward the photoreceptor drum 110. In addition, a portion of the roller 35 opposite to the photoreceptor drum 110 faces the bottom 312 of the groove 311 at a narrow gap.

As shown in FIGS. 1 and 2, a plurality of elastic bodies 41 are arranged on the surface of the supporting member 31 opposite to the photoreceptor drum 110. Each elastic body 41 is a unit for urging the supporting member 31 against the photoreceptor drum 110, and is provided between the supporting member 31 and a case 50 of the image forming apparatus. In the first embodiment, as shown in FIG. 1, six elastic bodies 41 are arranged around four corners of the upper surface of the supporting member 31 and in a central portion thereof in the longitudinal direction.

For example, a coil spring having one end fixed to the supporting member 31 and the other end fixed to the case 50 is used as the elastic body 41. However, the elastic body 41 may have any other shapes. That is, any members can be used as long as they can urge the supporting member 31 against the photoreceptor drum 110. For example, various members, such as a leaf spring and rubber interposed between the supporting member 31 and the case 50, can be used as the elastic bodies 41.

As represented by arrow F1 in FIGS. 1 and 2, the supporting member 31 is urged against the photoreceptor drum 110 by the elastic bodies 41. The urging force causes the roller 35 to be pressed against the surface of the photoreceptor drum 110, so that friction force is generated between the roller 35 and the photoreceptor drum 110. As a result, the photoreceptor drum 110 rotates in the direction of arrow A1 in FIG. 2, which causes the roller 35 to rotate in the direction of arrow A2.

As described above, in the first embodiment, the elastic bodies 41 press the supporting member 31 to allow the roller to come into contact with the surface of the photoreceptor drum 110. Therefore, even when errors occur in the dimensions of the head 10 and the photoreceptor drum 110 or in the mounting positions thereof, or even when surface deflection occurs in the surface of the photoreceptor drum 110 due to insufficient circularity of the cross section of the photoreceptor drum 110 or an error in the drum axis direction X, each light emitting element 332 follows the surface of the photoreceptor drum 110. Therefore, it is possible to maintain a predetermined gap between the light emitting elements 332 and the photoreceptor drum 110.

Further, the rollers 35 of the head 10 come into contact with the surface of the photoreceptor drum 110 and rotate with the revolution of the photoreceptor drum 110, which makes it possible to solve various problems due to contact between the head 10 and the photoreceptor drum 110.

For example, the related art has a problem in that the head vibrates due to contact with the photoreceptor drum. However, in the first embodiment, friction force generated from the photoreceptor drum 110 is hardly applied to the head 10, making it possible to prevent the vibration of the head 10 due to the rotation of the photoreceptor drum 110. Therefore, it is possible to keep a predetermined gap between the light emitting elements 332 and the photoreceptor drum 110 with high accuracy. In addition, this structure has an advantage of reducing the friction of a contact portion between the head 10 and the photoreceptor drum 110, compared with the structure in which the photoreceptor drum rotates with its surface coming into contact with the head. Therefore, it is possible to prevent a variation in the gap between the light emitting element 332 and the photoreceptor drum 110 with the passage of time, and thus to maintain a uniform gap therebetween.

In general, a variation in the area or shape of a spot image formed on the surface of the photoreceptor drum may be caused by, for example, an error in the dimensions of the head or the photoreceptor drum or an error in the mounting positions thereof. In contrast, the structure according to the first embodiment can absorb these errors, which makes it possible to maintain a predetermined gap between the light emitting element 332 and the photoreceptor drum 110.

As described above, according to the first embodiment, it is possible to reduce a variation in the area or shape of the spot image formed on the surface of the photoreceptor drum 110. In addition, according to the first embodiment, a predetermined amount of light is radiated onto a region where the spot image is formed, and thus a clear spot image can be obtained. Further, according to the first embodiment, even when a foreign matter is caught between the roller 35 and the photoreceptor drum 110, the foreign matter can be rapidly removed by the rotation of the roller 35, which prevents the surface of the photoreceptor drum 110 from being damaged due to the foreign matter.

Furthermore, according to the first embodiment, a plurality of elastic bodies 41 is evenly arranged on the upper surface of the supporting member 31. This structure makes it possible to uniformly press, for example the supporting member 31, compared with a structure in which the elastic bodies 41 are unevenly arranged in a predetermined region on the upper surface of the supporting member 31. Therefore, it is possible to maintain a uniform gap between the light emitting elements 332 and the photoreceptor drum 110.

As shown in FIG. 1, when the elastic bodies 41 are arranged at the central portion of the supporting member 31 in the longitudinal direction thereof, the supporting member 31 may be bent due to the pressing force by the elastic bodies 41 or the weight of the supporting member 31. In this case, the bottom 312 of the groove 311 may come into contact with the roller 35 in a portion B shown in FIG. 4, and thus friction therebetween may interrupt the rotation of roller 35. Therefore, it is preferable that the bottom 312 of the groove 311 formed in the supporting member 31 and the outer circumferential surface of the roller 35 have a small friction coefficient. Thus, the first embodiment adopts this structure. Accordingly, even when the bottom 312 of the groove 311 comes into contact with the roller 35, friction force generated from a contact portion therebetween is sufficiently small, which results in smooth rotation of the roller 35. Alternatively, the supporting member 31 may be formed of a material having sufficiently high rigidity. This structure prevents the supporting member 31 from being curved, which makes it possible to avoid the contact between the roller 35 and the bottom 312. In addition, a structure in which the elastic bodies 41 are not arranged at the central portion of the supporting member 31 in the longitudinal direction thereof (for example, a structure in which the elastic bodies 41 are formed only in the vicinities of the four corners of the upper surface of the supporting member 31) may be used. In this case, it is also possible to prevent the curve of the supporting member 31 which interrupts the rotation of the roller 35.

Moreover, according to the first embodiment, the rollers 35 arranged at both sides of the light emitting elements 332 have a light shielding property. According to this structure, light which has been emitted from the light emitting elements 332 and then has been diffused at a wide angle is shielded by the roller 35. Therefore, it is possible to selectively radiate light from the light emitting elements 332 onto only a region on the surface of the photoreceptor drum 110 between the rollers 35 (a region R shown in FIG. 2). As a result, a high-definition image can be printed. In particular, in the first embodiment, since the rollers 35 are opposite to the entire surface of the photoreceptor drum 110 in the widthwise direction thereof, it is possible to prevent light emitted from the light emitting elements 332 from being diffused on the entire surface of the photoreceptor drum 110.

Second Embodiment

Figure 5:
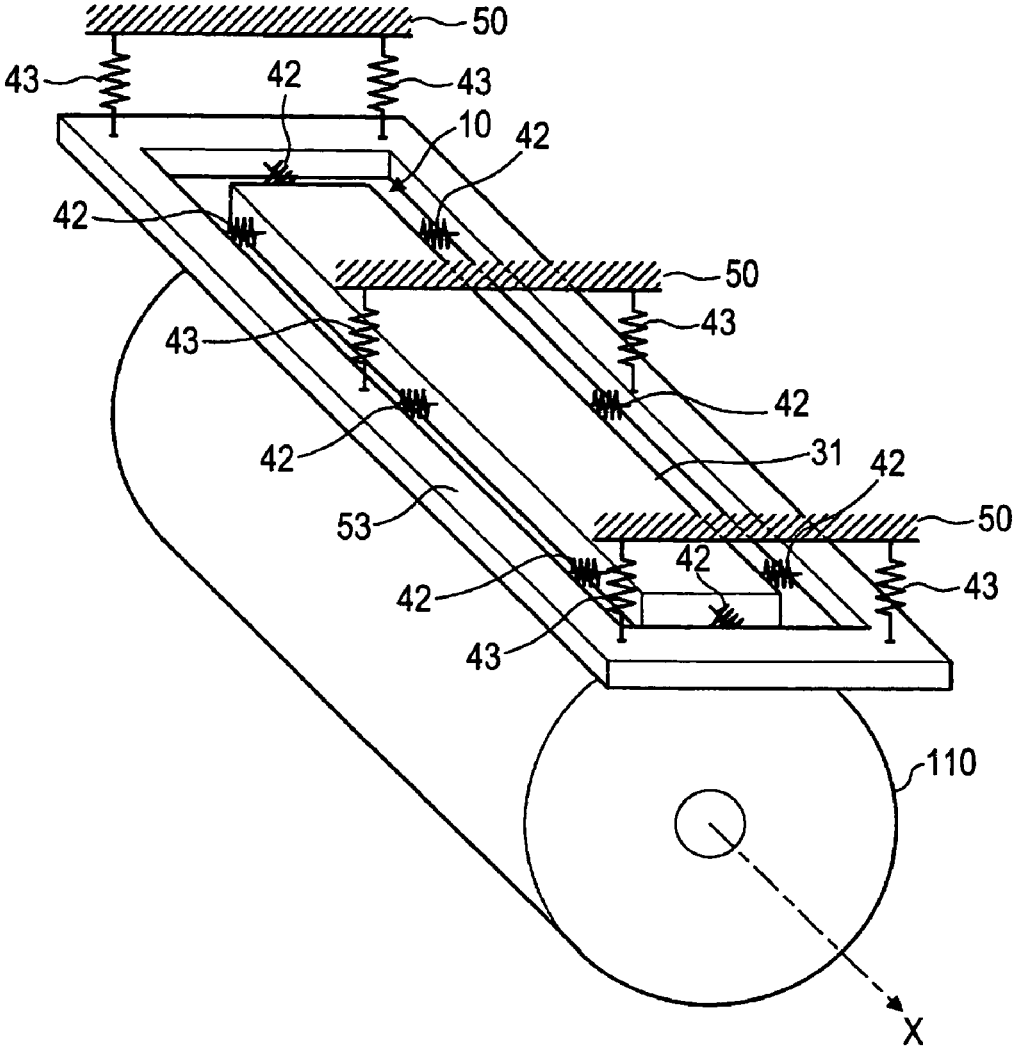
FIG. 5 is a perspective view illustrating the structure of a portion of an image forming apparatus according to a second embodiment of the invention.

FIG. 5 is a perspective view illustrating the structure of a portion of an image forming apparatus according to a second embodiment of the invention. In the first embodiment, the elastic bodies 41 for pressing the supporting member 31 against the photoreceptor drum 110 is arranged on the upper surface of the supporting member 31. However, in the second embodiment, elastic bodies provided on the side surfaces of the supporting member 31 urge the supporting member 31 against the photoreceptor drum 110.

Figure 6:
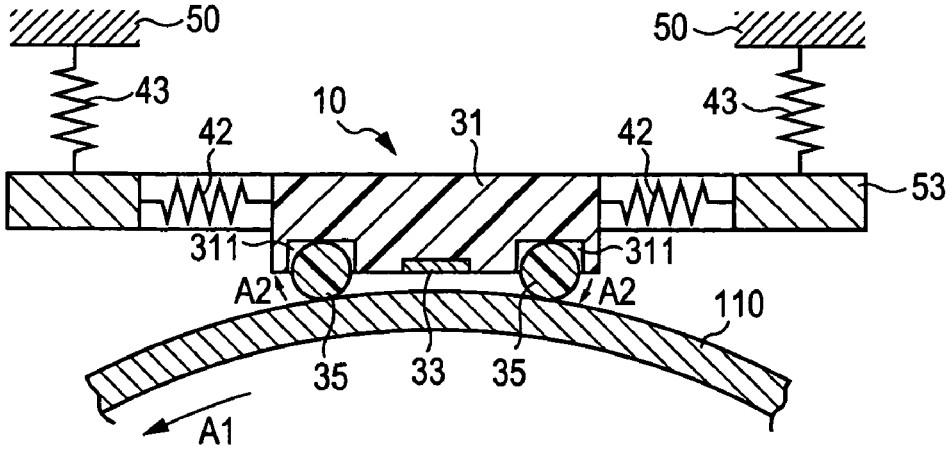
FIG. 6 is a cross-sectional view illustrating the structure of a head and a peripheral portion of the head of the image forming apparatus according to the second embodiment.

FIG. 6 is a cross-sectional view illustrating the sectional structure of the components shown in FIG. 5, taken along a direction perpendicular to the drum axis direction X, and corresponds to FIG. 2 in the first embodiment. As shown in FIGS. 5 and 6, the image forming apparatus according to the second embodiment has a substantially rectangular frame member 53 surrounding the head 10. An inner circumferential surface of the frame member 53 corresponds to a side surface of the supporting member 31.

A plurality of elastic bodies 42 is provided between the inner circumferential surface of the frame member 53 and the side surface of supporting member 31. An end of each elastic body 42 is fixed to the inner circumferential surface of the frame member 53, and the other end thereof is fixed to the side surface of the supporting member 31. More specifically, as shown in FIG. 5, three elastic bodies 42 are arranged at equal intervals on the side surface corresponding to each long side of the substantially rectangular supporting member 31 such that an end of each of the three elastic bodies 42 is fixed to the side surface of the supporting member 31 and the other end thereof is fixed to the inner surface of the frame member 53 opposite to the side surface of the supporting member 31. In addition, an end of one elastic body 42 is fixed in the center of the side surface corresponding to each short side of the supporting member 31, and the other end of the elastic body 42 is fixed to the inner circumferential surface of the frame member 53 opposite to the side surface of the supporting member 31.

Further, a plurality of elastic bodies 43 is arranged on a surface of the frame member 53 opposite to the photoreceptor drum 10. The elastic bodies 43 are members for urging the frame member 53 against the photoreceptor drum 110, and are provided between the case 50 of the image forming apparatus and the frame member 53. In the second embodiment, six elastic bodies 43 are arranged around four corners of the frame member 53 and in a central portion thereof in the longitudinal direction. The elastic bodies 42 and 43 are the same components as the elastic bodies 41 of the first embodiment. For example, coil springs or leaf springs are used as the elastic bodies 42 and 43.

In the above-mentioned structure, when the elastic bodies 43 urge the frame member 53 against the photoreceptor drum 110, the elastic bodies 42 are extended. Then, the supporting member 31 is urged against the photoreceptor drum 110 by elastic force generated by the elastic bodies 42. Therefore, in the second embodiment, the rollers 35 is also pressed against the photoreceptor 110, and thus the same effects as those in the first embodiment can be obtained. The frame member 53 can have any shapes as long as it has a portion opposite to the side surface of the supporting member 31. Therefore, the shape of the frame member 53 is not limited to that shown in FIG. 5.

Figure 7:
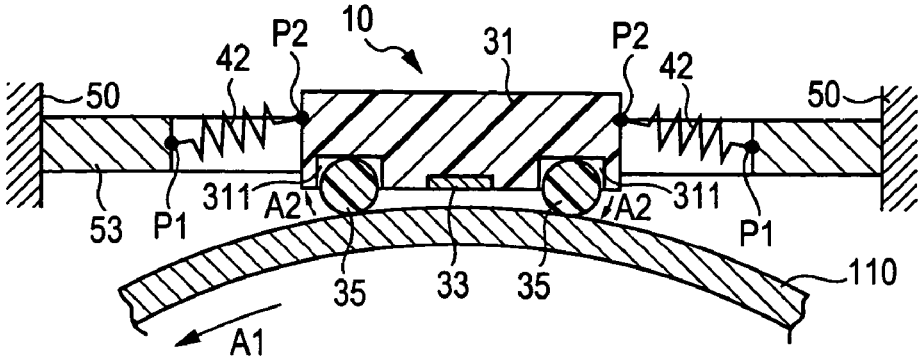
FIG. 7 is a cross-sectional view illustrating the structure of a head and a peripheral portion of the head of another image forming apparatus according to the second embodiment.

In the above-mentioned structure, the elastic bodies 43 press the frame member 53 against the photoreceptor drum 110. However, as shown in FIG. 7, the supporting member 31 may be urged against the photoreceptor 110 according to the fixed position of the frame member 53. That is, in this structure, the frame member 53 is fixed to the case 50 such that an end portion P1 of each elastic body 42 fixed to the frame member 53 is positioned closer to the photoreceptor drum 110 than an end portion P2 of the elastic body 42 fixed to the supporting member 31. In this structure, the elastic force of the elastic bodies 42 causes the supporting member 31 to be pressed against the photoreceptor drum 110, and thus the same effects as those in the first and second embodiment can be obtained. In addition, according to this structure, it is unnecessary to provide the elastic bodies 43 on the surfaces of the supporting member 31 and the frame member 53 opposite to the photoreceptor drum 110, which results in a reduction in a space to be ensured on the upper side of the head 10.

Modifications of First and Second Embodiments

Various modifications of the above-mentioned embodiments can be made. The modifications thereof will be described in detail. The following modifications may be appropriately combined.

First Modification

Figure 8:
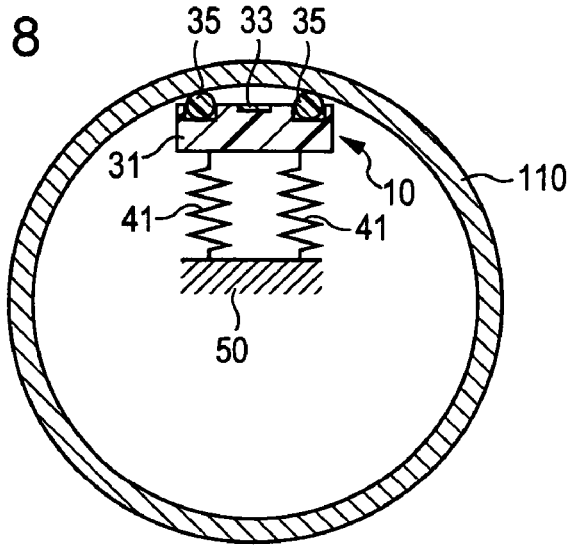
FIG. 8 is a cross-sectional view illustrating the structure of an image forming apparatus according to a first modification of the first embodiment.

In the above-mentioned embodiments, the head 10 is arranged so as to face the outer circumferential surface of the cylindrical photoreceptor drum 110. However, as shown in FIG. 8, the head 10 may be arranged inside the photoreceptor drum 110 such that the light emitting device 33 and the rollers 35 are opposite to the inner circumferential surface of the photoreceptor drum 110. In this structure, the photoreceptor drum 110 is formed by laminating a photosensitive layer on a cylindrical outer circumferential surface having a transmissive property. According to this structure, it is possible to reduce a space required for arranging the head 10, compared with the structures described in the above-mentioned embodiments.

Second Modification

Figure 9:
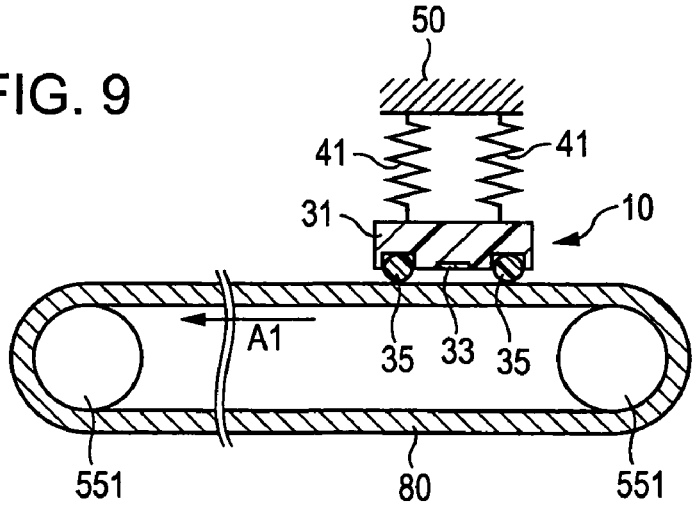
FIG. 9 is a cross-sectional view illustrating the structure of an image forming apparatus according to a second modification of the first embodiment.

In the above-mentioned embodiments, the cylindrical photoreceptor drum 110 is used as an image carrier. However, as shown in FIG. 9, an endless belt 80 which is wound around a plurality of rollers 551 and rotates in the direction of arrow A1 may be used as the image carrier. In FIG. 9, the head 10 is arranged to face the outer circumferential surface of the endless belt 80. However, similar to the structure shown in FIG. 8, the head 10 may be arranged to face the inner circumferential surface of the endless belt 80. In FIGS. 8 and 9, the head 10 is urged by the structure according to the first embodiment. However, the structure of the second embodiment may be applied to this modification. As described above, in this modification, it is preferable that the rollers be provided in the supporting member such that rotational axes thereof is arranged to traverse the surface of the image carrier (in the direction of a bus of the image carrier), and the shape of the image carrier does not matter.

Third Embodiment

Figure 10:
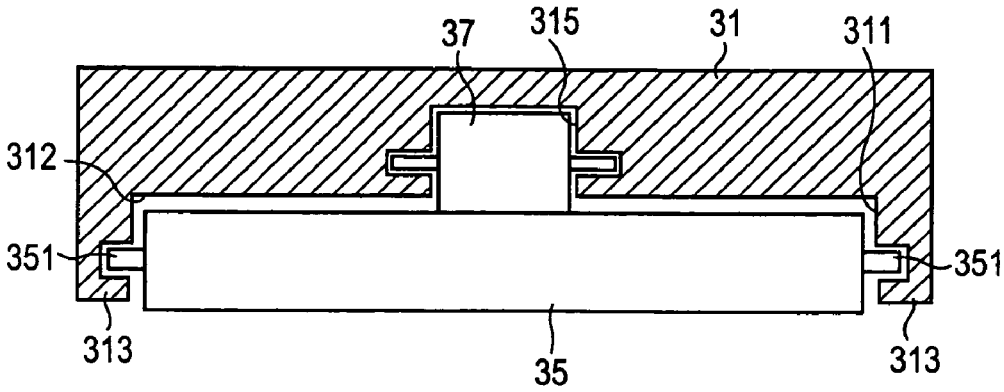
FIG. 10 is a cross-sectional view illustrating the structure of a roller and a peripheral portion of the roller of an image forming apparatus according to a third modification of the first or second embodiment.

As described in the first embodiment, when the bottom 312 of the groove 311 formed in the supporting member 31 comes into contact with the roller 35, the rotation of the roller 35 is interrupted. In order to solve the problem, in the first embodiment, the bottom 312 of the groove 311 having a small friction coefficient is used. However, the structure shown in FIG. 10 can also smoothly rotate the rollers 35. In the structure shown in FIG. 10, a concave portion 315 is formed in the bottom 312 of the groove 311 of the supporting member 31, and an auxiliary roller 37 is arranged in the concave portion 315. The auxiliary roller 37 is a cylindrical member whose rotational axis extends parallel to the roller 35, and is provided in the supporting member 31 with its side surface coming into contact with the side surface of the roller 35. When the roller 35 rotates with the revolution of the photoreceptor drum 110, the auxiliary roller 37 rotates following the rotation of the roller 35. According to this structure, the bottom 312 of the groove 311 does not contact the roller 35, which makes it possible to smoothly rotate the roller 35.

Fourth Modification

In the above-mentioned embodiments, the light emitting device 33 is opposite to the photoreceptor drum 110 without any members interposed therebetween (that is, any members are not provided between the light emitting device 33 and the photoreceptor drum 110). However, optical members may be provided between the light emitting device 33 and the photoreceptor drum 110. For example, an optical waveguide (for example, an optical fiber) for guiding light emitted from the light emitting elements 332 to the surface of the photoreceptor drum 110 or a lens (for example, a condensing lens array) for condensing light emitted from the light emitting elements 332 may be provided between the light emitting device 33 and the photoreceptor drum 110.

Figure 11:
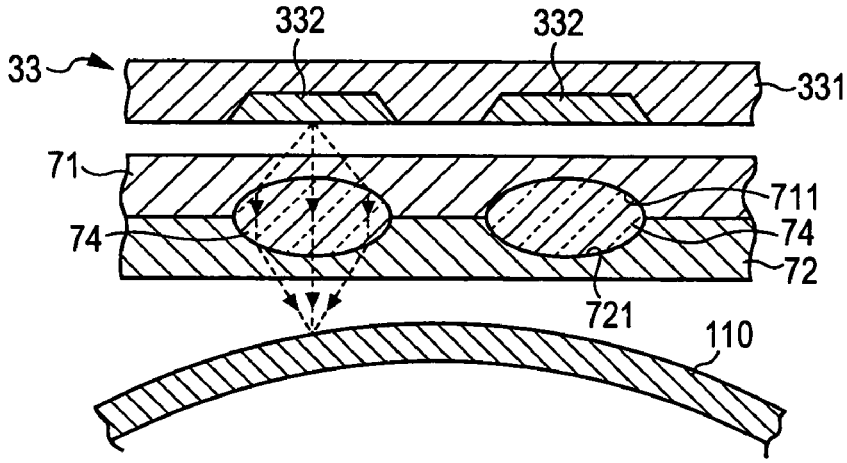
FIG. 11 is a cross-sectional view illustrating the structure of an image forming apparatus according to a fourth modification of the first embodiment.

Further, as shown in FIG. 11, microlenses 74 for condensing light emitted from the light emitting elements 332 may be provided between the light emitting device 33 and the photoreceptor drum 110 (fourth modification). The microlenses 74 are arranged in an array shape so as to be opposite to the light emitting elements 332. In the structure shown in FIG. 11, first and second substrates 71 and 72 bonded to each other are arranged in a space between the light emitting device 33 and the photoreceptor drum 110. A plurality of curved-shaped concave portions 711 are formed in a surface of the first substrate 71 opposite to the second substrate 72 at positions corresponding to the light emitting elements 332, and a plurality of curved-shaped concave portions 721 are formed in a surface of the second substrate 72 opposite to the second substrate 71. A resin material having a different reflective index from those of the first and second substrates 71 and 72 is filled up into spaces formed by the concave portions 711 of the first substrate 71 and the concave portions 721 of the substrate 72. The microlenses 74, which are double-sided convex lenses, are formed by the resin material. As represented by two-dot chain lines in FIG. 11, the microlenses 74 condense light emitted from the corresponding light emitting elements 332, so that an image is formed on the surface of the photoreceptor drum 110. The shape and arrangement of the microlenses 74 are not limited to those shown in FIG. 11. For example, convex microlenses protruding toward the photoreceptor drum 110 may be formed on a substrate 331 of the light emitting device 33.

In the structure in which light emitted from the light emitting elements 332 is condensed by the microlenses 74, even when a distance between the light emitting element 332 and the photoreceptor drum 110 varies slightly, a variation in the diameter of a spot region on the surface of the photoreceptor drum 110 where light emitted from the light emitting element 332 is incident becomes remarkable. According to the fourth modification, the roller 35 makes it possible to maintain a uniform gap between the light emitting device 33 and the photoreceptor drum 110 with high accuracy. Therefore, in the structure capable of improving the utilization efficiency of light by using the microlenses 74, it is also possible to accurately form a predetermined latent image on the surface of the photoreceptor drum 110. That is, the effects of maintaining a uniform gap between the light emitting device 33 and the photoreceptor drum 110 can be more reliably obtained by the structure in which optical components, such as the microlenses 74, are arranged between the light emitting device 33 and the photoreceptor drum 110, as shown in FIG. 11. In addition, as described in the above-mentioned embodiment, the structure in which the light emitting device 33 is adjacent to the photoreceptor drum 110 without any members interposed therebetween makes it possible to improve the utilization efficiency of light emitted from the light emitting elements 332 and to reduce manufacturing costs. Further, it is possible to reduce the brightness of the light emitting elements required for emitting a sufficient amount of light to the surface of the photoreceptor drum 110. As a result, the power consumption of the light emitting device 33 can be reduced, and the life span of the light emitting element 332 can be prolonged.

Fifth Modification

Figure 12:
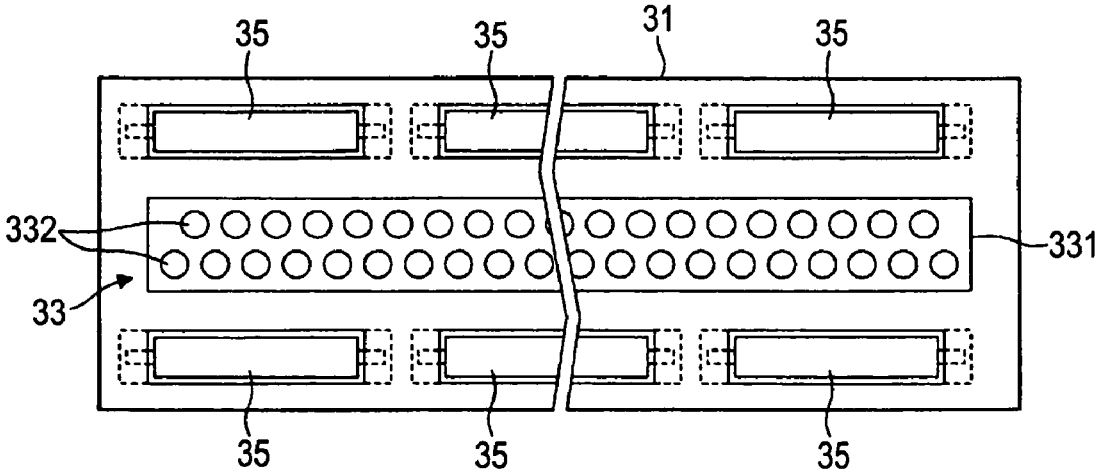
FIG. 12 is a plan view illustrating a surface of a head facing a photoreceptor drum in an image forming apparatus according to a fifth embodiment of the first or second embodiment.

In the above-mentioned embodiments, two rollers 35 are arranged at both sides of the light emitting device 33. However, the number of rollers 35 and the positions thereof can be changed. In the first embodiment, the light-shielding rollers 35 prevent the diffusion of light emitted from the light emitting elements 332. The roller 35 may be formed of a transmissive material, or the total length of the roller 35 may be smaller than the width of the photoreceptor drum 110 as long as the diffusion of light emitted from the light emitting elements 332 does not matter particularly (for example, a member for shielding diffused light is separately provided from the roller 35, or the diffusion of light is suppressed by an optical component such as a lens). In addition, as shown in FIG. 12, a plurality of rollers 35 may be arranged in straight lines at regular intervals.

Third Embodiment

Figure 13:
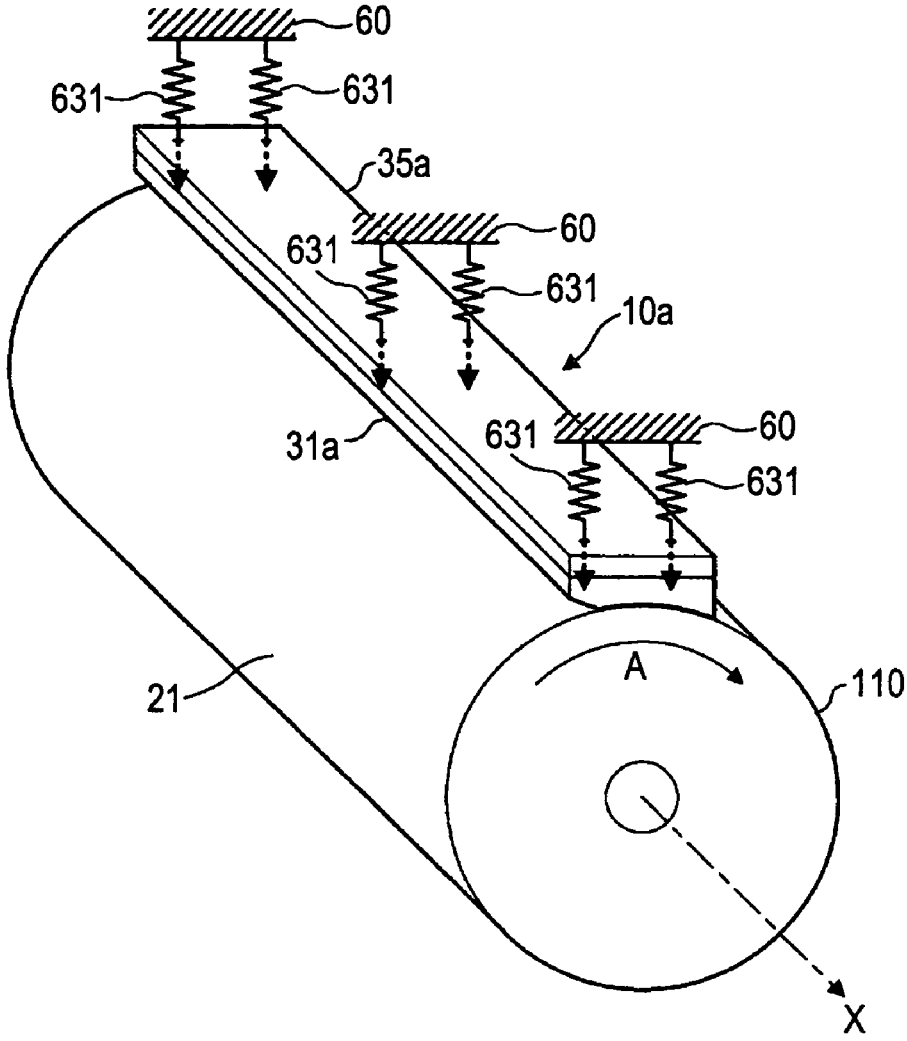
FIG. 13 is a perspective view illustrating the structure of a portion of an image forming apparatus according to a third embodiment of the invention.

FIG. 13 is a perspective view illustrating the structure of a portion of an image forming apparatus according to a third embodiment of the invention. The image forming apparatus is used for a printing unit of, for example, a printer, a duplicating machine, or a facsimile. As shown in FIG. 13, the image forming apparatus includes a cylindrical photoreceptor drum 110 which is supported so as to rotate in the direction of arrow A (sub-scanning direction) and a head 10*a* which is arranged to face an outer circumferential surface 21 of the photoreceptor drum 110. Hereinafter, the direction of a rotational axis of the photoreceptor drum 110 (that is, the direction of a bus of the photoreceptor drum 110 (the main scanning direction)) is referred to as a 'drum axis direction X'.

Figure 14:
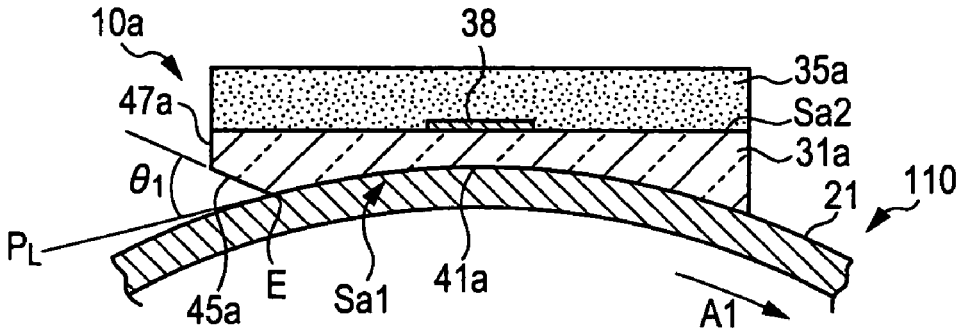
FIG. 14 is a cross-sectional view illustrating the structure of a head and a peripheral portion of the head of an image forming apparatus according to the third embodiment.

FIG. 14 is a cross-sectional view illustrating a head of the image forming apparatus according to the third embodiment and the peripheral structure thereof, taken along a direction perpendicular to the drum axis direction X shown in FIG. 13. As shown in FIGS. 13 and 14, the head 10*a* includes a substantially rectangular substrate 31*a* whose longitudinal direction is the drum axis direction X and which is opposite to the outer circumferential surface 21 of the photoreceptor drum 110, a plurality of light emitting elements 38 formed on an element forming surface Sa2 (one surface of the substrate 31*a*) opposite to a drum opposing surface Sa1 which faces the photoreceptor drum 110, and a sealing member 35*a* which is formed on the element forming surface Sa2 of the substrate 31*a* so as to cover the light emitting elements 38. The sealing member 35*a* is a film formed of various resin material, such as an acryl-based resin and an epoxy-based resin. The sealing member 35*a* covering the light emitting elements 38 makes it possible to prevent the deterioration of the light emitting elements 38 due to permeation of air and water.

As shown in FIG. 13, a plurality of elastic bodies 631 is arranged on the surface of the sealing member 35*a*. Each elastic body 631 is a unit for elastically urging the head 10*a* against the photoreceptor drum 110, and is provided between the head 10*a* and a case 60 of the image forming apparatus. In the third embodiment, six elastic bodies 631 are arranged around four corners of the surface of the sealing member 35*a* and in a central portion thereof in the longitudinal direction. For example, a coil spring having one end fixed to the head 10*a* and the other end fixed to the case 60 is used as the elastic body 631. However, the elastic body 631 may have any other shapes. For example, various members, such as a leaf spring and rubber interposed between the sealing member 35*a* and the case 60, can be used as the elastic bodies 631.

Figure 15:
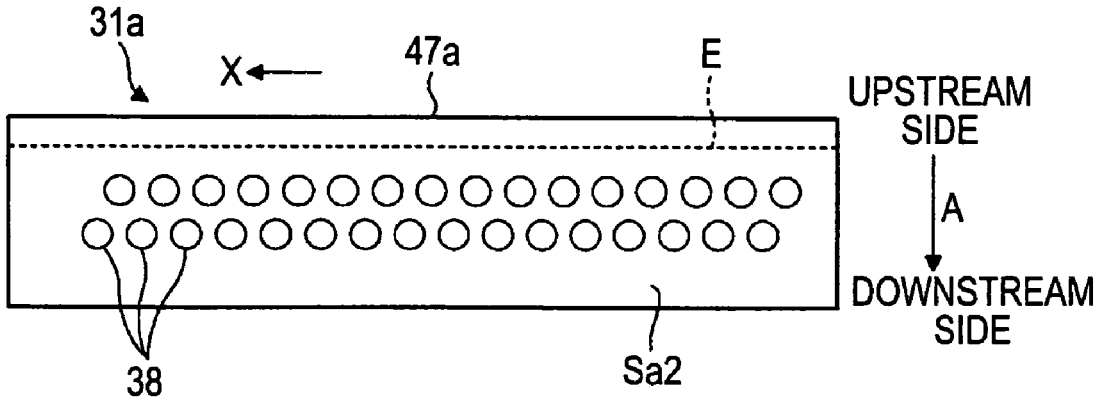
FIG. 15 is a plan view illustrating an element forming surface of a substrate of the image forming apparatus according to the third embodiment.

The substrate 31*a* shown in FIGS. 13 and 14 is a plate member formed of a transmissive material, such as glass or plastic. Each light emitting element 38 is formed by interposing a light emitting layer formed of an organic EL material between an anode and a cathode, and emits light when electric energy is applied. FIG. 15 is a plan view illustrating the element forming surface Sa2 of the substrate 31*a*. As shown in FIG. 15, the light emitting elements 38 are arranged in two rows or in island shapes along the drum axis direction X, and selectively emit light corresponding to an image to be printed on a recording medium, such as a sheet. Light emitted from each light emitting element 38 is incident on the surface of the photoreceptor drum 110 through the substrate 31*a*. That is, the head 10*a* of the third embodiment is of a bottom emission type. Then, the exposure by the head 10*a* causes a latent image corresponding to a desired image to be formed on the surface of the photoreceptor drum 110. The arrangement pattern of the light emitting elements 38 is not limited to that shown in FIG. 15. For example, the light emitting elements may be arranged in other patterns, such as in one row or three or more rows.

Figure 16:
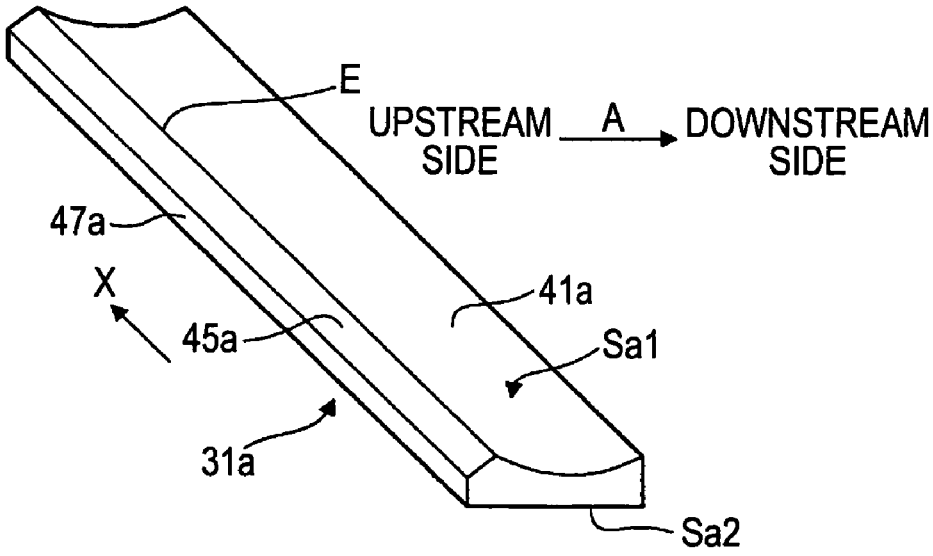
FIG. 16 is a perspective view illustrating the appearance of the substrate of the image forming apparatus according to the third embodiment.

Next, FIG. 16 is a perspective view illustrating the appearance of the substrate 31*a*. In FIG. 16, the drum opposing surface Sa1 is positioned on the upper side (that is, the position of the substrate 31*a* is reverse to the position of the substrate 31*a* shown in FIG. 13 or 14 in the vertical direction). As shown in FIG. 16, the drum opposing surface Sa1 of the substrate 31*a* includes a sliding surface 41*a* and an inclined surface 45*a*. As shown in FIGS. 14 and 16, the sliding surface 41*a* is a curved surface (concave surface) which is recessed toward the opposite side to the photoreceptor drum 110 with a curvature substantially equal to that of the outer circumferential surface 21 of the photoreceptor drum 110. That is, the sliding surface 41*a* can be referred to as a portion of the inner surface (inner circumferential surface) of a cylinder which has a radius substantially equal to the outer circumferential surface 21 of the photoreceptor drum 110. When the elastic bodies 631 urge the head 10*a* against the photoreceptor drum 110, the entire sliding surface 41*a* of the substrate 31*a* comes into contact with the outer circumferential surface 21 of the photoreceptor drum without a gap therebetween.

Meanwhile, the inclined surface 45*a* is positioned between the sliding surface 41*a* and a side surface 47*a* located at the upstream side of the substrate 31*a* in a rotational direction A of the photoreceptor drum 110. As shown in FIG. 14, the inclined surface 45*a* is tilted with respect to the outer circumferential surface 21 such that an elevation angle θ1 with respect to the outer circumferential surface 21 of the photoreceptor drum 110 is an acute angle. The elevation angle θ1 is an angle formed between the inclined surface 45*a* and a tangent line PL of the outer circumferential surface 21 at an edge E positioned on the upstream side of the sliding surface 41*a* in the rotational direction A of the photoreceptor drum 110. As described above, a portion of the substrate 31*a* which is opposite to the photoreceptor drum 110 and is positioned on the upstream side in the rotational direction A is chamfered. Therefore, as shown in FIG. 14, the sliding surface 41*a* comes into contact with the outer circumferential surface 21 of the photoreceptor drum 110, and the inclined surface 45*a* is opposite to the outer circumferential surface 21 of the photoreceptor drum 110 with a gap therebetween. The shape of the substrate 31*a* is formed by mechanically or chemically polishing the surface of a substantially rectangular plate.

As described above, in the third embodiment, the sliding surface 41*a* having a curvature substantially equal to that of the outer circumferential surface 21 of the photoreceptor drum 110 comes into contact with the outer circumferential surface 21 of the photoreceptor drum 110. Therefore, it is possible to accurately maintain a predetermined distance between the light emitting elements 38 and the outer circumferential surface 21 of the photoreceptor drum 110, compared with the structure in which the drum opposing surface Sa1 is flat. This effect will be described below.

Figure 17A:
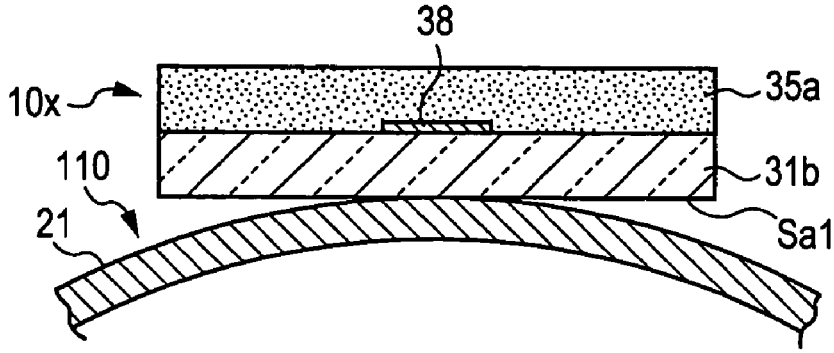
FIGS. 17A to 17C are cross-sectional views illustrating the structure of an image forming apparatus compared with the image forming apparatus according to the third embodiment and the structural defect thereof.
Figure 17B:
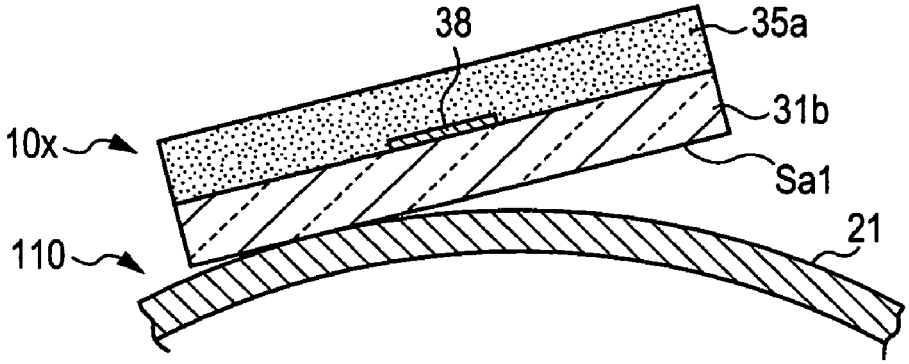
Figure 17C:
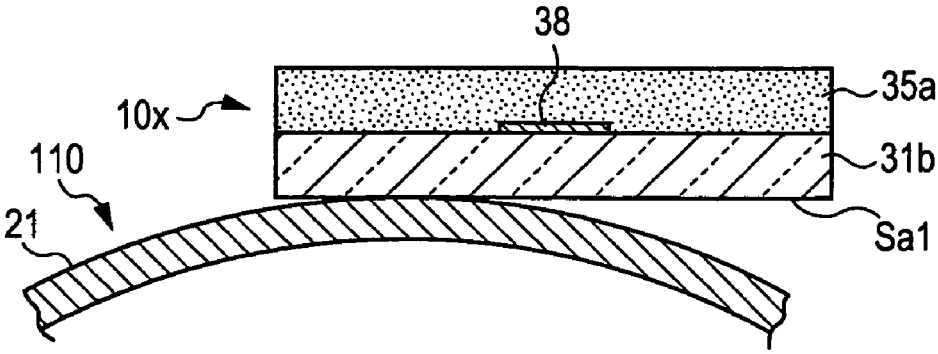

As a structure compared with the third embodiment, a head 10*x* including a substrate 31*b* having a flat drum opposing surface Sa1 is considered, as shown in FIG. 17A. This structure has a problem in that the position or posture of the head 10*x* with respect to the photoreceptor drum 110 is unstable since the drum opposing surface Sa1 comes into line contact with the outer circumferential surface 21 of the photoreceptor drum 110. For example, as shown in FIG. 17A, even when the head 10*x* is maintained such that the drum opposing surface Sa1 is arranged in a substantially horizontal direction, the head 10*x* rotates on a contact line between the drum opposing surface Sa1 and the outer circumferential surface 21. As a result, the head 10*x* may be inclined, as shown in FIG. 17B. In addition, for example, when the photoreceptor drum 110 rotates, the position of the head 10*x* may be changed from the original position to the horizontal position by friction force acting from the photoreceptor drum 110 to the head 10*x* or other factors (for example, external force), as shown in FIG. 17C. In both cases shown in FIGS. 17B and 17C, a distance between the light emitting element 38 and the outer circumferential surface 21 of the photoreceptor drum 110 is larger than that of the ideal structure shown in FIG. 17A. When the distance between the light emitting element 38 and the photoreceptor drum 110 is changed, a variation in the area or shape of a region (spot) of the outer circumferential surface 21 of the photoreceptor drum 110 where light emitted from the light emitting elements 38 is incident occurs, which makes it difficult to form a high-definition image.

In contrast, in the third embodiment, the surface contact between the sliding surface 41*a* and the outer circumferential surface 21 of the photoreceptor drum 110 enables a stable posture or position of the head 10*a* with respect to the photoreceptor drum 110. That is, the surface contact therebetween effectively prevents the inclination of the head 10*a* as shown in FIG. 17B or the displacement of the head 10*a* in the horizontal direction as shown in FIG. 17C. Therefore, it is possible to maintain a predetermined distance between the photoreceptor drum 110 and the light emitting elements 38, and thus to form a high-definition image. In particular, in the third embodiment, a plurality of elastic bodies 631 which are evenly formed on the surface of the sealing member 35*a* urge the head 10*a* against the photoreceptor drum 110 with uniform force. Thus, it is possible to reliably and stably maintain the posture or position of the head 10*a* by the surface contact between the sliding surface 41*a* and the outer circumferential surface 21 of the photoreceptor drum 110.

Figure 27:
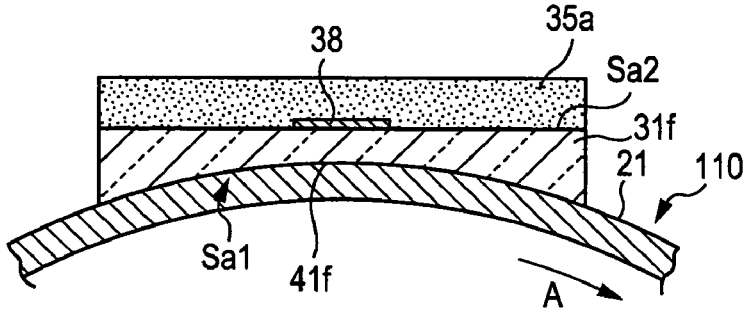
FIG. 27 is a cross-sectional view illustrating the structure of a head of an image forming apparatus according to a first modification of the third or sixth embodiment.

Further, in the third embodiment, since a portion of the drum opposing surface Sa1 of the substrate 31*a* arranged on the upstream side thereof in the rotational direction A of the photoreceptor drum 110 serves as the inclined surface 45*a*, it is possible to prevent the damage of the outer circumferential surface 21 due to collision between the drum opposing surface Sa1 and the outer circumferential surface 21 of the photoreceptor drum 110. For example, a structure in which the drum opposing surface Sa1 (that is, for example, as shown in FIG. 27, the sliding surface and the side surface intersect with each other at an acute angle formed therebetween) does not include the inclined surface 45*a* is assumed. In this structure, the outer circumferential surface 21 may be damaged by contact between the outer circumferential surface 21 and a corner corresponding to the intersection between the sliding surface and the side surface (hereinafter, referred to as a head corner). In particular, when the cross section of the photoreceptor drum 110 is not a circular shape due to errors in manufacture or deformation with the passage of time, or when the position of the photoreceptor drum 110 deviates from the original position thereof due to the same reasons, a portion of the outer circumferential surface 21 protruding from the original surface toward the outside may be damaged due to contact with the head corner. In contrast, in the head 10*a* of the third embodiment, since the drum opposing surface Sa1 has the inclined surface 45*a* (that is, the edge of the head is chamfered), it is possible to prevent the damage of the outer circumferential surface 21. Further, in the third embodiment, the inclined surface 45*a* is formed on only the upstream side of the drum opposing surface Sa1 in the rotational direction A. However, the same inclined surface as the inclined surface 45*a* may be additionally formed on the downstream side of the drum opposing surface Sa1 in the rotational direction A.

Fourth Embodiment

Figure 18:
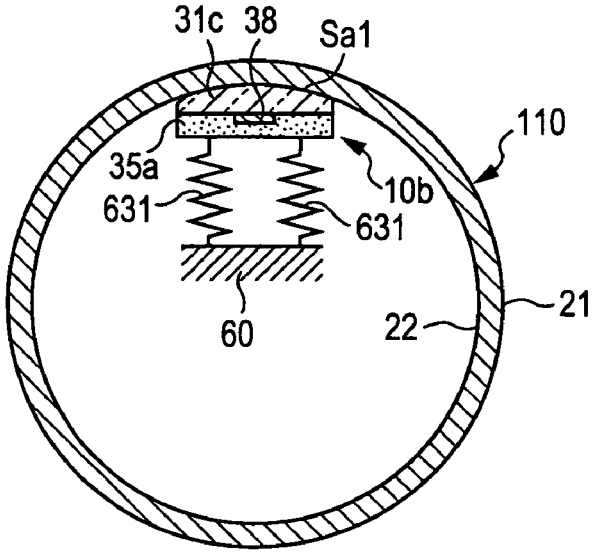
FIG. 18 is a cross-sectional view illustrating the structure of a portion of an image forming apparatus according to a fourth embodiment of the invention.

FIG. 18 is a cross-sectional view illustrating the structure of a portion of an image forming apparatus according to a fourth embodiment. In the third embodiment, the head 10*a* is opposite to the outer circumferential surface 21 of the photoreceptor drum 110. On the other hand, in the fourth embodiment, a head 10*b* is opposite to the inner circumferential surface of the cylindrical photoreceptor drum 110. In the fourth embodiment, the photoreceptor drum 110 is a cylindrical member formed by laminating a photosensitive layer on an outer circumferential surface of a transmissive cylinder. The head 10*b* is urged by a plurality of elastic bodies 631 arranged on the surface of a sealing member 35*a* so that a substrate 31*c* comes into contact with an inner circumferential surface 22 of the photoreceptor drum 110. In the fourth embodiment, the same components as those in the third embodiment have the same reference numerals, and a description thereof will be omitted.

Figure 19:
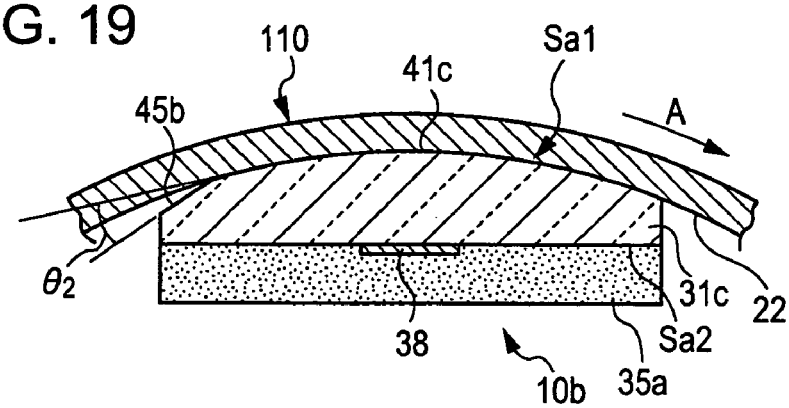
FIG. 19 is a cross-sectional view illustrating the structure of a head and a peripheral portion of the head of the image forming apparatus according to the fourth embodiment.
Figure 20:
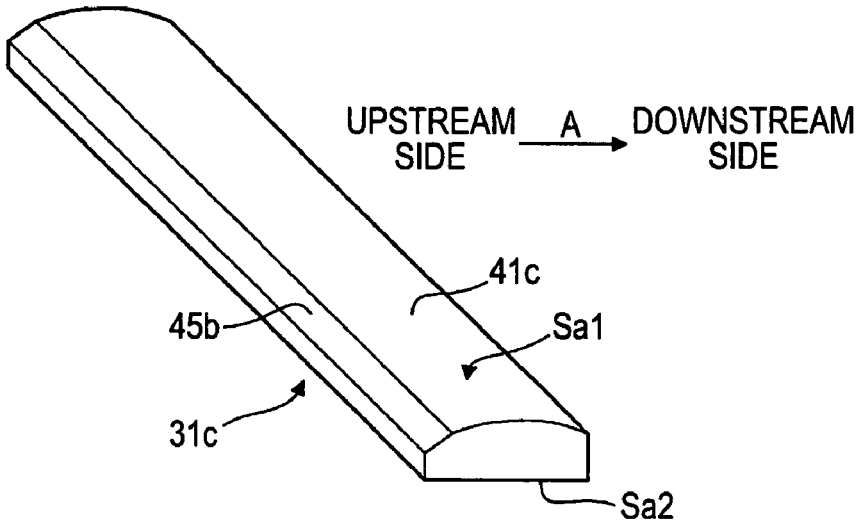
FIG. 20 is a perspective view illustrating the appearance of a substrate of the image forming apparatus according to the fourth embodiment.

FIG. 19 is an enlarged cross-sectional view illustrating a portion of the structure shown in FIG. 18. FIG. 20 is a perspective view illustrating the appearance of the substrate 31*c*. As shown in FIG. 19, a drum opposing surface Sa1 of the substrate 31*c* includes an inclined surface 45*b* and a sliding surface 41*c* which is shaped so as to come into surface contact with the inner circumferential surface 22 of the photoreceptor drum 110. As shown in FIGS. 19 and 20, the sliding surface 41*c* is a curved surface (convex surface) which protrudes toward the photoreceptor drum 110 with a curvature substantially equal to that of the inner circumferential surface 22 of the photoreceptor drum 110. That is, the sliding surface 41*c* can be referred to as a portion of the outer surface (outer circumferential surface) of a cylinder which has a radius substantially equal to the inner circumferential surface 22 of the photoreceptor drum 110. The inclined surface 45*b* of the substrate 31*c* is positioned on the upstream side of the sliding surface 41*c* of the drum opposing surface Sa1 in the rotational direction A of the photoreceptor drum 110. As shown in FIG. 19, the inclined surface 45*b* is tilted with respect to the inner circumferential surface 22 such that an elevation angle θ2 with respect to the inner circumferential surface 22 of the photoreceptor drum 110 is an acute angle.

In the fourth embodiment, the sliding surface 41*c* having a curvature substantially equal to that of the inner circumferential surface 22 of the photoreceptor drum 110 comes into surface contact with the inner circumferential surface 22. Therefore, it is possible to maintain a predetermined distance between the light emitting elements 38 and the inner circumferential surface 22 of the photoreceptor drum 110 with high accuracy, similar to the third embodiment. Further, in the fourth embodiment, since the head 10*b* is accommodated inside the photoreceptor drum 110, it is possible to reduce a space required for arranging the head, compared with the third embodiment in which the head 10*a* is arranged outside the photoreceptor drum 110.

Fifth Embodiment

Figure 21:
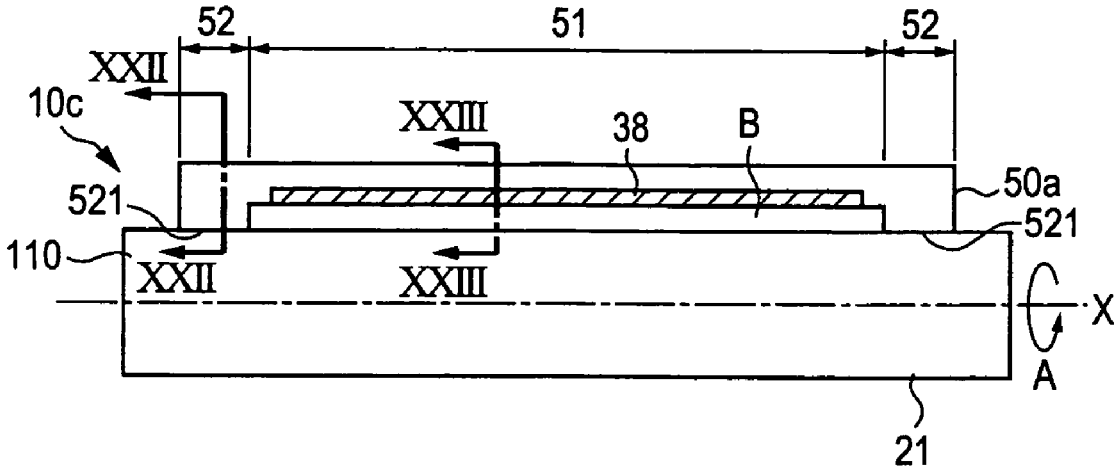
FIG. 21 is a front view illustrating the structure of a portion of an image forming apparatus according to a fifth embodiment of the invention.
Figure 22:
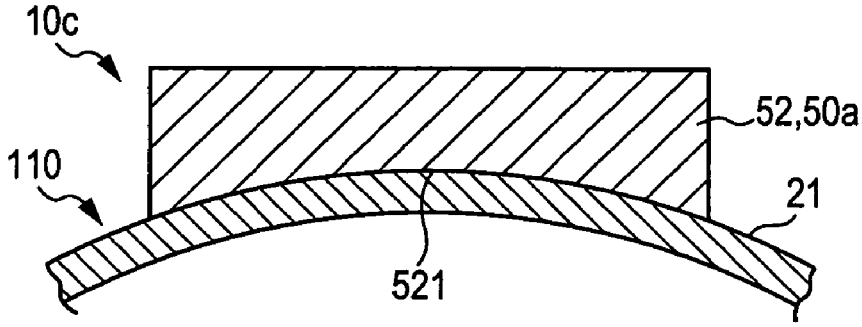
FIG. 22 is a cross-sectional view taken along the line XXII-XXII of FIG. 21.
Figure 23:
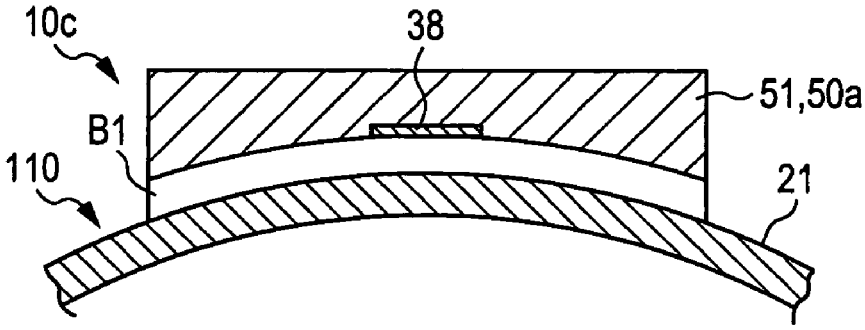
FIG. 23 is a cross-sectional view taken along the line XXIII-XXIII of FIG. 21.

FIG. 21 is a front view illustrating a head 10*c* and a photoreceptor drum 110 of an image forming apparatus according to a fifth embodiment, as viewed from the horizontal direction (a direction perpendicular to the drum axis direction). In addition, FIG. 22 is a cross-sectional view taken along the line XXII-XXII of FIG. 21. FIG. 23 is a cross-sectional view taken along the line XXIII-XXIII of FIG. 21. As shown in FIG. 21, in the fifth embodiment, the head 10*c* (which is of a top emission type) includes a substrate 50*a* whose longitudinal direction is the drum axis direction X and a plurality of light emitting elements 38 formed on the substrate 50*a*.

In the third embodiment, the sliding surface 41*a* is formed on the entire surface of the substrate 31*a* in the longitudinal direction (drum axis direction X) thereof. In contrast, in the fifth embodiment, only both ends of the substrate having the light emitting elements 38 formed thereon in the longitudinal direction (drum axis direction) serve as the sliding surface. In the fifth embodiment, the same components as those in the third embodiment have the same reference numerals, and a description thereof will be omitted.

The substrate 50*a* includes a first portion 51 having a plurality of light emitting elements 38 on a surface opposite to the photoreceptor drum 110 and second portions 52 arranged at both ends thereof in the longitudinal direction. Surfaces of the second portions 52 opposite to the photoreceptor drum 110 protrude from the surface of the first portion having the light emitting elements 38 formed thereon toward the photoreceptor drum 110. Therefore, as shown in FIGS. 21 and 23, the first portion 51 and the light emitting elements 38 formed therein are opposite to the inner circumferential surface 21 of the photoreceptor drum 110 at a gap B1 corresponding to a step difference (about several micrometers) between the first portion 51 and the second portion 52. The substrate 50*a* having the above-mentioned shape is formed by mechanically or chemically polishing a portion of a substantially rectangular plate corresponding to the first portion 51.

In the fifth embodiment, as shown in FIGS. 21 and 22, a part of the second portion 52 opposite to the outer circumferential surface 21 of the photoreceptor drum 110 serves as a sliding surface 521. Similar to the sliding surface 41*a* in the third embodiment, the sliding surface 521 is a curved surface (concave surface) which is recessed toward the opposite side to the photoreceptor drum 110 with a curvature substantially equal to that of the outer circumferential surface 21 of the photoreceptor drum 110. When a plurality of elastic bodies 631 (not shown in FIGS. 21 to 23) arranged on a surface of the substrate 50*a* opposite to the light emitting elements 38 and the sliding surface 521 urges the head 10*c* against the photoreceptor drum 110, the sliding surface 521 of the second portion 52 comes into surface contact with the outer circumferential surface 21 of the photoreceptor drum without a gap therebetween. Thus, the fifth embodiment obtains the same effects as those in the third embodiment. Further, in the fifth embodiment, the first portion 51 of the substrate 50*a* and the light emitting elements 38 formed thereon are separated from the outer circumferential surface 21 of the photoreceptor drum 110. This structure makes it possible to prevent the damage of the light emitting elements 38 due to contact with the photoreceptor drum 110.

In the fifth embodiment, the head 10*c* is opposite to the outer circumferential surface 21 of the photoreceptor drum 110. However, the head 10*c* may be opposite to the inner circumferential surface 22 of the photoreceptor drum 110, as in the fourth embodiment. In this structure, the sliding surface 521 of the second portion 52 of the substrate 50*a* opposite to the inner circumferential surface 22 of the photoreceptor drum 110 is a curved surface (convex surface) which has a curvature substantially equal to that of the inner circumferential surface 22 and protrudes toward the photoreceptor drum 110. In addition, in FIGS. 21 to 23, parts of the second portions 52 opposite to the photoreceptor drum 110 serve as the sling surface 521. However, an inclined surface 45, which is the same as that in the third or fourth embodiment, may be formed in the second portion 52.

In FIGS. 21 to 23, the top-emission-type head 10*c* is used. However, the fifth embodiment can be applied to a bottom-emission-type head. That is, when both ends (second portions 52) of the drum opposing surface Sa1 of the substrate shown in FIG. 14 or 19 in the longitudinal direction protrude from the other portion (first portion 51) toward the photoreceptor drum 110 and serve as the sliding surface 521, the same effects as those in the fifth embodiment can be obtained.

Figure 31:
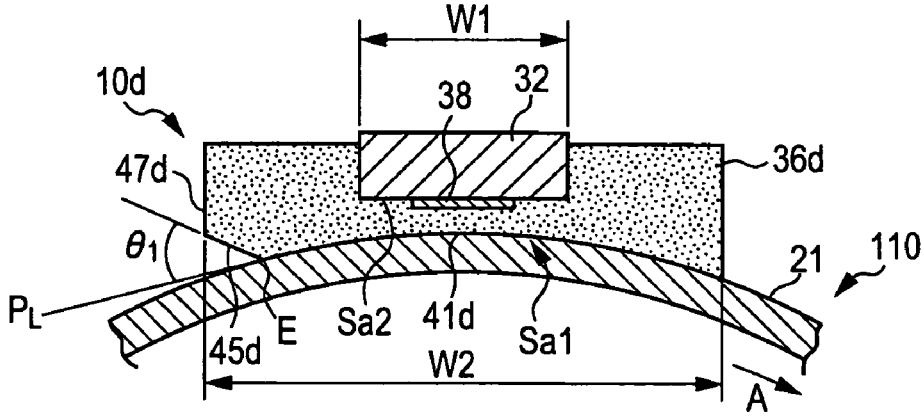
FIG. 31 is a cross-sectional view illustrating the structure of a head and a peripheral portion of the head of the image forming apparatus according to the seventh embodiment.
Figure 36:
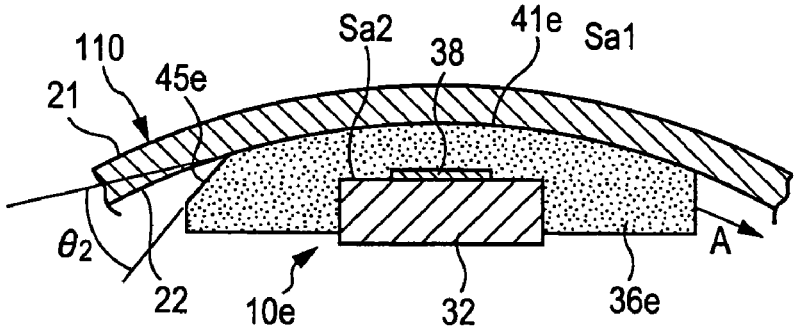
FIG. 36 is a cross-sectional view illustrating the structure of a head and a peripheral portion of the head of the image forming apparatus according to the eighth embodiment.

Further, in FIGS. 21 to 23, the substrate 50*a* is formed of a single plate. However, similar to the third embodiment or the fourth embodiment, a base member formed by laminating a plurality of substrates may be used. In addition, as shown in FIGS. 31 and 36, a sealing member may be provided so as to cover the element forming surface Sa2 and side surfaces of the substrate, thereby forming a base member. The substrate is formed such that both ends of the surface thereof opposite to the photoreceptor drum in the longitudinal direction (drum axis direction X) protrude from the other portion toward the photoreceptor drum 110.

Sixth Embodiment

Figure 24:
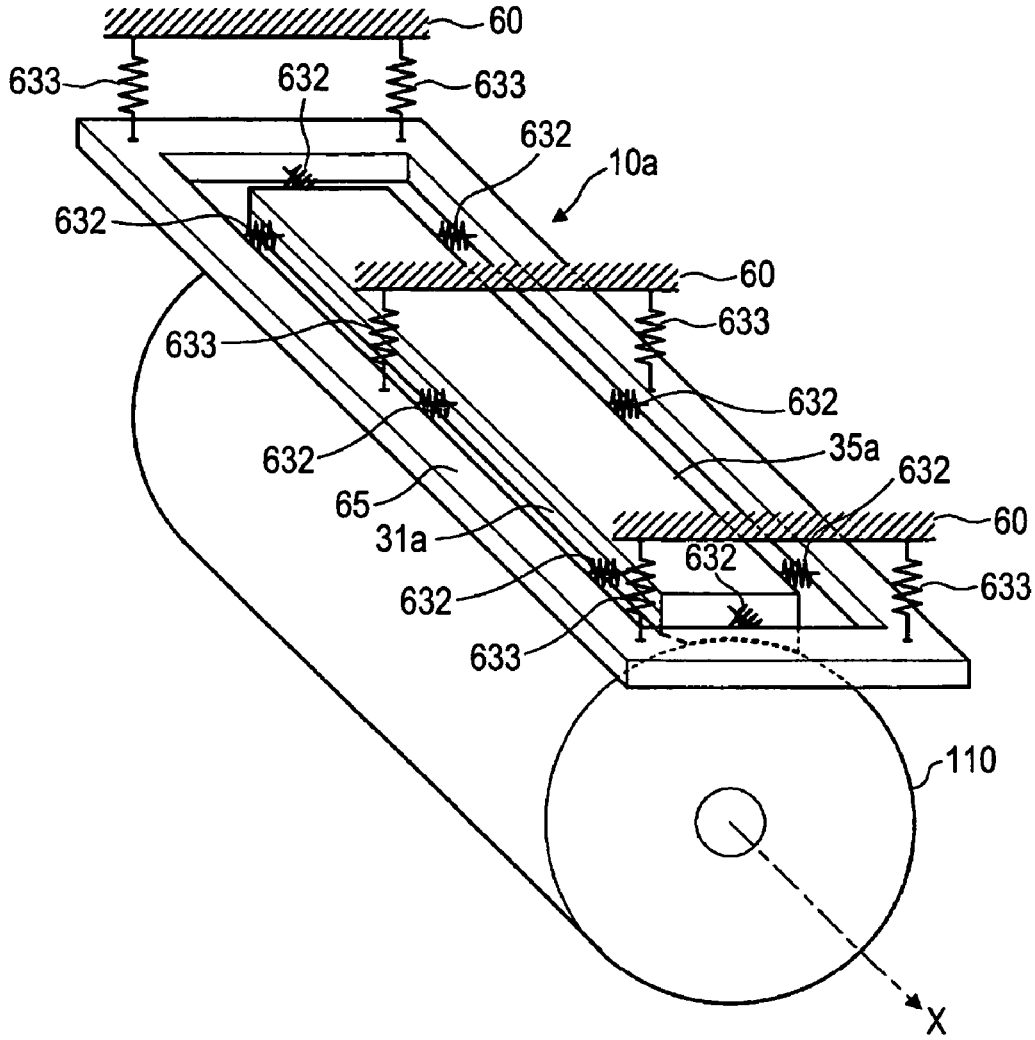
FIG. 24 is a perspective view illustrating the structure of a portion of an image forming apparatus according to a sixth embodiment of the invention.
Figure 25:
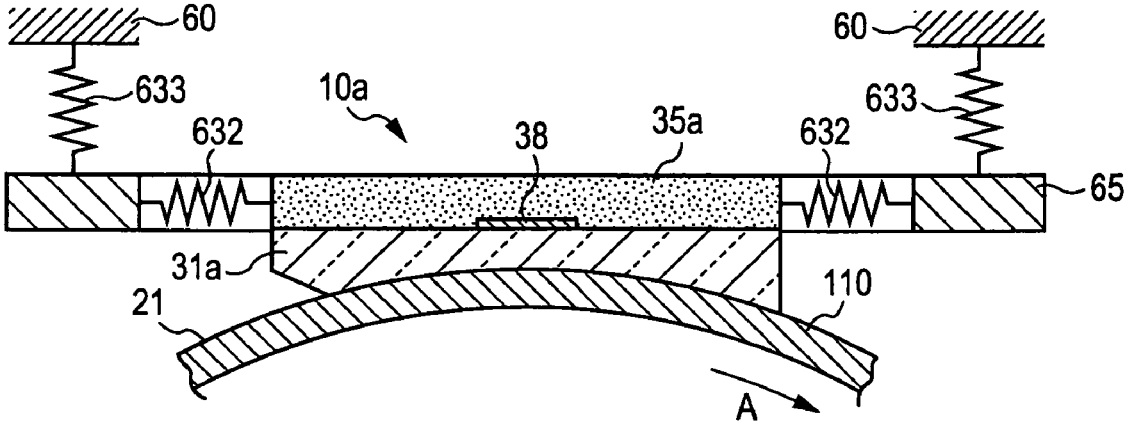
FIG. 25 is a cross-sectional view illustrating the structure of a head and a peripheral portion of the head of the image forming apparatus according to the sixth embodiment.

FIG. 24 is a perspective view illustrating the structure of a portion of an image forming apparatus according to a sixth embodiment of the invention. FIG. 25 is a cross-sectional view illustrating components shown in FIG. 24, taken along a direction perpendicular to the drum axis direction X, and corresponds to FIG. 14 in the third embodiment. As shown in FIGS. 24 and 25, the image forming apparatus according to the sixth embodiment has a substantially rectangular frame member 65 surrounding the head 10*a*. An inner circumferential surface of the frame member 65 corresponds to side surfaces of the head 10*a*. The frame member 65 can have any shapes as long as it has a portion opposite to the side surface of the head 10*a*. Therefore, the shape of the frame member 65 is not limited to that shown in FIG. 24.

In the third embodiment, a plurality of elastic bodies 631 is arranged on the surface of the head 10*a* opposite to the photoreceptor drum 110. In contrast, in the sixth embodiment, elastic bodies arranged on the side surfaces of the head 10*a* urge the head 10*a* against the photoreceptor drum 110. In the sixth embodiment, the same components as those in the third embodiment have the same reference numerals, and a description thereof will be omitted.

A plurality of elastic bodies 632 is provided between the inner circumferential surface of the frame member 65 and the side surface of the head 10*a*. Each elastic body 632 has one end fixed to the inner circumferential surface of the frame member 65 and the other end fixed to the side surface of the head 10*a*. More specifically, as shown in FIG. 24, three elastic bodies 632 are arranged at equal intervals on the side surface corresponding to each long side of the substantially rectangular head 10*a* such that an end of each of the three elastic bodies 632 is fixed to the side surface of the head 10*a* and the other end thereof is fixed to the inner circumferential surface of the frame member 65 opposite to the side surface of the head 10*a*. In addition, an end of one elastic body 632 is fixed in the center of the side surface corresponding to each short side of the head 10*a*, and the other end of the elastic body 632 is fixed to the inner circumferential surface of the frame member 65 opposite to the side surface of the head 10*a*.

Further, a plurality of elastic bodies 633 is arranged on a surface of the frame member 65 opposite to the photoreceptor drum 10. The elastic bodies 633 are members for urging the frame member 65 against the photoreceptor drum 110, and are provided between the case 60 of the image forming apparatus and the frame member 65. In the sixth embodiment, six elastic bodies 633 are arranged around four corners of the frame member 65 and in a central portion thereof in the longitudinal direction. The elastic bodies 632 and 633 are the same components as the elastic bodies 631 of the third embodiment. For example, coil springs or leaf springs are used as the elastic bodies 632 and 633.

In the above-mentioned structure, when the elastic bodies 633 press the frame member 65 against the photoreceptor drum 110, the elastic bodies 632 are extended. Then, the head 10*a* is urged against the photoreceptor drum 110 by elastic force generated by the elastic bodies 632. Therefore, the sixth embodiment can obtain the same effects as those in the third embodiment.

Figure 26:
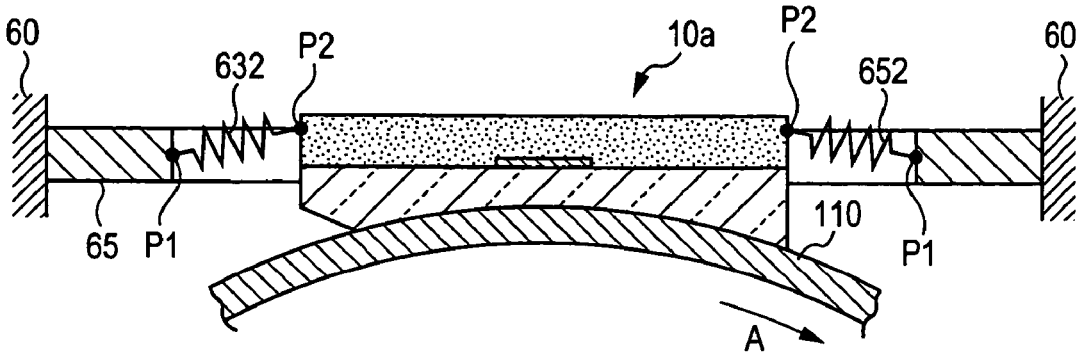
FIG. 26 is a cross-sectional view illustrating the structure of a head and a peripheral portion of the head of another image forming apparatus according to the sixth embodiment.

In the above-mentioned structure, the elastic bodies 633 press the frame member 65 against the photoreceptor drum 10. However, as shown in FIG. 26, the head 10*a* may be urged against the photoreceptor 110 according to the fixed position of the frame member 65. That is, in this structure, the frame member 65 is fixed to the case 60 such that an end portion P1 of each elastic body 632 fixed to the frame member 65 is positioned closer to the photoreceptor drum 110 than an end portion P2 of the elastic body 632 fixed to the head 10*a*. In this structure, the elastic force of the elastic bodies 632 causes the head 10*a* to be pressed against the photoreceptor drum 110, and thus the same effects as those in the sixth embodiment can be obtained. In addition, according to this structure, it is unnecessary to provide the elastic bodies 633 on the surfaces of the head 10*a* and the frame member 65 opposite to the photoreceptor drum 110, which results in a reduction in a space to be ensured on the upper side of the head 10*a*.

In FIGS. 24 to 26, the head 10*a* according to the third embodiment is urged. However, the fourth embodiment or the fifth embodiment can adopt the structure in which the head 10*a* is urged against the photoreceptor drum 110 by the components of the sixth embodiment, such as the frame member 65 and the elastic bodies 632.

Modifications of Third to Sixth Embodiments

Various modifications of the third to sixth embodiments can be made. The modifications thereof will be described in detail. The following modifications may be appropriately combined.

First Modification

Figure 28:
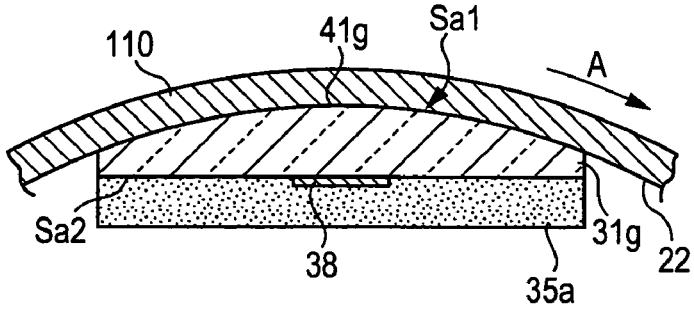
FIG. 28 is a cross-sectional view illustrating the structure of a head of an image forming apparatus according to a first modification of the fourth embodiment.

In the third, fourth, and sixth embodiments, the surface of the head opposite to the photoreceptor drum 110 includes an inclined surface. However, the inclined surface is not necessarily needed. For example, in the third or sixth embodiment, as shown in FIG. 27, instead of the substrate 31*a*, a substrate 31*f* may be used in which the entire drum opposing surface Sa1 serves as a sliding surface 41*f* having a curvature substantially equal to that of the outer circumferential surface 21 of the photoreceptor drum 110. In addition, as shown in FIG. 28, in the fourth embodiment, a substrate 31*g* may be used in which the entire drum opposing surface Sa1 serves as a sliding surface 41*g* having a curvature substantially equal to that of the inner circumferential surface 22 of the photoreceptor drum 110.

Second Modification

In the third to sixth embodiments, optical components may be provided between the light emitting elements 38 and the photoreceptor drum 110. For example, an optical waveguide (for example, an optical fiber) for guiding light emitted from the light emitting elements 38 to the surface of the photoreceptor drum 110 or a lens for condensing light emitted from the light emitting elements 38 may be provided between the light emitting elements 38 and the photoreceptor drum 110.

Figure 29:
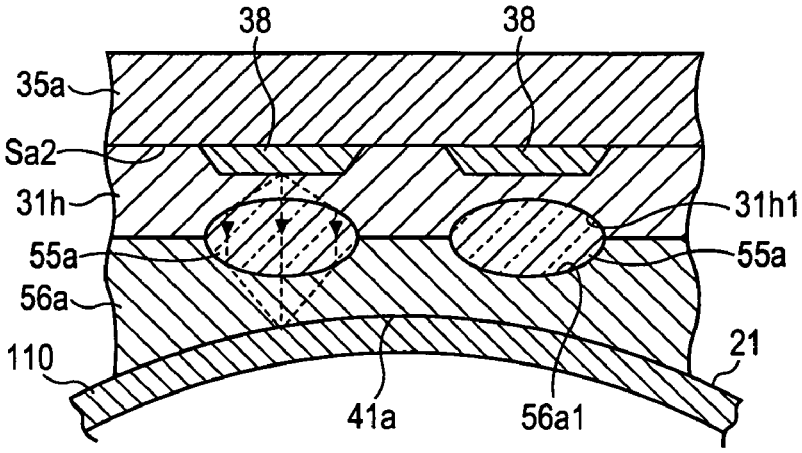
FIG. 29 is a cross-sectional view illustrating the structure of a head of an image forming apparatus according to a second modification of the third or sixth embodiment.

FIG. 29 is a cross-sectional view illustrating the structure of a head of an image forming apparatus according to a second modification of the third or sixth embodiment. In this structure, microlenses 55*a* for condensing light emitted from the light emitting elements 38 are provided between the light emitting elements 38 and the photoreceptor drum 110. The microlenses 55*a* are arranged in an array shape so as to be opposite to the light emitting elements 38. In the structure shown in FIG. 29, a board 56*a* overlaps a surface of a substrate 31*h* having the light emitting elements 38 formed thereon which faces the photoreceptor drum 110. The board 56*a* may be a thin film which is formed of a resin material on the substrate 31*h*, or a plate member bonded to the substrate 31*h*. A plurality of curved-shaped concave portions 31*h*1 are formed in a surface of the substrate 31*h* facing the board 56*a* at positions corresponding to the light emitting elements 38. Similarly, a plurality of curved-shaped concave portions 56*a*1 are formed in a surface of the board 56*a* facing the substrate 31*h* at positions corresponding to the light emitting elements 38. A surface of the board 56*a* facing the outer circumferential surface 21 of the photoreceptor drum 110 is composed of a sliding surface 41*a* having a curvature substantially equal to that of the outer circumferential surface 21.

A resin material having a different reflective index from those of the substrate 31*h* and the board 56*a* is filled up into spaces formed by the concave portions 31*h*1 of the substrate 31*h* and the concave portions 56*a*1 of the substrate 56*a*, thereby forming the microlenses 55*a*, which are double-sided convex lenses. The microlenses 55*a* condense light emitted from the corresponding light emitting elements 38, so that an image is formed on the surface of the photoreceptor drum 110. The shape and arrangement of the microlenses 55*a* are not limited to those shown in FIG. 29. For example, convex microlenses protruding toward the photoreceptor drum 110 may be formed on the surface of the substrate.

In the structure in which light emitted from the light emitting elements 38 is condensed by the microlenses 55*a*, even when a distance between the light emitting elements 38 and the photoreceptor drum 110 varies slightly, a variation in the area of a spot on the surface of the photoreceptor drum 110 where light emitted from the light emitting element 38 is incident becomes remarkable. According to this modification, the surface contact between the photoreceptor drum 110 and the sliding surface having a curvature substantially equal to that of the surface of the photoreceptor drum 110 makes it possible to maintain a uniform distance between the light emitting elements 38 and the photoreceptor drum 110 with high accuracy. Therefore, in the structure capable of improving the utilization efficiency of light by using the microlenses 55*a*, it is also possible to accurately form a predetermined latent image on the surface of the photoreceptor drum 110. That is, the effects of maintaining the uniform distance between the light emitting elements 38 and the photoreceptor drum 110 can be more reliably obtained by the structure in which optical components, such as microlenses, are arranged between the light emitting elements 38 and the photoreceptor drum 110, as shown in FIG. 29.

Seventh Embodiment

Figure 30:
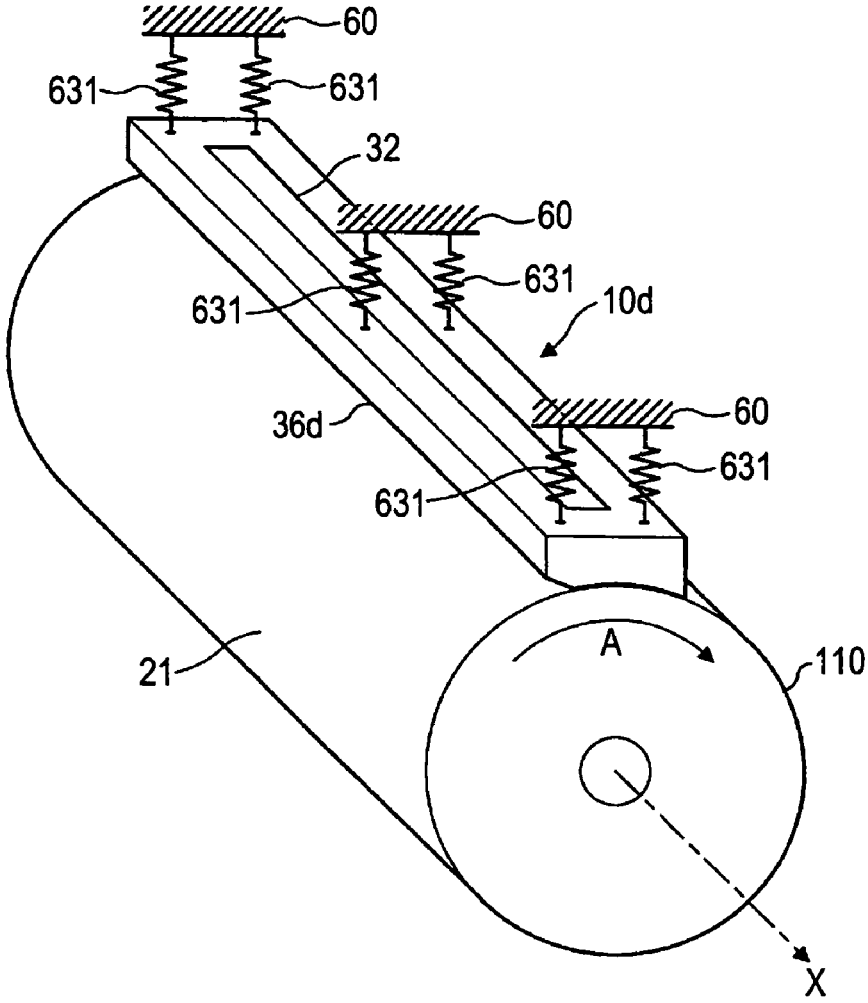
FIG. 30 is a perspective view illustrating the structure of a portion of an image forming apparatus according to a seventh embodiment of the invention.

FIG. 30 is a perspective view illustrating the structure of a portion of an image forming apparatus according to a seventh embodiment of the invention. The image forming apparatus is used for a printing unit of, for example, a printer, a duplicating machine, or a facsimile. As shown in FIG. 30, the image forming apparatus includes a cylindrical photoreceptor drum 110 which is supported so as to rotate in the direction of arrow A (sub-scanning direction) and a head 10*d* which is arranged opposite to an outer circumferential surface 21 of the photoreceptor drum 110. Hereinafter, the direction of a rotational axis of the photoreceptor drum 110 (that is, the direction of a bus of the photoreceptor drum 110 (the main scanning direction)) is referred to as a 'drum axis direction X'.

FIG. 31 is a cross-sectional view illustrating the components shown in FIG. 30, taken along a direction perpendicular to the drum axis direction X. As shown in FIGS. 30 and 31, the head 10*d* includes a substantially rectangular substrate 32 whose longitudinal direction is the drum axis direction X and which is opposite to the outer circumferential surface 21 of the photoreceptor drum 110, a plurality of light emitting elements 38 formed on an element forming surface Sa2 (one surface of the substrate 32) opposite to a drum opposing surface Sa1 which faces the photoreceptor drum 110, and a sealing member 36*d* which is formed on the element forming surface Sa2 of the substrate 32 so as to cover the light emitting elements 38. The sealing member 36*d* is a substantially rectangular member formed so as to cover the element forming surface Sa2 and side surfaces of the substrate 32, and is formed of various resin material, such as an acryl-based resin and an epoxy-based resin. The sealing member 36*d* covering the light emitting elements 38 makes it possible to prevent the deterioration of the light emitting elements 38 due to permeation of air or water. The sealing member 36*d* of the seventh embodiment has a transmissive property.

As shown in FIG. 30, a plurality of elastic bodies 631 is arranged on a surface of the head 10*d* (the sealing member 36*d*) opposite to the photoreceptor drum 110. Each elastic body 631 is a member for elastically urging the head 10*d* against the photoreceptor drum 110, and is provided between the head 10*d* and a case 60 of the image forming apparatus. In the seventh embodiment, six elastic bodies 631 are arranged around four corners of the surface of the sealing member 36*d* opposite to the photoreceptor drum 110 and in a central portion thereof in the longitudinal direction. For example, a coil spring having one end fixed to the head 10*d* and the other end fixed to the case 60 is used as the elastic body 631. However, the elastic body 631 may have any other shapes. For example, various members, such as a leaf spring and rubber interposed between the sealing member 36*d* and the case 60, can be used as the elastic bodies 631.

Figure 32:
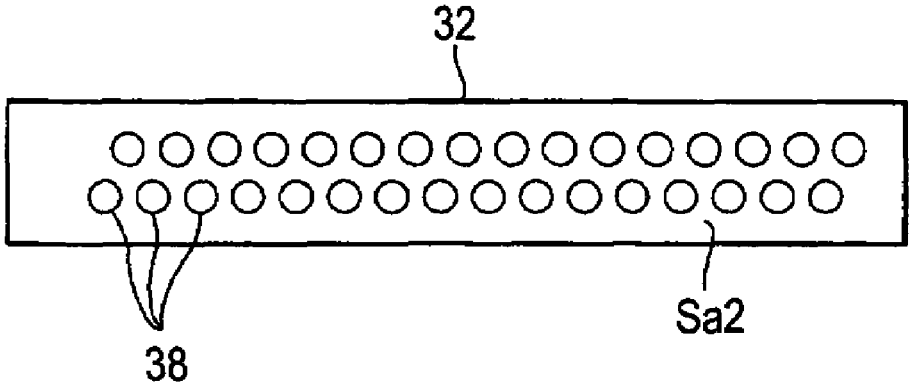
FIG. 32 is a plan view illustrating an element forming surface of a substrate of the image forming apparatus according to the seventh embodiment.

The substrate 32 shown in FIGS. 30 and 31 is a plate member formed of a transmissive material, such as glass or plastic. Meanwhile, each light emitting element 38 is formed by interposing a light emitting layer formed of an organic EL material between an anode and a cathode, and emits light when electric energy is applied. FIG. 32 is a plan view illustrating the element forming surface Sa2 of the substrate 32. As shown in FIG. 32, the light emitting elements 38 are arranged in two rows or in island shapes along the drum axis direction X, and selectively emit light corresponding to an image to be printed on a recording medium, such as a sheet. Light emitted from each light emitting element 38 is incident on the surface of the photoreceptor drum 110 through the sealing member 36*d*. That is, the head 10*d* of the seventh embodiment is of a top emission type. Therefore, the substrate 32 does not need to have a transmissive property. Then, the exposure by the head 10*d* causes a latent image corresponding to a desired image to be formed on the surface of the photoreceptor drum 110. The arrangement pattern of the light emitting elements 38 is not limited to that shown in FIG. 32. For example, the light emitting elements 38 may be arranged in other patterns, such as in one row or three or more rows.

Figure 33:
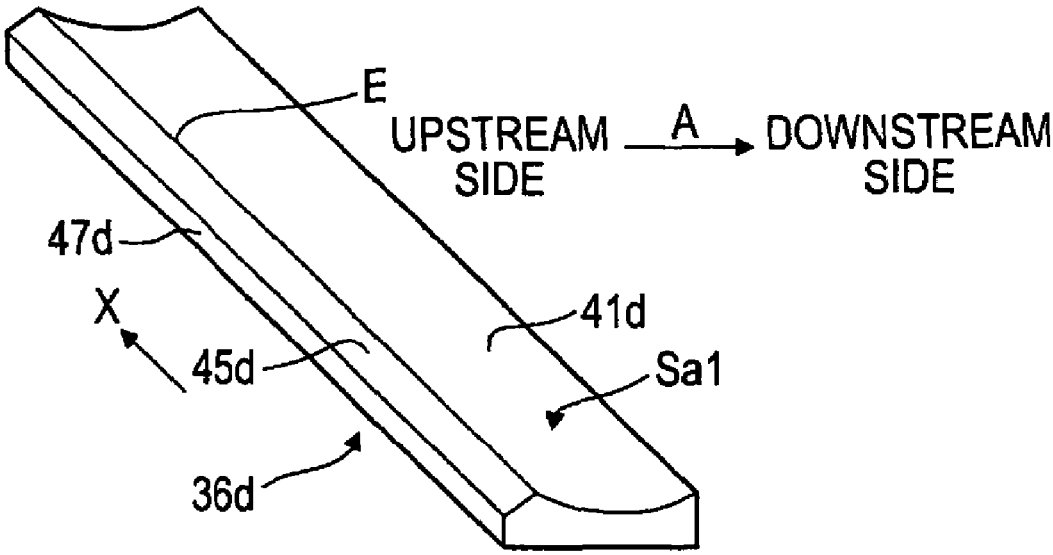
FIG. 33 is a perspective view illustrating the appearance of the substrate of the image forming apparatus according to the seventh embodiment.

Next, FIG. 33 is a perspective view illustrating the appearance of a surface Sa1 of the sealing member 36*d* opposite to the photoreceptor drum (hereinafter, referred to as a 'drum opposing surface'). In FIG. 33, the drum opposing surface Sa1 is positioned on the upper side (that is, the position of the sealing member 36*d* is reverse to the position thereof shown in FIG. 30 or 31 in the vertical direction). As shown in FIG. 33, the drum opposing surface Sa1 of the sealing member 36*d* includes a sliding surface 41*d* and an inclined surface 45*d*. As shown in FIGS. 31 and 33, the sliding surface 41*d* is a curved surface (concave surface) which is recessed toward the opposite side to the photoreceptor drum 110 with a curvature substantially equal to that of the outer circumferential surface 21 of the photoreceptor drum 110. That is, the sliding surface 41*d* can be referred to as a portion of the inner surface (inner circumferential surface) of a cylinder which has a radius substantially equal to the outer circumferential surface 21 of the photoreceptor drum 110. When the elastic bodies 631 urge the head 10*d* against the photoreceptor drum 110, the entire sliding surface 41*d* of the sealing member 36*d* comes into contact with the outer circumferential surface 21 of the photoreceptor drum 110 without a gap therebetween, as shown in FIG. 31.

Meanwhile, the inclined surface 45*d* is positioned between the sliding surface 41*d* and a side surface 47*d* located at the upstream side of the sealing member 36*d* in a rotational direction A of the photoreceptor drum 110. As shown in FIG. 31, the inclined surface 45*d* is tilted with respect to the outer circumferential surface 21 such that an elevation angle θ1 with respect to the outer circumferential surface 21 of the photoreceptor drum 110 is an acute angle. The elevation angle θ1 is an angle formed between the inclined surface 45*d* and a tangent line PL of the outer circumferential surface 21 at an edge E positioned on the upstream side of the sliding surface 41*d* in the rotational direction A of the photoreceptor drum 110. As described above, a portion of the sealing member 36*d* which is opposite to the photoreceptor drum 110 and is positioned on the upstream side in the rotational direction A is chamfered. Therefore, as shown in FIG. 31, the sliding surface 41*d* comes into surface contact with the outer circumferential surface 21 of the photoreceptor drum 110, and the inclined surface 45*d* is opposite to the outer circumferential surface 21 of the photoreceptor drum 110 with a gap therebetween.

The above-mentioned sealing member 36*d* is formed by a method (injection molding) of hardening an ultraviolet-curable or thermosetting resin material filled into a mold by heating or radiation of ultraviolet rays and of taking it out or by a method of mechanically or chemically polishing a board which is formed substantially in a rectangular shape so as to cover the element forming surface Sa2 of the substrate 32. The former shaping method has an advantage that an inexpensive sealing member 36*d* can be produced in large quantities. In addition, the substrate 32 is fit into a groove formed by mechanically or chemically polishing the surface of the sealing member 36*d* opposite to the drum opposing surface Sa1 and is then fixed to the sealing member 36*d* by an adhesive.

As described above, in the seventh embodiment, the sliding surface 41*d* having a curvature substantially equal to that of the outer circumferential surface 21 of the photoreceptor drum 110 comes into surface contact with the outer circumferential surface 21 of the photoreceptor drum 110. Therefore, it is possible to accurately maintain a predetermined distance between each light emitting element 38 and the outer circumferential surface 21 of the photoreceptor drum 110, compared with the structure in which the drum opposing surface Sa1 is flat. This effect will be described below.

Figure 34A:
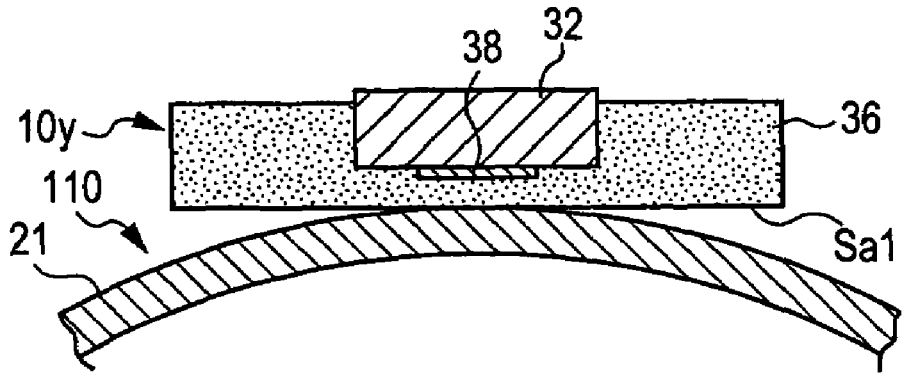
FIGS. 34A to 34C are cross-sectional views illustrating the structure of an image forming apparatus compared with the image forming apparatus according to the seventh embodiment and the structural defect thereof.
Figure 34B:
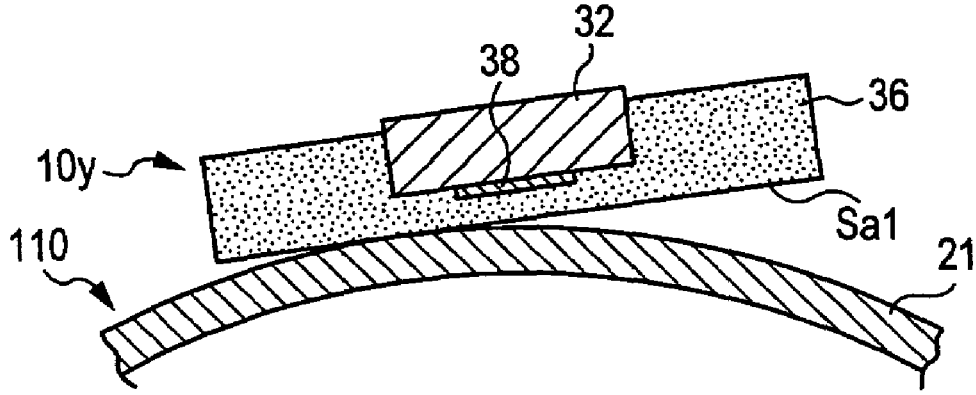
Figure 34C:
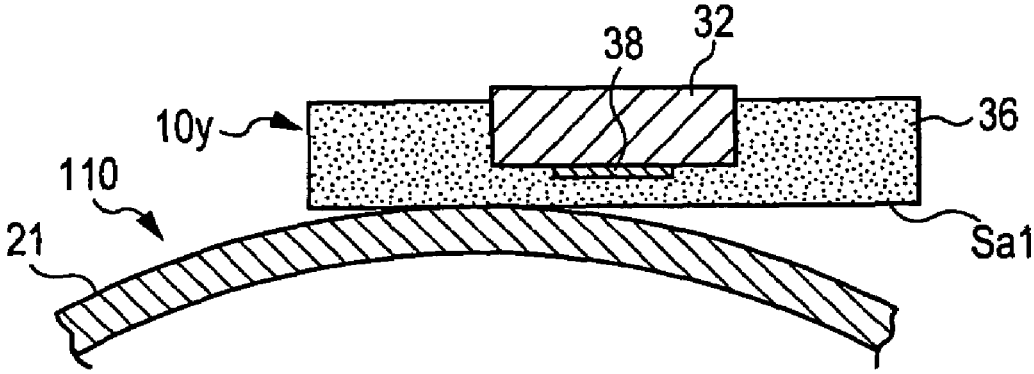

As a structure compared with the seventh embodiment, a head 10*y* including a sealing member 36 having a flat drum opposing surface Sa1 is considered, as shown in FIG. 34A. This structure has a problem in that the position or posture of the head 10*y* with respect to the photoreceptor drum 110 is unstable since the drum opposing surface Sa1 comes into line contact with the outer circumferential surface 21 of the photoreceptor drum 110. For example, as shown in FIGS. 34A to 34C, even when the head 10*y* is maintained such that the drum opposing surface Sa1 is arranged in a substantially horizontal direction, the head 10*y* rotates on a contact line between the drum opposing surface Sa1 and the outer circumferential surface 21. As a result, the head 10*y* may be inclined, as shown in FIG. 34B. In addition, for example, when the photoreceptor drum 110 rotates, the position of the head 10*y* may be changed from the original position to the horizontal position by friction force acting from the photoreceptor drum 110 to the head 10*y* or other factors (for example, external force), as shown in FIG. 34C. In both cases shown in FIGS. 34B and 34C, a distance between the light emitting element 38 and the outer circumferential surface 21 of the photoreceptor drum 110 is larger than that in the ideal structure shown in FIG. 34A. When the distance between the light emitting element 38 and the photoreceptor drum 110 is changed, a variation in the area or shape of a region (spot) of the outer circumferential surface 21 of the photoreceptor drum 110 where light emitted from the light emitting elements 38 is incident occurs, which makes it difficult to form a high-definition image.

In contrast, in the seventh embodiment, the surface contact between the sliding surface 41*d* and the outer circumferential surface 21 of the photoreceptor drum 110 enables the stale posture or position of the head 10*d* with respect to the photoreceptor drum 110. That is, the surface contact therebetween effectively prevents the inclination of the head 10*d* as shown in FIG. 34B or the displacement of the head 10*d* in the horizontal direction as shown in FIG. 34C. Therefore, it is possible to maintain a predetermined distance between the photoreceptor drum 110 and the light emitting elements 38, and thus to form a high-definition image. In particular, in the seventh embodiment, a plurality of elastic bodies 631 urge the head 10*d* against the photoreceptor drum 110 with uniform force. Thus, it is possible to reliably and stably maintain the posture or position of the head 10*d* by the surface contact between the sliding surface 41*d* and the outer circumferential surface 21 of the photoreceptor drum 110.

Figure 42:
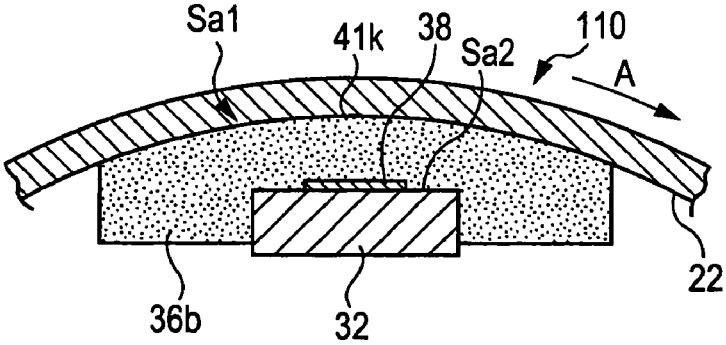
FIG. 42 is a cross-sectional view illustrating the structure of a head of an image forming apparatus according to a first modification of the eighth embodiment.

Further, in the seventh embodiment, since a portion of the drum opposing surface Sa1 of the sealing member 36*d* arranged on the upstream side thereof in the rotational direction A of the photoreceptor drum 110 is the inclined surface 45*d*, it is possible to prevent the damage of the outer circumferential surface 21 due to collision between the drum opposing surface Sa1 and the outer circumferential surface 21 of the photoreceptor drum 110. For example, a structure in which the drum opposing surface Sa1 does not include the inclined surface 45*d* (that is, for example, as shown in FIG. 42, the sliding surface and the side surface intersect with each other at an acute angle formed therebetween) is assumed. In this structure, the outer circumferential surface 21 may be damaged by contact between the outer circumferential surface 21 and a corner corresponding to the intersection between the sliding surface and the side surface. In particular, when the cross section of the photoreceptor drum 110 is not a circular shape due to errors in manufacture or deformation with the passage of time, or when the position of the photoreceptor drum 110 deviates from the original position thereof due to the same reasons, a portion of the outer circumferential surface 21 protruding from the original surface toward the outside may be damaged due to contact with the corner. In contrast, in the head 10*d* of the seventh embodiment, since the drum opposing surface Sa1 has the inclined surface 45*d* (that is, the edge of the head is chamfered), it is possible to prevent the damage of the outer circumferential surface 21. Further, in the seventh embodiment, the inclined surface is formed on only the upstream side of the drum opposing surface Sa1 in the rotational direction A. However, the same inclined surface (a chamfered portion) as the inclined surface 45*d* may be additionally formed on the downstream side of the drum opposing surface Sa1 in the rotational direction A.

In the above-mentioned embodiment, the top-emission-type head 10*d* is used. However, as described above, the structure in which the sliding surface comes into surface contact with the photoreceptor drum 110 can be applied to a bottom-emission-type head, as shown in FIG. 14. In the structure shown in FIG. 14, the transmissive substrate 31*a* having a substantially rectangular shape constitutes the drum opposing surface Sa1. The drum opposing surface Sa1 of the substrate 31*a* includes the sliding surface 41*a*, which is a curved surface recessed toward the opposite side to the photoreceptor drum 110 with a curvature substantially equal to that of the outer circumferential surface 21 of the photoreceptor drum 110, and the inclined surface 45*a* which is tilted such that an elevation angle θ1 with respect to the outer circumferential surface 21 is an acute angle. In this structure, since the sliding surface 41*a* of the substrate 31*a* comes into surface contact with the outer circumferential surface 21 of the photoreceptor drum 110, it is possible to maintain the stable posture or position of the head, similar to the structure shown in FIGS. 30 to 33. However, in this structure, it is difficult to achieve both a reduction in manufacturing costs and a stable posture or position of the head. This problem will be described below in detail.

The substrate needs to have high flatness in order to form the light emitting elements 38 thereon. For example, the substrate is more expensive than the sealing member not requiring high flatness. Therefore, from the viewpoint of a reduction in manufacturing costs, it is preferable that the substrate have a small size. In addition, when a plurality of substrates is manufactured by dividing a large board (a so-called mother glass), the larger the number of substrates obtained from one board is, the lower the manufacturing costs thereof becomes. Therefore, from this point of view, it is preferable that the substrate have a small size. Meanwhile, as shown in FIG. 14, in the structure in which the sliding surface 41*a* of the substrate 31*a* comes into surface contact with the photoreceptor drum 110, as the contact area of the sliding surface 41*a* with the photoreceptor drum 110 is larger, the effect of stabilizing the posture or position of the head (the effect of maintaining a predetermined distance between the light emitting element 38 and the photoreceptor drum 110) becomes more remarkable. As such, in the structure shown in FIG. 14, a reciprocal relationship between the postural or positional stabilization of the head and a reduction in the manufacturing costs thereof is established. That is, when the size of the substrate 32 is reduced in order to lower manufacturing costs, the positional or postural stabilization of the head is lowered (accuracy for maintaining the distance between the light emitting element 38 and the photoreceptor drum 110 is lowered). On the other hand, when the size of substrate increases in order to improve the stabilization of the head, the manufacturing costs are raised.

In contrast, in the seventh embodiment shown in FIGS. 30 to 33, since the sealing member 36*d*, not the substrate 32, comes into contact with the photoreceptor drum 110, it is possible to reliably ensure a sufficient area of the sliding surface coming into contact with the photoreceptor drum 110, regardless of the size of the substrate 32. For example, in the structure shown in FIG. 31, it is possible to increase a width W2 of the drum opposing surface Sa1 of the sealing member 36*d*, regardless of a width W1 of the substrate 32 in a direction perpendicular to the drum axis direction X. Therefore, it is possible to reduce the manufacturing costs of the substrate 32 by setting the width W1 of the substrate 32 to the minimum value required for forming the light emitting element 38, and to effectively stabilize the posture or position of the head (to accurately maintain a distance between the light emitting element 38 and the photoreceptor drum 110) by ensuring a sufficient width W2 of the sealing member 36*d*. That is, the seventh embodiment can achieve both the postural or positional stabilization of the head and a reduction in manufacturing costs, compare with the structure shown in FIG. 14.

Further, in the structure shown in FIG. 14, the substrate should have both a property suitable for forming the light emitting elements 38 and compatibility with the outer circumferential surface 21 of the photoreceptor drum 110 (in particular, friction resistance to the outer circumferential surface 21). The selection of the shape or material of the substrate is restricted within narrow limits. In contrast, in the seventh embodiment, a material forming the substrate having the light emitting elements 38 thereon can be separately selected from a material forming the sealing member 36*d* coming into contact with the photoreceptor drum 110, which makes it possible to improve the flexibility of the design of the head, compared with the structure shown in FIG. 14.

Eighth Embodiment

Figure 35:
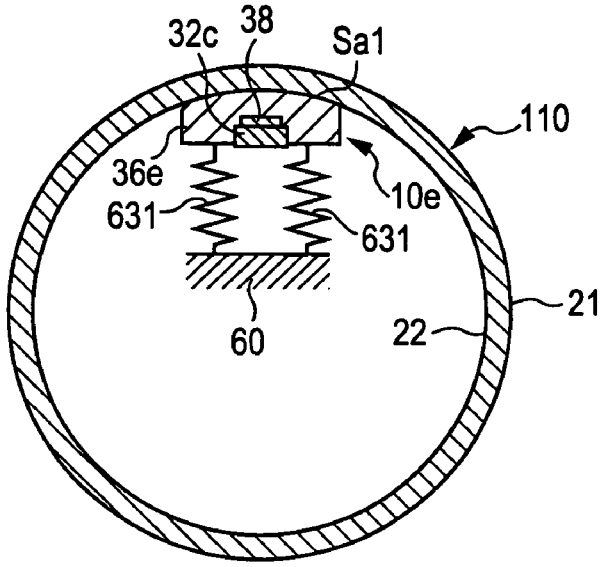
FIG. 35 is a cross-sectional view illustrating the structure of a portion of an image forming apparatus according to an eighth embodiment of the invention.

FIG. 35 is a cross-sectional view illustrating the structure of a portion of an image forming apparatus according to an eighth embodiment. In the seventh embodiment, the head 10*d* is opposite to the outer circumferential surface 21 of the photoreceptor drum 110. In contrast, in the eighth embodiment, a head 10*e* is opposite to the inner circumferential surface of the cylindrical photoreceptor drum 110. In the eighth embodiment, the photoreceptor drum 110 is a cylindrical member formed by laminating a photosensitive layer on an outer circumferential surface of a transmissive cylinder. The head 10*e* is urged against the photoreceptor drum 110 by a plurality of elastic bodies 631 so that a sealing member 36*e* comes into contact with an inner circumferential surface 22 of the photoreceptor drum 110. In the eighth embodiment, the same components as those in the seventh embodiment have the same reference numerals, and a description thereof will be omitted.

Figure 37:
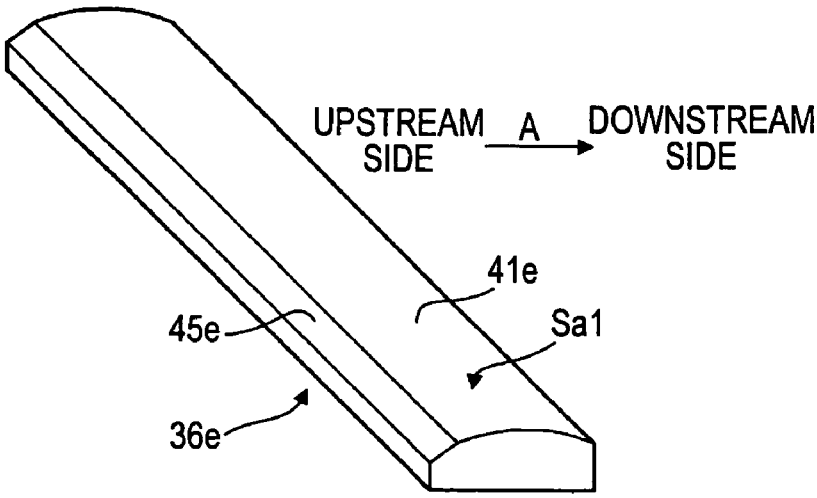
FIG. 37 is a perspective view illustrating the appearance of a substrate of the image forming apparatus according to the eighth embodiment.

FIG. 36 is an enlarged cross-sectional view illustrating the head 10*e* shown in FIG. 35. FIG. 37 is a perspective view illustrating the appearance of the sealing member 36*e*, paying attention to the drum opposing surface Sa1. As shown in FIG. 36, the drum opposing surface Sa1 of the sealing member 36*e* includes an inclined surface 45*e* and a sliding surface 41*e* which is shaped so as to come into surface contact with the inner circumferential surface 22 of the photoreceptor drum 110. That is, as shown in FIGS. 36 and 37, the sliding surface 41*e* is a curved surface (convex surface) which protrudes toward the photoreceptor drum 110 with a curvature substantially equal to that of the inner circumferential surface 22 of the photoreceptor drum 110. In other words, the sliding surface 41*e* can be referred to as a portion of the outer surface (outer circumferential surface) of a cylinder which has a radius substantially equal to the inner circumferential surface 22 of the photoreceptor drum 110. The inclined surface 45*e* of the sealing member 36*e* is positioned on the upstream side of the sliding surface 41*e* of the drum opposing surface Sa1 in the rotational direction A of the photoreceptor drum 110. As shown in FIG. 36, the inclined surface 45*e* is tilted with respect to the inner circumferential surface 22 such that an elevation angle θ2 with respect to the inner circumferential surface 22 of the photoreceptor drum 110 is an acute angle.

In the eighth embodiment, the sliding surface 41*e* having a curvature substantially equal to that of the inner circumferential surface 22 of the photoreceptor drum 110 comes into surface contact with the inner circumferential surface 22. Therefore, the same effects as those in the seventh embodiment can be obtained. Further, in the eighth embodiment, since the head 10*e* is accommodated inside the photoreceptor drum 110, it is possible to reduce a space required for arranging the head, compared with the seventh embodiment in which the head 10*d* is arranged outside the photoreceptor drum 110.

Ninth Embodiment

Figure 38:
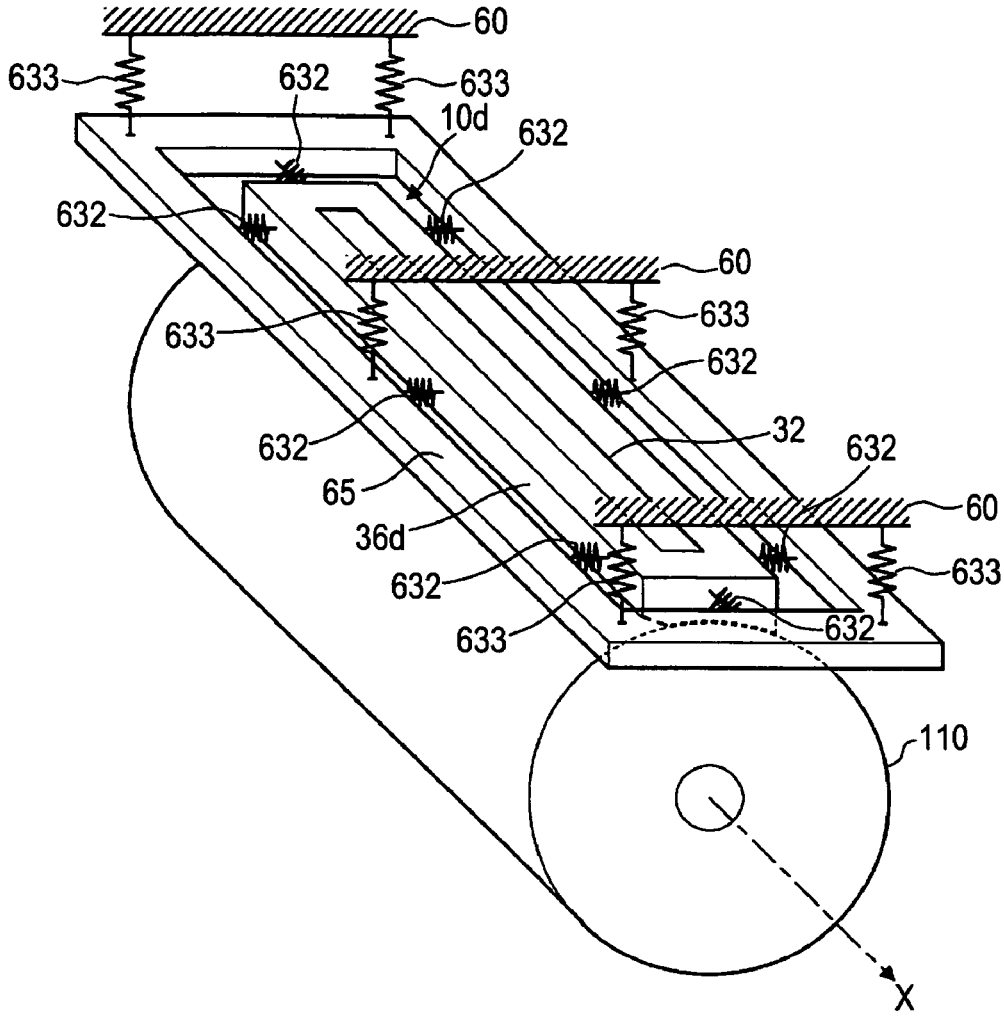
FIG. 38 is a perspective view illustrating the structure of a portion of an image forming apparatus according to a ninth embodiment of the invention.
Figure 39:
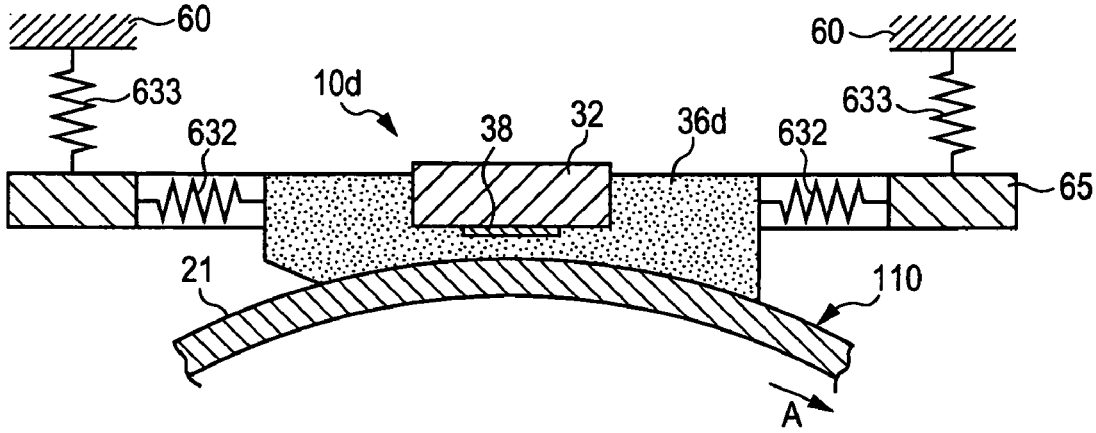
FIG. 39 is a cross-sectional view illustrating the structure of a head and a peripheral portion of the head of the image forming apparatus according to the ninth embodiment.

FIG. 38 is a perspective view illustrating the structure of the head 10*d* and the photoreceptor drum 110 of an image forming apparatus according to a ninth embodiment of the invention. FIG. 39 is a cross-sectional view illustrating components shown in FIG. 38, taken along a direction perpendicular to the drum axis direction X, and corresponds to FIG. 31 referred in the seventh embodiment. As shown in FIGS. 38 and 39, the image forming apparatus according to the ninth embodiment has a substantially rectangular frame member 65 surrounding the head 10*d*. An inner circumferential surface of the frame member 65 corresponds to the side surface of the head 10*d*. The frame member 65 can have any shapes as long as it has a portion opposite to the side surface of the head 10*d*. Therefore, the shape of the frame member 65 is not limited to that shown in FIG. 38.

In the seventh embodiment, a plurality of elastic bodies 631 is arranged on the surface of the head 10*d* opposite to the photoreceptor drum 110. In contrast, in the ninth embodiment, elastic bodies arranged on the side surfaces of the head 10*d* urge the head 10*d* against the photoreceptor drum 110. In the ninth embodiment, the same components as those in the seventh embodiment have the same reference numerals, and a description thereof will be omitted.

A plurality of elastic bodies 632 is provided between the inner circumferential surface of the frame member 65 and the side surface of the head 10*d*. Each elastic body 632 has one end fixed to the inner circumferential surface of the frame member 65 and the other end fixed to the side surface of the head 10*d*. More specifically, as shown in FIG. 38, three elastic bodies 632 are arranged at equal intervals on the side surface corresponding to each long side of the substantially rectangular head 10*d* such that an end of each of the three elastic bodies 632 is fixed to the side surface of the head 10*d* and the other end thereof is fixed to the inner circumferential surface of the frame member 65 opposite to the side surface of the head 10*d*. In addition, an end of one elastic body 632 is fixed in the center of the side surface corresponding to each short side of the head 10*d*, and the other end of the elastic body 632 is fixed to the inner circumferential surface of the frame member 65 opposite to the side surface of the head 10*d*.

Further, a plurality of elastic bodies 633 is arranged on a surface of the frame member 65 opposite to the photoreceptor drum 110. The elastic bodies 633 are members for urging the frame member 65 against the photoreceptor drum 110, and are provided between the case 60 of the image forming apparatus and the frame member 65. In the ninth embodiment, six elastic bodies 633 are arranged around four corners of the frame member 65 and in a central portion thereof in the longitudinal direction. The elastic bodies 632 and 633 are the same components as the elastic bodies 631 of the seventh embodiment. For example, coil springs or leaf springs are used as the elastic bodies 632 and 633.

In the above-mentioned structure, when the elastic bodies 633 press the frame member 65 against the photoreceptor drum 110, the elastic bodies 632 are extended. Then, the head 10*d* is urged against the photoreceptor drum 110 by elastic force generated by the elastic bodies 632. Therefore, the ninth embodiment can obtain the same effects as those in the seventh embodiment.

Figure 40:
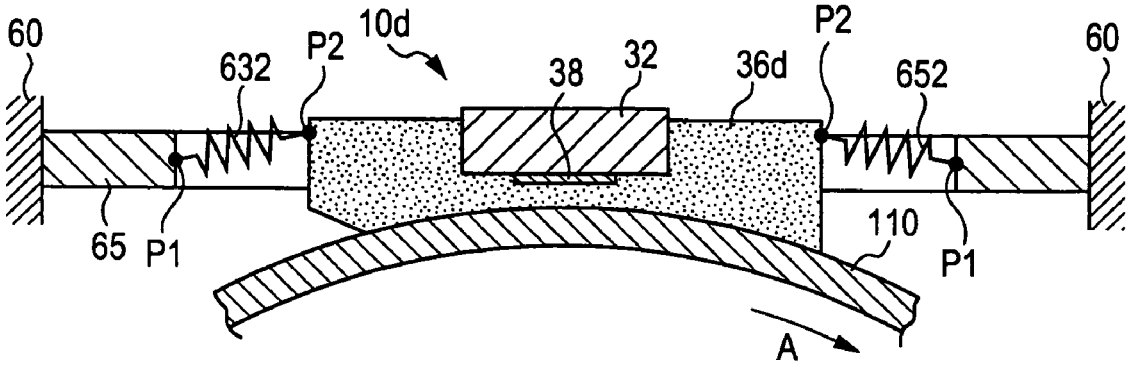
FIG. 40 is a cross-sectional view illustrating the structure of a head and a peripheral portion of the head of another image forming apparatus according to the ninth embodiment.

In the above-mentioned structure, the elastic bodies 633 press the frame member 65 against the photoreceptor drum 110. However, as shown in FIG. 40, the head 10*d* may be urged against the photoreceptor 110 according to the fixed position of the frame member 65. That is, in this structure, the frame member 65 is fixed to the case 60 such that an end portion P1 of each elastic body 632 fixed to the frame member 65 is positioned closer to the photoreceptor drum 110 than an end portion P2 of the elastic body 632 fixed to the head 10*d*. In this structure, the elastic force of the elastic bodies 632 causes the head 10*d* to be pressed against the photoreceptor drum 110, and thus the same effects as described above can be obtained. In addition, according to this structure, it is unnecessary to provide the elastic bodies 633 on the surfaces of the head 10*d* and the frame member 65 opposite to the photoreceptor drum 110, which results in a reduction in a space to be ensured on the upper side of the head 10*d*.

In FIGS. 38 to 40, the head 10*d* according to the seventh embodiment is urged. However, similar to the eighth embodiment, the head 10*d* is urged against the photoreceptor drum 110 by the components of the ninth embodiment, such as the frame member 65 and the elastic bodies 632.

Modifications of Seventh to Ninth Embodiments

Various modifications of the seventh to ninth embodiments can be made. The modifications thereof will be described in detail. The following modifications may be appropriately combined.

First Modification

Figure 41:
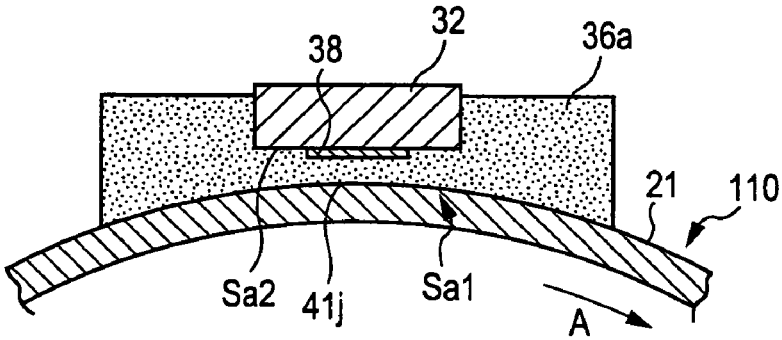
FIG. 41 is a cross-sectional view illustrating the structure of a head of an image forming apparatus according to a first modification of the seventh or ninth embodiment.

In the seventh to ninth embodiments, the drum opposing surface Sa1 includes an inclined surface. However, the inclined surface is not necessarily needed. For example, in the seventh or ninth embodiment, as shown in FIG. 41, instead of the sealing member 36*d*, a sealing member 36*a* may be used in which the entire drum opposing surface Sa1 is a sliding surface 41*j* having a curvature substantially equal to that of the outer circumferential surface 21 of the photoreceptor drum 110. In addition, as shown in FIG. 42, in the eighth embodiment, a sealing member 36*b* may be used in which the entire drum opposing surface Sa1 is a sliding surface 41*k* having a curvature substantially equal to that of the inner circumferential surface 22 of the photoreceptor drum 110.

Second Modification

In the seventh to ninth embodiments, optical components may be provided between the light emitting elements 38 and the photoreceptor drum 110. For example, an optical waveguide (for example, an optical fiber) for guiding light emitted from the light emitting elements 38 to the surface of the photoreceptor drum 110 or a lens for condensing light emitted from the light emitting elements 38 may be provided between the light emitting elements 38 and the photoreceptor drum 110.

Figure 43:
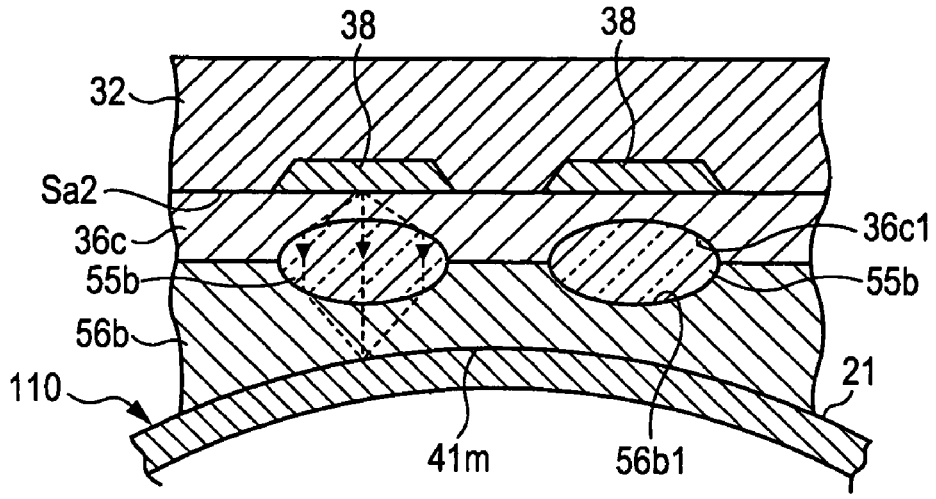
FIG. 43 is a cross-sectional view illustrating the structure of a head of an image forming apparatus according to a second modification of the seventh or ninth embodiment.

FIG. 43 is a cross-sectional view illustrating the structure of a head of an image forming apparatus according to a second modification of the seventh or ninth embodiment. In this structure, microlenses 55*b* for condensing light emitted from the light emitting elements 38 are provided between the light emitting elements 38 and the photoreceptor drum 110. The microlenses 55*b* are arranged in an array shape so as to be opposite to the light emitting elements 38. In the structure shown in FIG. 43, a board 56*b* overlaps a surface of a sealing member 36*c* covering the light emitting elements 38 which faces the photoreceptor drum 110. The board 56*b* may be a thin film which is formed of a resin material on the sealing member 36*c*, or a plate member bonded to the sealing member 36*c*. A plurality of curved-shaped concave portions 36*c*1 are formed in a surface of the sealing member 36*c* facing the board 56*b* at positions corresponding to the light emitting elements 38. Similarly, a plurality of curved-shaped concave portions 56*b*1 are formed in a surface of the board 56*b* facing the sealing member 36*c* at positions corresponding to the light emitting elements 38. A surface of the board 56*b* facing the outer circumferential surface 21 of the photoreceptor drum 110 is composed of a sliding surface 41*m* having a curvature substantially equal to that of the outer circumferential surface 21.

A resin material having a different reflective index from those of the sealing member 36*c* and the board 56*b* is filled up into spaces formed by the concave portions 36*c*1 of the sealing member 36*c* and the concave portions 56*b*1 of the substrate 56*b*, thereby forming the microlenses 55*b*, which are double-sided convex lenses. The microlenses 55*b* condense light emitted from the corresponding light emitting elements 38, so that an image is formed on the surface of the photoreceptor drum 110. The shape and arrangement of the microlenses 55*b* are not limited to those shown in FIG. 43. For example, convex microlenses protruding toward the photoreceptor drum 110 may be formed on the surface of the sealing member.

In the structure in which light emitted from the light emitting elements 38 is condensed by the microlenses 55*b*, even when a distance between the light emitting elements 38 and the photoreceptor drum 110 varies slightly, a variation in the area of a spot on the surface of the photoreceptor drum 110 where light emitted from the light emitting element 38 is incident becomes remarkable. According to this modification, the surface contact between the photoreceptor drum 110 and the sliding surface having a curvature substantially equal to that of the surface of the photoreceptor drum 110 makes it possible to maintain a uniform distance between the light emitting elements 38 and the photoreceptor drum 110 with high accuracy. Therefore, in the structure capable of improving the utilization efficiency of light by using the microlenses 55*b*, it is also possible to accurately form a predetermined latent image on the surface of the photoreceptor drum 110. That is, the effects of maintaining the uniform distance between the light emitting elements 38 and the photoreceptor drum 110 can be more reliably obtained by the structure in which optical components, such as the microlenses 55*b*, are arranged between the light emitting elements 38 and the photoreceptor drum 110, as shown in FIG. 43.

Third Modification

In the first to ninth embodiments, the light emitting element includes the light emitting layer formed of an organic EL material. However, functions related to the above-mentioned embodiments or modifications may be realized by using a head having light emitting elements arranged therein, each including a light emitting layer formed of an inorganic EL material, or a head having light emitting diodes (LEDs) as light emitting elements. That is, elements which emit light when electric energy is applied as well as the light emitting elements each including a light emitting layer formed of an organic EL material can be used.

Tenth to Thirteenth Embodiments

Figure 44:
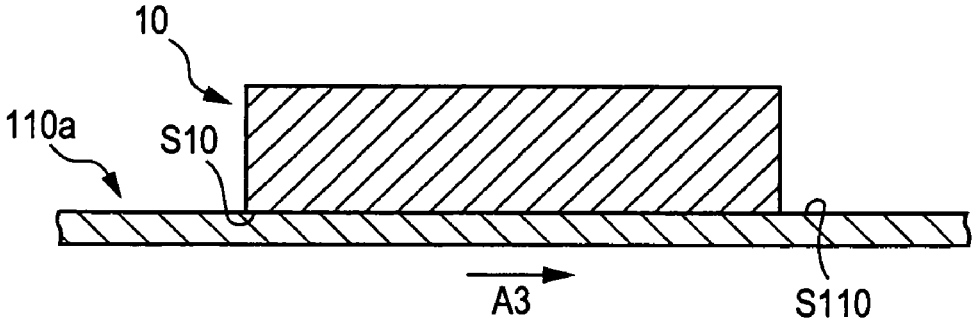
FIG. 44 is a cross-sectional view illustrating main parts of an image forming apparatus according to tenth to thirteenth embodiments of the invention.

FIG. 44 is a cross-sectional view illustrating main parts of an image forming apparatus according to tenth to thirteenth embodiments. As shown in FIG. 44, each of the image forming apparatuses according to the tenth to thirteenth embodiments includes an image carrier 110*a*, such as a photoreceptor drum or a photosensitive belt, and a head 10 for forming a latent image on the image carrier 110*a*. The image carrier 110*a* is supported in the case of the image forming apparatus, and has an image carrier surface S110 on which a latent image is formed. The image carrier surface S110 is advanced in a direction A3 represented by an arrow in FIG. 44 when a latent image is formed. The head 10 is supported in the case of the image forming apparatus, and has a contact surface S110 coming into contact with the image carrier surface S110. In addition, the head 10 emits light from the contact surface S110 to the image carrier surface S110. A latent image is formed on the image carrier surface S110 by the emission. Light emitted from the head 10 travels along a direction X1 (a direction perpendicular to the plane of FIG. 44) traversing the image carrier surface S110 which is advanced in the direction A3, and the latent image formed on the image carrier surface S110 has a two-dimensional pattern by the emission of light from the head 10 and the advance of the image carrier surface S110. The direction X1 is the drum axis direction X when the image carrier 110*a* is a photoreceptor drum.

Hereinafter, the tenth to thirteenth embodiments according to the invention will be described in detail. In the following drawings used for the description, only the main parts are hatched. In addition, the image forming apparatuses of the tenth to thirteenth embodiments differ from each other in the structure of the head 10, and thus a description of the above-mentioned embodiments will be made, centered on the structure of the head 10. In the tenth embodiment, the head 10 is denoted by reference numeral 200. In the eleventh embodiment, the head 10 is denoted by reference numeral 300. In the twelfth embodiment, the head 10 is denoted by reference numeral 201. In the thirteenth embodiment, the head 10 is denoted by reference numeral 301.

Tenth Embodiment

Figure 45:
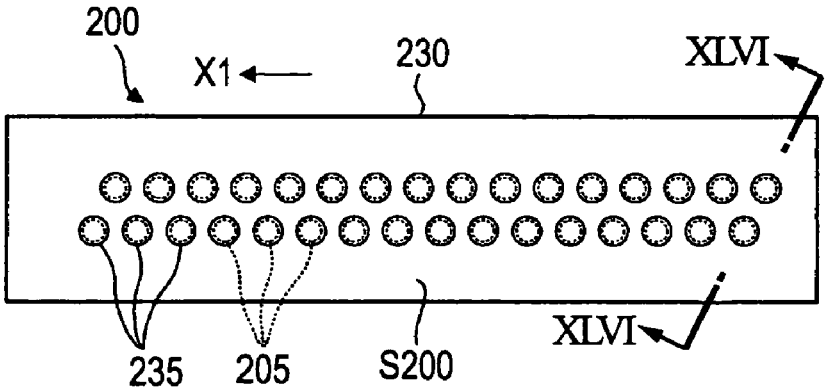
FIG. 45 is a plan view illustrating the structure of a head 200 of an image forming apparatus according to the tenth embodiment of the invention.

FIG. 45 is a plan view illustrating the structure of the head 200 of the image forming apparatus according to the tenth embodiment of the invention. As shown in FIG. 45, in the head 200, a plurality of light emitting elements 205 are arranged in two rows or in island shapes along the direction X1. These light emitting elements 205 are covered with a flat sealing substrate 230. A front surface of the sealing substrate 230 serves as a light emission surface S200, and a rear surface thereof is opposite to the light emitting elements 205. The light emission surface S200 is the contact surface S10 of FIG. 44. A cylindrical optical waveguide 235 is formed in each light emitting element 205 in a portion of the sealing substrate 230 overlapping the light emitting element 205.

Figure 46:
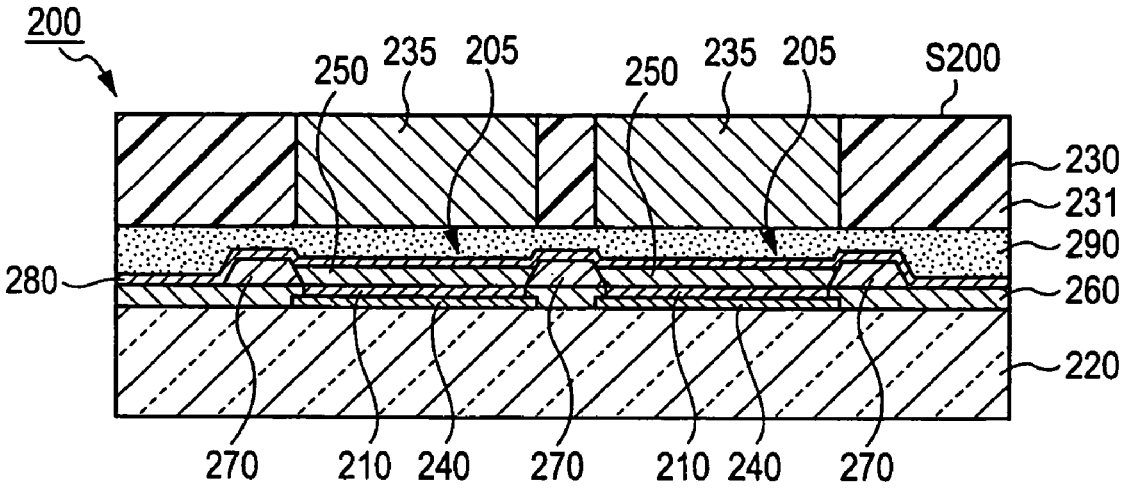
FIG. 46 is a cross-sectional view taken along the line XLVI-XLVI of FIG. 45.

FIG. 46 is a cross-sectional view taken along the line XLVI-XLVI of FIG. 45. As shown in FIG. 46, the head 200 has a structure in which a plurality of light emitting elements 205 is provided between a plate-shaped main substrate 220 and a plate-shaped sealing substrate 230. The main substrate 220 is formed of, for example, glass or plastic, and the light emitting elements 205 are formed on the main substrate 220. Each light emitting element 205 is an organic EL element which emits light when electric energy is applied, and regions where the light emitting elements 205 are formed are divided by an oxide film 260 and partition walls (banks) 270 formed on the oxide film 260. In each region, an electrode 240 serving as a cathode, a surface-emitting layer 210 which is formed of an organic EL material, a transmissive hole-injecting layer 250, and a transparent electrode 280 serving as an anode are sequentially formed on the main substrate 220.

Further, the sealing substrate 230 overlaps the main substrate 220 having the light emitting elements 205 formed thereon so as to seal the light emitting elements 205 together with the main substrate 220. The sealing protects the light emitting elements 205 from the air (in particular, water and oxygen) and thus prevents the deterioration thereof. A transmissive adhesive 290 is used to fix the sealing substrate 230 to the main substrate 220. For example, a thermosetting adhesive or an ultraviolet-curable adhesive is used as the adhesive 290.

The sealing method used for this technical field includes a film sealing method in which the entire surface of the sealing substrate 230 is bonded to the main substrate 220 by the adhesive 290 and a gap sealing method in which the periphery of the sealing substrate 230 is bonded to the main substrate 220 by the adhesive 290 to form spaces defined by the sealing substrate 230 and the main substrate 220 around the light emitting elements 205. A drying agent is arranged in the spaces in the gap sealing method. In the tenth embodiment, the film sealing method is used, but the gap sealing method can be used.

The sealing substrate 230 is formed by arranging a plurality of optical waveguides 235 in a plate 231. The plate 231 is formed of, for example, glass, metal, ceramic, or plastic. Each optical waveguide 235 is provided so as to pass through the front and rear surfaces of the sealing substrate 230, and the central axis thereof extends in the thickness direction of the sealing substrate 230. In addition, the outer circumferential surface of each optical waveguide 235 is covered with the plate 231. One end surface of the optical waveguide 235 facing the light emitting element 205 serves as a portion of the rear surface of the sealing substrate 230, and the other end surface thereof serves as a portion of the front surface (the light emission surface S200) of the sealing substrate 230. The one end surface of the optical waveguide 235 facing the light emitting element 205 covers the light emitting layer 210 of the corresponding light emitting element 205, as viewed from the light emission surface S200.

Further, the optical waveguides 235 are formed of a transmissive material. The material has a refractive index which is equal to that of the adhesive 290 and is higher than that of a material forming the plate 231.

In addition, the optical waveguides 235 are fixed to the plate 231. Any methods can be used to fix the optical waveguides 235 to the plate, but attentions should be paid when using a method in which the outer circumferential surface of the optical waveguide 235 does not contact the plate 231. In this case, a method of fixing the optical waveguides 235 to the plate 231 using an adhesive is considered. In this method, an adhesive needs to have a refractive index lower than that of a material forming the optical waveguide 235. That is, the outer circumferential surfaces of the optical waveguides 235 must be covered with a material having a refractive index lower than that of the material.

Figure 47:
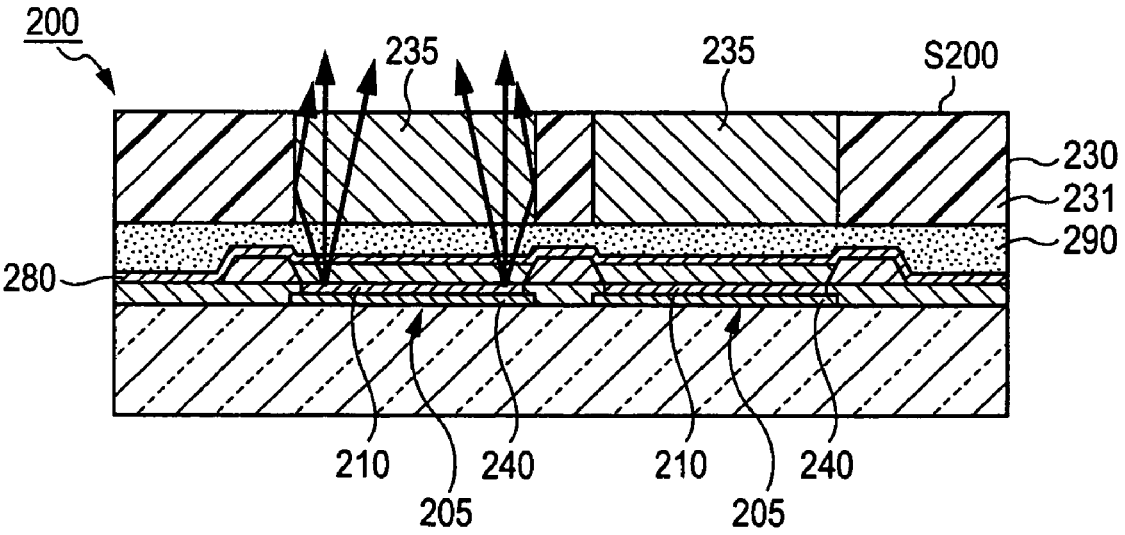
FIG. 47 is a cross-sectional view illustrating an optical operation of the head 200.

FIG. 47 is a cross-sectional view illustrating the optical operation of the head 200. In the head 200, when a voltage is applied by the electrode 240 and the transparent electrode 280, the light emitting layer 210 interposed therebetween emits light. Most of light emitted from the light emitting layer 210 to the sealing substrate 230 travels substantially in a direction perpendicular to the sealing substrate 230 to reach the rear surface of the sealing substrate 230 through the hole injecting layer 250, the transparent electrode 280, and the adhesive 290, more particularly, to reach the one end surface of the optical waveguide 235 facing the corresponding light emitting element 205. Since the refractive index of the material forming the optical waveguides 235 is equal to or higher than that of the adhesive 290, it is easy for all light components reached the one end surface to be incident on the optical waveguide 235. Therefore, most of the reached light components are incident on the optical waveguides 235 and then travel in the optical waveguides 235.

When the light components traveling in the optical waveguide 235 reach the outer circumferential surface of the optical waveguide 235, most of them are specularly reflected therefrom. That is, the optical waveguide 235 functions as a core of an optical fiber having a large diameter to guide the incident light. The reason why the specular reflection occurs is that an angle between the outer circumferential surface of the optical waveguide 235 and the traveling direction of light reached the outer circumferential surface is generally very small. In order words, this is because, in general, the incident angle of light on the outer circumferential surface of the optical waveguide 235 is very large. More specifically, the reason is as follows.

Since the refractive index of the material forming the optical waveguide 235 is higher than that of a material covering the outer circumferential surface thereof (for example, an adhesive or a material forming the plate 231), most of the light components traveling in the optical waveguide 235 are specularly reflected. However, in order for the specular reflection, the incident angle should be larger than a threshold angle which is determined on the basis of the ratio of two reflective indexes. Therefore, as described above, since the incident angle of light with respect to the outer circumferential surface is generally very large, most of the light components reached the outer circumferential surface are specularly reflected therefrom as long as a material having an excessive threshold angle is not used. Therefore, it is preferable to select a material forming the optical waveguides 235 and a material covering the outer circumferential surfaces thereof such that a large number of light components are specular reflected.

In this way, light travels in the optical waveguide 235 and is then emitted from the end surface of the optical waveguide 235 on the side of the light emission surface S200. Therefore, a spot image (an optical image) is formed on the light emission surface S200.

Figure 48:
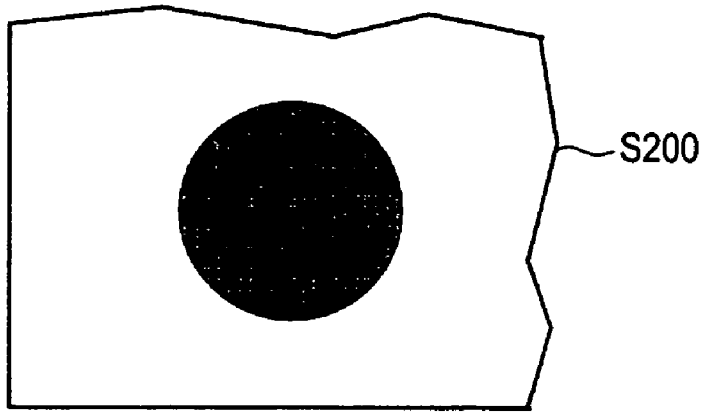
FIG. 48 is a diagram illustrating a spot image formed by the head 200.

FIG. 48 is a diagram illustrating the spot image formed by the head 200. The shape, size, and forming position of the spot image are identical with the end surface of the optical waveguide 235 on the side of the light emission surface S200. In addition, the spot image has a substantially uniform distribution of brightness. Further, since light emitted from the light emitting layer 210 is not specularly reflected from an interface between the adhesive 290 and the optical waveguide 235, the utilization efficiency of light emitted from the light emitting layer 210 is improved.

Furthermore, even when the thickness of the sealing substrate 230 is reduced due to the abrasion of a contact portion and thus the optical waveguide 235 is shortened, the shape and size of the end surface of the optical waveguide 235 exposed from the light emission surface S200 are hardly varied, since the optical waveguide 235 is a cylindrical member which guides light by the specular reflection from the outer circumferential surface thereof and the central axis thereof extends in a direction where the contact surface recedes due to abrasion. Thus, the shape and size of the spot image formed on the light emission surface S200 are also hardly changed.

As described above, according to the image forming apparatus of the tenth embodiment, in disregard of contact exposure in which the head 200 comes into contact with the image carrier 110*a*, it is possible to guide light emitted from the light emitting layer 210 to the sealing substrate 230 without leakage and thus to stably form a high-definition image. That is, it is possible to reduce a variation in the area or shape of a spot image. This effect contributes to an improvement in the quality of printing and stabilization. In addition, since the optical waveguides are formed in the sealing substrate not requiring surface accuracy as high as the main substrate, an image forming apparatus can be more easily manufactured than an image forming apparatus having a head in which the optical waveguides are formed in the main substrate.

Next, an example of a method of manufacturing the head 200 will be described.

Figure 49:
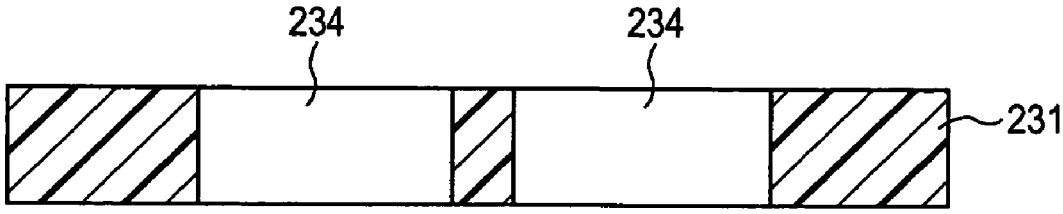
FIG. 49 is a diagram illustrating a first process of a method of manufacturing the head 200.

FIG. 49 is a diagram illustrating a first process of the method of manufacturing the head 200. As shown in FIG. 49, first, a plurality of cylindrical holes is formed in the plate 231. Since these holes are filled up in a subsequent process to serve as the optical waveguides 235, they are formed such that end surfaces thereof can cover the light emitting layer 210. A well-known method suitable for a material forming the plate 231 is used to form these holes. For example, when the plate 231 is formed of glass, a method of etching the plate 231 by using fluoric acid to form the holes can be used. In addition, when the plate 231 is formed of, for example, an ultraviolet-curable resin, a method of radiating ultraviolet rays on a portion of the plate 231 covered with a mask to harden it and of cutting non-hardened portions can be used.

Figure 50:
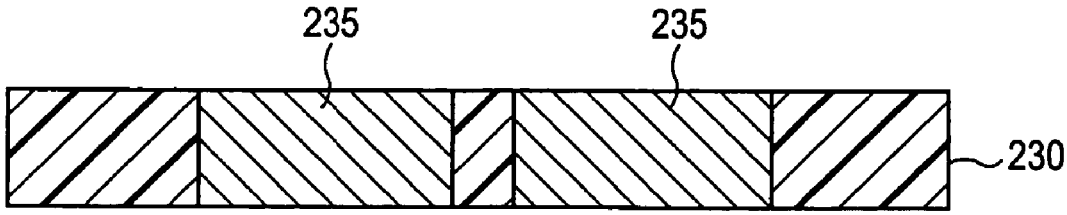
FIG. 50 is a diagram illustrating the next process of that shown in FIG. 49.

FIG. 50 is a diagram illustrating the next process of that shown in FIG. 49. As shown in FIG. 50, the holes are filled up to form the optical waveguides 235 in the sealing substrate 230. That is, a resin material forming the optical waveguides 235 is filled up into the holes so that both end surfaces of each optical waveguide 235 are flush with the front and rear surfaces of the sealing substrate 230. The holes can be filled up by, for example, a method of filling up the resin material using a squeegee or an ink-jet method of applying the resin material using a dispenser. When the sealing substrate 230 is manufactured by the filling method, a material forming the optical waveguide 235 is limited to resin. However, when the sealing substrate 230 is manufactured by the other methods, the material is not limited to resin.

Figure 51:
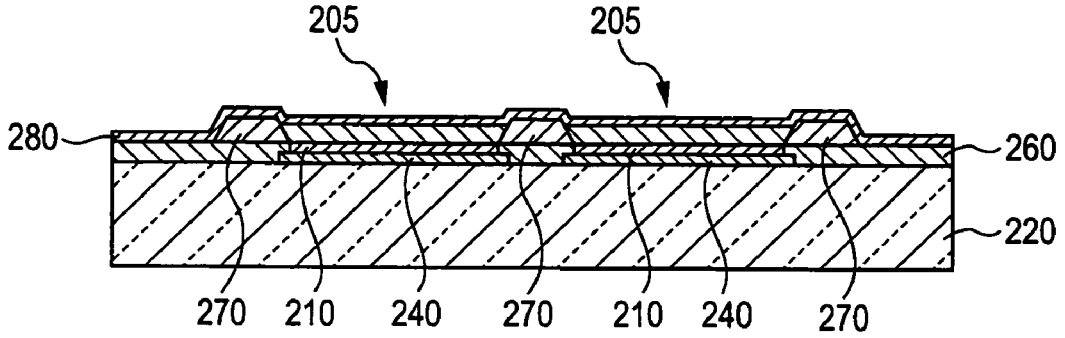
FIG. 51 is a diagram illustrating the next process of that shown in FIG. 50.

FIG. 51 is a diagram illustrating the next process of that shown in FIG. 50. As shown in FIG. 51, a plurality of light emitting elements 205 is formed on the main substrate 220.

Figure 52:
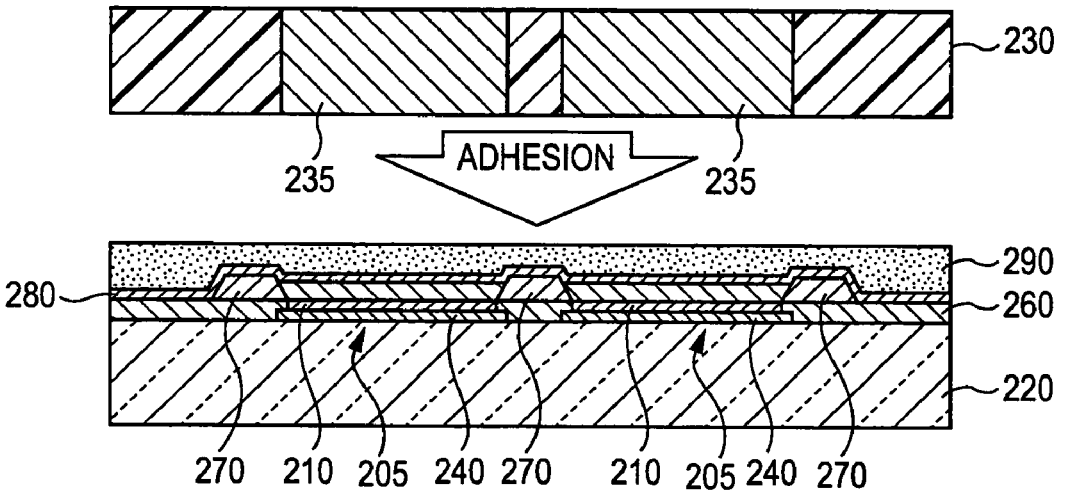
FIG. 52 is a diagram illustrating the next process of that shown in FIG. 51.

FIG. 52 is a diagram illustrating the next process of that shown in FIG. 51. As shown in FIG. 52, the adhesive 290 is coated on the surface of the main substrate 220 having the light emitting elements 205 formed thereon (or the rear surface of the sealing substrate 230), and the sealing substrate 230 is bonded and fixed to the main substrate 220 by the adhesive 290. At that time, the main substrate 220 and the sealing substrate 230 are arranged such that an end surface of each optical waveguide 235 facing the main substrate 220 covers the light emitting layer 210 of the corresponding light emitting element 205, thereby completing the head 200.

As described above, in this manufacturing method, a process for cutting the substrate is needed. However, the sealing substrate, not the main substrate, is cut. Therefore, the utilization efficiency of the main substrate requiring a high degree of utilization efficiency is not lowered, which is effective in the mass production.

Eleventh Embodiment

Figure 53:
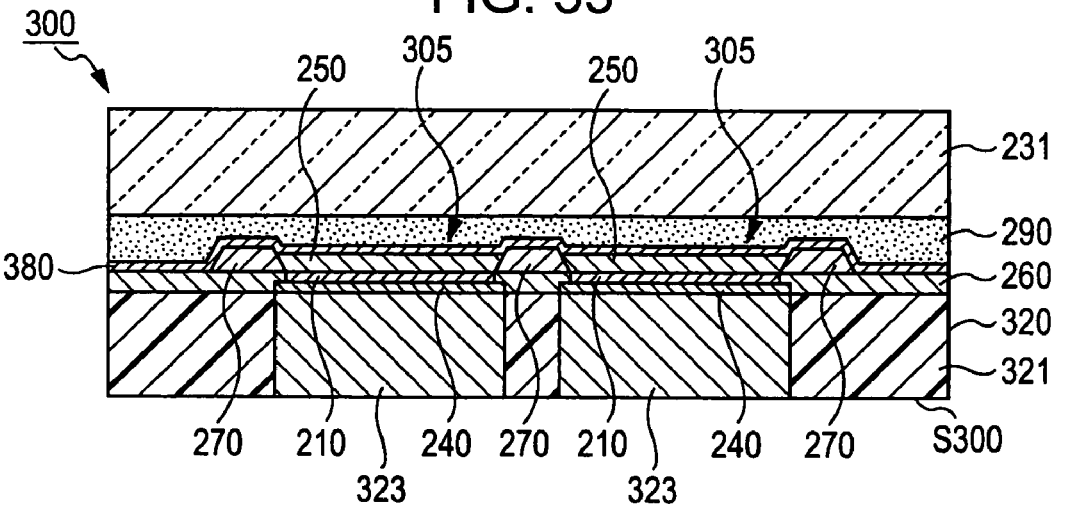
FIG. 53 is a cross-sectional view illustrating the structure of a head 300 of an image forming apparatus according to the eleventh embodiment of the invention.

FIG. 53 is a cross-sectional view illustrating the structure of the head 300 of the image forming apparatus according to the eleventh embodiment of the invention. The head 300 differs from the head 200 shown in FIG. 46 in that the optical waveguides are formed in the main substrate, not in the sealing substrate. From the viewpoint of the difference, in the head 300, light emitting elements 305 are used instead of the light emitting elements 205, and a main substrate 320 is used instead of the main substrate 220. However, the plate 231 is used as the sealing substrate as it is.

A surface of the main substrate 320 opposite to the surface thereof having the light emitting elements 305 formed thereon is a light emission surface S300. The light emission surface S300 corresponds to the contact surface S10 of FIG. 44. The light emitting element 305 differs from the light emitting element 205 in that a transparent electrode 340, serving as an anode, is substituted for the electrode 240 serving as a cathode, and an electrode 380, serving as a cathode, is substituted for the transparent electrode 280 serving as an anode.

The main substrate 320 is formed by arranging optical waveguides 323 in a plate 321 so as to correspond to light emitting elements 305. Each optical waveguide 323 overlaps the corresponding light emitting element 305. The plate 321 is formed of, for example, glass, quartz, or plastic. Each optical waveguide 323 is provided so as to pass through the front and rear surfaces of the main substrate 320, and the central axis thereof extends in the thickness direction of the main substrate 320. In addition, the outer circumferential surface of each optical waveguide 323 is covered with the plate 321. One end surface of the optical waveguide 323 facing the light emitting element 305 serves as a portion of the rear surface of the main substrate 320, and the other end surface thereof serves as a portion of the front surface (the light emission surface S300) of the main substrate 320.

The one end surface of the optical waveguide 323 facing the light emitting element 305 covers the light emitting layer 210 of the corresponding light emitting element 305, as viewed from the light emission surface S300. Further, the optical waveguides 323 are formed of a transmissive material. The material has a refractive index which is higher than that of a material forming the plate 321. That is, the optical waveguides 323 are fixed to the plate 321, and the outer circumferential surfaces thereof are covered with a material having a refractive index lower than that of the material.

Figure 54:
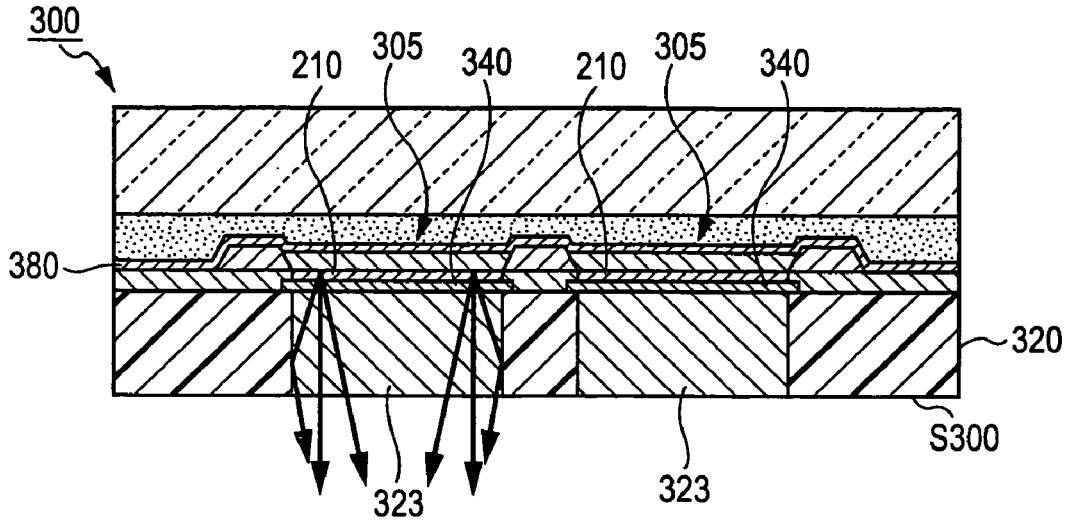
FIG. 54 is a cross-sectional view illustrating an optical operation of the head 300.

FIG. 54 is a cross-sectional view illustrating the optical operation of the head 300. In the head 300, when a voltage is applied by the transparent electrode 340 and the electrode 380, the light emitting layer 210 interposed therebetween emits light. Most of light emitted from the light emitting layer 210 to the main substrate 320 travels substantially in a direction perpendicular to the main substrate 320 to reach the rear surface of the main substrate 320 through the transparent electrode 340, more particularly, to reach the one end surface of the optical waveguide 323 facing the corresponding light emitting element 305. The light reached the one end surface is incident on the optical waveguide 323 and then travels in the optical waveguides 323. Since the optical waveguide 323 functions as a core of an optical fiber having a large diameter, most of the light incident on the optical waveguide 323 travels in the optical waveguide 323 and is then emitted from the end surface of the optical waveguide 323 on the side of the light emission surface S300.

The image forming apparatus of the eleventh embodiment can obtain the same effects as those obtained from the image forming apparatus of the tenth embodiment. However, since the optical waveguides are formed in the main substrate, the effects obtained by forming the optical waveguides in the sealing substrate are not obtained.

Further, in the image forming apparatus according to the eleventh embodiment, since the optical waveguides 323 are formed in the main substrate 320, a distance between the light emitting layer and the optical waveguide is smaller than that in the image forming apparatus according to the tenth embodiment. This contributes to an improvement in the brightness of a spot image.

Twelfth Embodiment

Figure 55:
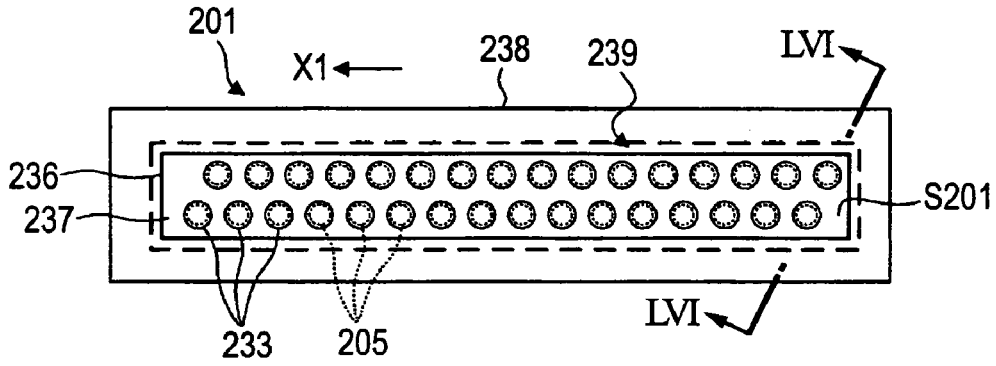
FIG. 55 is a cross-sectional view illustrating the structure of a head 201 of an image forming apparatus according to the twelfth embodiment of the invention.

FIG. 55 is a plan view illustrating the structure of the head 201 of the image forming apparatus according to the twelfth embodiment of the invention. As shown in FIG. 55, in the head 201, a plurality of light emitting elements 205 are arranged in two rows or in island shapes along the direction X1. These light emitting elements 205 are covered with a sealing substrate 238, and are further covered with a flat optical waveguide plate 236 formed in a groove (concave portion) 239 of the sealing substrate 238. A front surface of the optical waveguide plate 236 serves as a light emission surface S201, and a rear surface thereof is opposite to the light emitting elements 205 with the sealing substrate 238 interposed therebetween. The light emission surface S201 on which a spot image will be formed is a portion of the contact surface S10 of FIG. 44. A cylindrical optical waveguide 233 is formed in each light emitting element 205 in a portion of the optical waveguide plate 236 overlapping the light emitting element 205.

Figure 56:
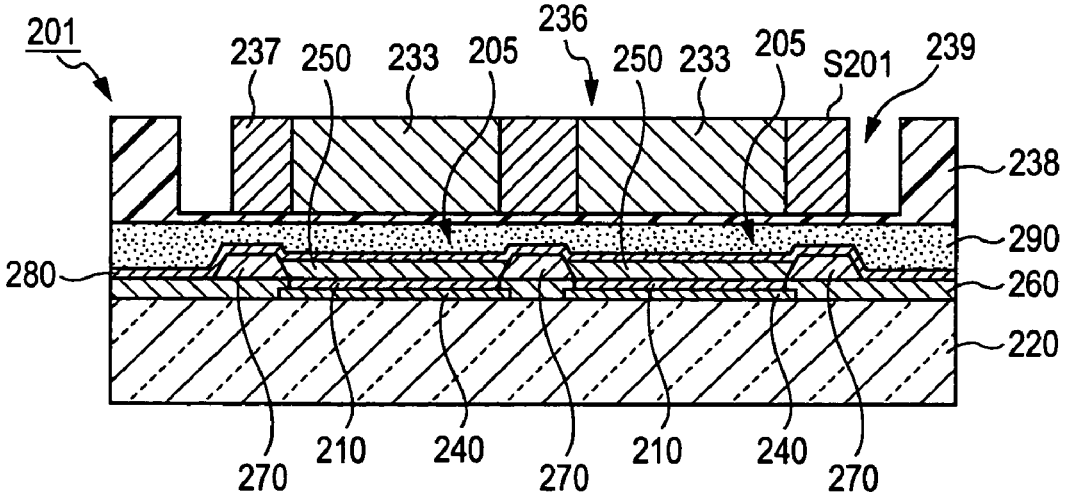
FIG. 56 is a cross-sectional view taken along the line LVI-LVI of FIG. 55.

FIG. 56 is a cross-sectional view taken along the line LVI-LVI of FIG. 55. As shown in FIG. 56, the head 201 has a structure in which a plurality of light emitting elements 205 is provided between a plate-shaped main substrate 220 and a plate-shaped sealing substrate 238. The sealing substrate 238 overlaps the main substrate 220 having the light emitting elements 205 formed thereon so as to seal the light emitting elements 205 together with the main substrate 220. A transmissive adhesive 290 is used to fix the sealing substrate 238 to the main substrate 220.

The sealing substrate 238 is a plate member having a groove 239 in one surface (front surface) thereof opposite to the other surface (rear surface) thereof facing the light emitting elements 205. The groove 239 has a flat bottom. The sealing substrate is generally formed of, for example, glass, metal, ceramic, or plastic. However, since the sealing substrate 238 needs to transmit light emitted from the light emitting layer 210, the sealing substrate 238 is formed of a transmissive material. In addition, the refractive index of a material forming the sealing substrate 238 is equal to or higher than that of the adhesive 290.

The optical waveguide plate 236 is fixed to the sealing substrate 238 such that the rear surface thereof comes into contact with the bottom of the groove 239. Any methods can be used to fix the optical waveguide plate 236 to the sealing substrate 238 as long as a light shielding material is not interposed between the rear surface of the optical waveguide plate 236 and the bottom of the groove 239. The optical waveguide plate 236 is formed by arranging a plurality of optical waveguides 233 in a plate 237 having rectangular front and rear surfaces.

Each optical waveguide 233 for guiding light emitted from the light emitting layer 210 is provided so as to pass through the front and rear surfaces of the optical waveguide plate 236, and the central axis thereof extends in the thickness direction of the optical waveguide plate 236. In addition, the outer circumferential surface of each optical waveguide 233 is covered with the plate 237. One end surface of the optical waveguide 233 facing the light emitting element 205 serves as a portion of the rear surface of the optical waveguide plate 236, and the other end surface thereof serves as a portion of the front surface (the light emission surface S201) of the optical waveguide plate 236. The one end surface of the optical waveguide 233 facing the light emitting element 205 covers the light emitting layer 210 of the corresponding light emitting element 205, as viewed from the light emission surface S201.

Further, the optical waveguides 233 are formed of a transmissive material. The material has a refractive index which is equal to or higher than that of a material forming the sealing substrate 238 and which is higher than that of a material forming the plate 237. In addition, the optical waveguides 233 are fixed to the plate 237. Any methods can be used to fix the optical waveguides 233 to the plate 237, but attentions should be paid when using a method in which the outer circumferential surface of the optical waveguide 233 does not contact the plate 237. In this case, a method of fixing the optical waveguides 233 to the plate 237 using an adhesive is considered. In this method, it is necessary to use an adhesive having a refractive index lower than that of a material forming the optical waveguide 233. That is, the outer circumferential surfaces of the optical waveguides 233 must be covered with a material having a refractive index lower than that of the material.

The width, length, and depth of the groove 239 are set such that the optical waveguide plate 236 is flush with the sealing substrate 238 except for the groove 239. That is, the width, length, and depth of the groove 239 depend on the width, length, and thickness of the optical waveguide plate 236. The width and length of the optical waveguide plate 236 are set to the minimum values capable of causing a plurality of optical waveguides 233 to be arranged in the optical waveguide plate 236. That is, the width and length of the optical waveguide plate 236 depend on the arrangement of the light emitting elements 205. More specifically, the width of the groove 239 is about several hundreds of micrometers.

The thickness of the optical waveguide plate 236 depends on the thickness of the sealing substrate 238.

Since the optical waveguide 233 functions to guide light emitted from the light emitting layer 210, it is preferable that the end surface thereof facing the light emitting element 205 be close to the light emitting element 205. Therefore, it is preferable that a thick optical waveguide plate 236 be used to improve the utilization efficiency of light emitted from the light emitting layer 210. However, in order to increase the thickness of the optical waveguide plate 236, it is necessary to reduce the thickness of a portion of the sealing substrate 238 where the groove 239 is formed. In this case, the rigidity of the sealing substrate 238 should be considered. In this structure, the width of the groove 239 is about several hundreds of micrometers, but the width of the sealing substrate 238 (the length of a short side in FIG. 55) is in a range of about 15 mm to 20 mm. Therefore, even when the groove 239 of the sealing substrate 238 has a relatively small thickness, a sufficient degree of rigidity is obtained. However, when the thickness of the groove 239 is excessively small, a sufficient degree of rigidity is not obtained. In addition, in this case, a sealing function is also deteriorated. Therefore, the thickness of the optical waveguide plate 236 is set as large as possible in the range not causing these problems.

Figure 57:
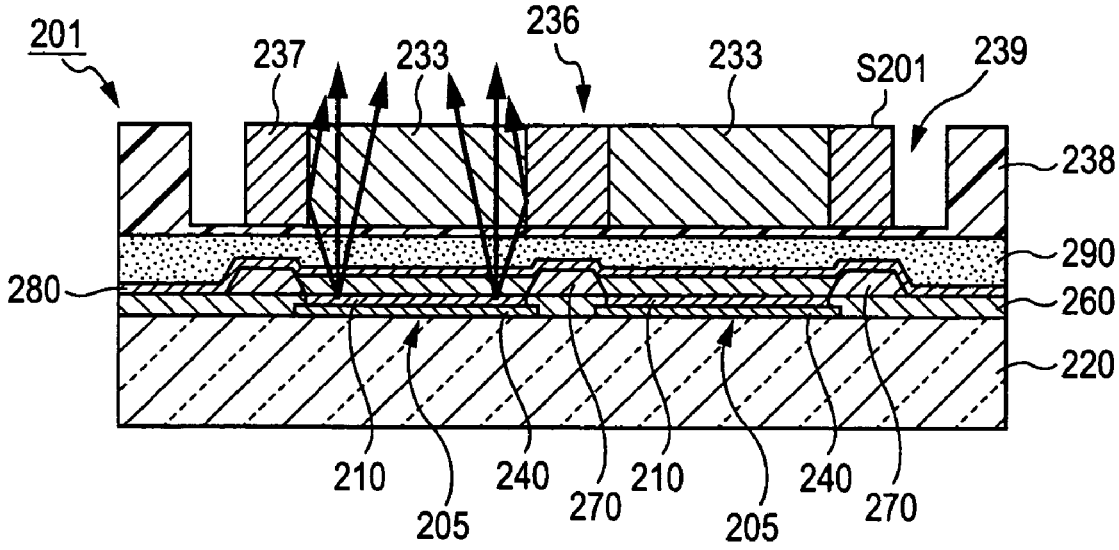
FIG. 57 is a cross-sectional view illustrating an optical operation of the head 201.

FIG. 57 is a cross-sectional view illustrating the optical operation of the head 201. In the head 201, when a voltage is applied by the electrode 240 and the transparent electrode 280, the light emitting layer 210 interposed therebetween emits light. Most of light components emitted from the light emitting layer 210 to the sealing substrate 238 travels substantially in a direction perpendicular to the sealing substrate 238 to reach the rear surface of the sealing substrate 238 through the hole injecting layer 250, the transparent electrode 280, and the adhesive 290. Since the refractive index of the material forming the sealing substrate 238 is equal to or higher than that of the adhesive 290, it is easy for all the light components reached the rear surface of the sealing substrate 238 to be incident on the sealing substrate 238. Therefore, most of the reached light components are incident on the sealing substrate 238.

Since a portion of the sealing substrate 238 covering the light emitting elements 205 has a relatively small thickness, all the light components incident on the sealing substrate 238 reach the front surface of the sealing substrate 238 (the bottom of the groove 239). More specifically, the light components reach the end surfaces of the optical waveguides 233 facing the light emitting elements 205. Since the refractive index of a material forming the optical waveguides 233 is equal to or higher than that of a material forming the sealing substrate 238, it is easy for all light components reached the one end surface to be incident on the optical waveguide 233. Therefore, most of the reached light components are incident on the optical waveguides 233 and then travel in the optical waveguides 233.

When the light components traveling in the optical waveguide 233 reach the outer circumferential surface of the optical waveguide 233, most of them are specularly reflected therefrom. That is, the optical waveguide 233 functions as a core of an optical fiber having a large diameter to guide the incident light. The reason why the specular reflection occurs is the same as described in the tenth embodiment. Preferably, a material forming the optical waveguides 233 and a material covering the outer circumferential surfaces of the optical waveguides 233 are selected such that a sufficient amount of light can be specularly reflected.

In this way, light travels in the optical waveguide 233 and is then emitted from the end surface of the optical waveguide 233 on the side of the light emission surface S201. Therefore, a spot image (an optical image) is formed on the light emission surface S201, as shown in FIG. 48. The shape, size, and forming position of the spot image are identical with the end surface of the optical waveguide 233 on the side of the light emission surface S201. In addition, the spot image has a substantially uniform distribution of brightness.

Furthermore, even when the thicknesses of the optical waveguide plate 236 and the sealing substrate 238 are reduced due to the abrasion of a closely adhering portion and thus the optical waveguide 233 is shortened, the shape and size of the end surface of the optical waveguide 233 exposed from the light emission surface S201 are hardly changed, since the optical waveguide 233 is a cylindrical member which guides light by the specular reflection from the outer circumferential surface thereof and the central axis thereof extends in a direction where the contact surface recedes due to abrasion. Thus, the shape and size of the spot image formed on the light emission surface S200 are also hardly changed.

As described above, according to the image forming apparatus of the twelfth embodiment, in disregard of contact exposure in which the head 201 comes into contact with the image carrier 110*a*, it is possible to guide light emitted from the light emitting layer 210 to the sealing substrate 238 without leakage and thus to stably form a high-definition image. That is, it is possible to reduce a variation in the area or shape of a spot image. This effect contributes to an improvement in the quality of printing and stabilization. In addition, light emitted from the light emitting layer 210 is hardly reflected not only from an interface between the adhesive 290 and the sealing substrate 238 but also from an interface between the sealing substrate 238 and the optical waveguide 233, which makes it possible to improve the utilization efficiency of light emitted from the light emitting layer 210.

Further, one groove 239 is formed in the sealing substrate 238. Therefore, it is possible to easily manufacture a sealing substrate, compared with the structure in which the optical waveguides passing through the sealing substrate are directly formed in the sealing substrate. In addition, it is possible to reduce manufacturing costs, compared with the structure in which the entire surface of the sealing substrate is cut.

Furthermore, since the optical waveguide plate 236 having the optical waveguides 233 formed therein does not need to have a sealing function, there is no restriction to select a material forming the plate 237. In addition, the optical waveguide plate 236 is smaller than the sealing substrate 238 in size. Therefore, it is possible to easily form the optical waveguides 233, compared with the structure in which the optical waveguides passing through the sealing substrate is directly formed in the sealing substrate.

Moreover, in the head 201, a surface of the sealing substrate 238 facing the main substrate 220 has no seam, which makes it possible to reliably maintain the sealing function. In addition, the optical waveguides 233 are formed in the optical waveguide plate 236, not in the sealing substrate 238 or the main substrate 220. Therefore, the optical waveguide plate 236, not the main substrate and the sealing substrate, is directly deformed due to a difference between thermal shrinkage (expansion) of the optical waveguide 233 and thermal shrinkage (expansion) of a circumferential portion thereof (the plate 237 or adhesive). That is, the deformation of the main substrate or the sealing member due to the optical waveguides 233 does not occur.

Next, an example of a method of manufacturing the head 201 will be described.

Figure 58:
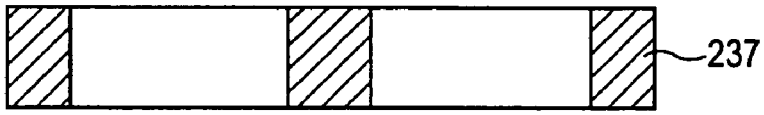
FIG. 58 is a diagram illustrating a first process of a method of manufacturing the head 201.

FIG. 58 is a diagram illustrating a first process of the method of manufacturing the head 201. As shown in FIG. 58, first, a plurality of cylindrical holes is formed in the plate 237. Since these holes are filled up in a subsequent process to serve as the optical waveguides 233, they are formed such that end surfaces thereof can cover the light emitting layer 210. The holes can be formed by, for example, the hole forming method used in the tenth embodiment.

Figure 59:
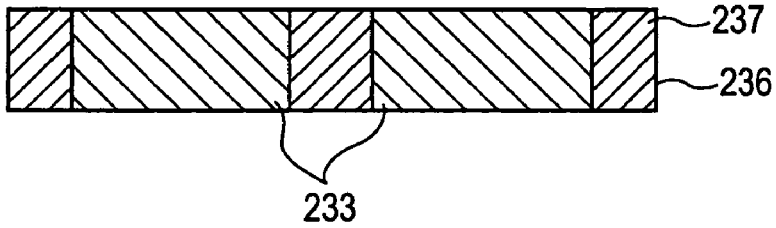
FIG. 59 is a diagram illustrating the next process of that shown in FIG. 58.

FIG. 59 is a diagram illustrating the next process of that shown in FIG. 58. As shown in FIG. 59, the holes are filled up to form the optical waveguides 233 in the optical waveguide plate 236. That is, a resin material forming the optical waveguides 233 is filled up into the holes so that both end surfaces of each optical waveguide 233 are flush with the front and rear surfaces of the optical waveguide plate 236. The holes can be filled up by, for example, the filling method used in the tenth embodiment.

Figure 60:
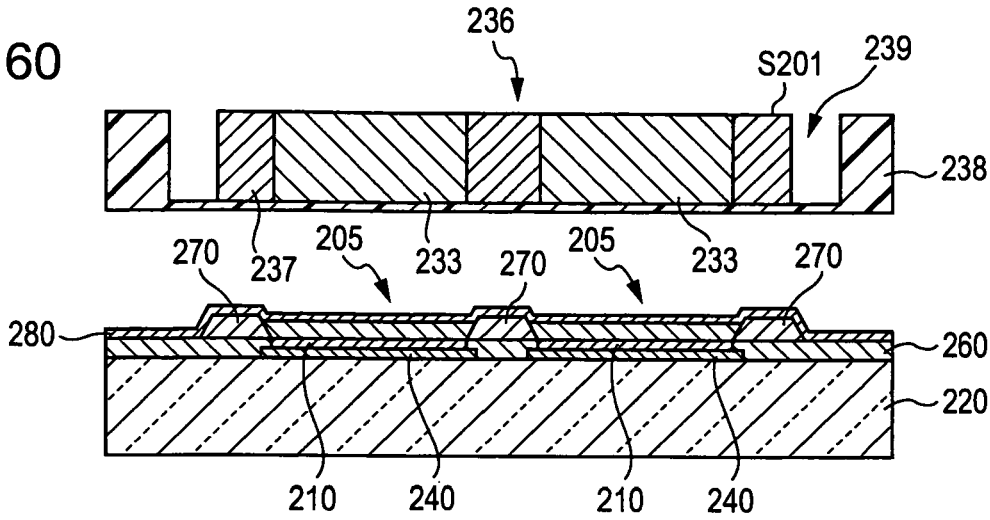
FIG. 60 is a diagram illustrating the next process of that shown in FIG. 59.

FIG. 60 is a diagram illustrating the next process of that shown in FIG. 59. As shown in FIG. 60, the groove 239 is formed by cutting the sealing substrate 238, and the optical waveguide plate 236 is fitted into the groove 239. In this way, one end surface of the optical waveguide plate 236 comes into contact with the bottom of the groove 239. Meanwhile, a plurality of light emitting elements 205 is formed on the main substrate 220.

Figure 61:
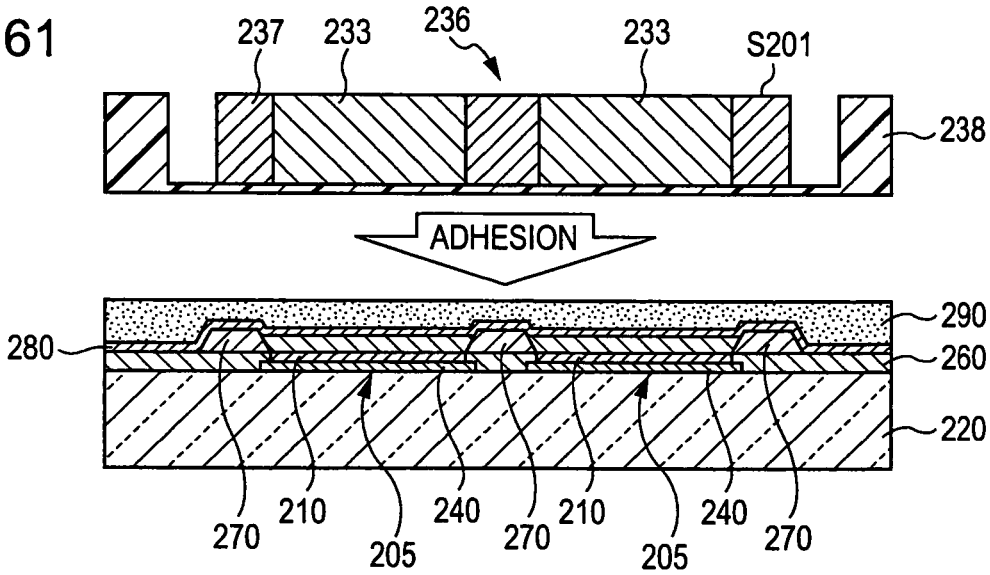
FIG. 61 is a diagram illustrating the next process of that shown in FIG. 60.

FIG. 61 is a diagram illustrating the next process of that shown in FIG. 60. As shown in FIG. 61, the adhesive 290 is coated on the surface of the main substrate 220 having the light emitting elements 205 formed thereon (or the rear surface of the sealing substrate 238), and the sealing substrate 238 is bonded and fixed to the main substrate 220 by the adhesive 290. At that time, the main substrate 220 and the sealing substrate 238 are arranged such that an end surface of each optical waveguide 233 facing the main substrate 220 covers the light emitting layer 210 of the corresponding light emitting element 205, thereby completing the head 201.

As described above, in this manufacturing method, a process for cutting the substrate is needed. However, the sealing substrate 238 and the plate 237, not the main substrate 220, are cut. Therefore, the utilization efficiency of the main substrate requiring a high degree of utilization efficiency is not lowered, which is effective in the mass production.

In this manufacturing method, the optical waveguide plate 236 is provided in the groove 239 of the sealing substrate 238 before the sealing substrate 238 is fixed to the main substrate 220. However, the optical waveguide plate 236 may be provided in the groove 239 of the sealing substrate 238 after the sealing substrate 238 is fixed to the main substrate 220.

Thirteenth Embodiment

Figure 62:
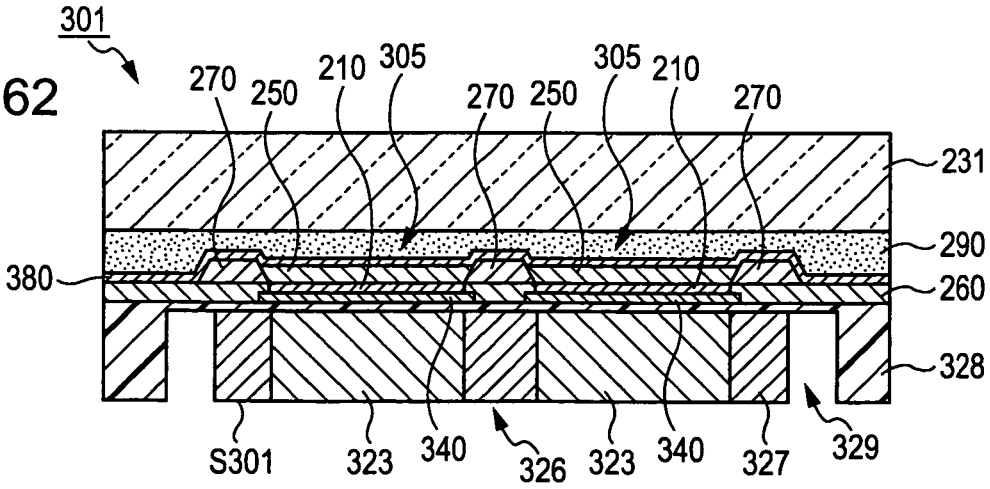
FIG. 62 is a cross-sectional view illustrating the structure of a head 301 of an image forming apparatus according to the thirteenth embodiment of the invention.

FIG. 62 is a cross-sectional view illustrating the structure of the head 301 of the image forming apparatus according to the thirteenth embodiment of the invention. The head 301 differs from the head 201 shown in FIG. 56 in that the optical waveguides are formed in the main substrate, not in the sealing substrate. From the viewpoint of the difference, in the head 301, light emitting elements 305 are used instead of the light emitting elements 205, and a plate-shaped main substrate 328 having a groove 329 formed therein is used instead of the main substrate 220. In addition, a plate 231 is used as a sealing substrate.

The plate 231 differs from the sealing substrate 238 shown in FIG. 56 in that it does not have a groove formed therein and is formed of a light shielding material. The light emitting element 305 differs from the light emitting element 205 in that a transparent electrode 340, serving as an anode, is substituted for the electrode 240 serving as a cathode, and an electrode 380, serving as a cathode, is substituted for the transparent electrode 280 serving as an anode.

The light emitting elements 305 are covered with the main substrate 328 and are further covered with a flat optical waveguide plate 326 which is provided in the groove 329 of the main substrate 328 and is fixed to the main substrate 328. The main substrate 328 should be formed of a transmissive material, such as glass, quartz, or plastic. The optical waveguide plate 326 is fixed to the main substrate 328 by the same method as that used for fixing the optical waveguide plate 236 to the sealing substrate 238 in FIG. 56. The front surface of the optical waveguide plate 326 serves as a light emission surface S301 on which a spot image is formed, and constitutes a portion of the contact surface S10 shown in FIG. 44. The rear surface of the optical waveguide plate 326 is opposite to the light emitting elements 305 with the main substrate 238 interposed therebetween.

The groove 329 is formed in one surface (front surface) of the main substrate 328 opposite to the other surface (rear surface) thereof facing the light emitting elements 305. The groove 329 has a flat bottom, and the rear surface of the optical waveguide plate 236 comes into contact with the bottom. Similar to the groove 239, the width, length, and depth of the groove 329 are set such that the surface (the light emission surface S301) of the optical waveguide plate 326 is flush with the surface of the main substrate 328 except for the groove 329. That is, the width, length, and depth of the groove 329 depend on the width, length, and thickness of the optical waveguide plate 326. In addition, the width, length, and thickness of the optical waveguide plate 326 are set, similar to the optical waveguide plate 236.

A cylindrical optical waveguide 323 is formed in each light emitting element 305 in a portion of the optical waveguide plate 326 overlapping the light emitting element 305. Each optical waveguide 323 for guiding light emitted from the light emitting layer 210 is provided so as to pass through the front and rear surfaces of the optical waveguide plate 326, and the central axis thereof extends in the thickness direction of the optical waveguide plate 326. In addition, the outer circumferential surface of each optical waveguide 323 is covered with the plate 327. One end surface of the optical waveguide 323 facing the light emitting element 305 serves as a portion of the rear surface of the optical waveguide plate 326, and the other end surface thereof serves as a portion of the front surface (the light emission surface S301) of the optical waveguide plate 326. The one end surface of the optical waveguide 323 facing the light emitting element 305 covers the light emitting layer 210 of the corresponding light emitting element 305, as viewed from the light emission surface S301.

Further, the optical waveguides 323 are formed of a transmissive material. The material has a refractive index which is equal to or higher than that of a material forming the main substrate 328 and which is higher than that of a material forming the plate 327. The outer circumferential surface of each optical waveguide 233 should be covered with a material having a refractive index lower than that of the material in any methods.

Figure 63:
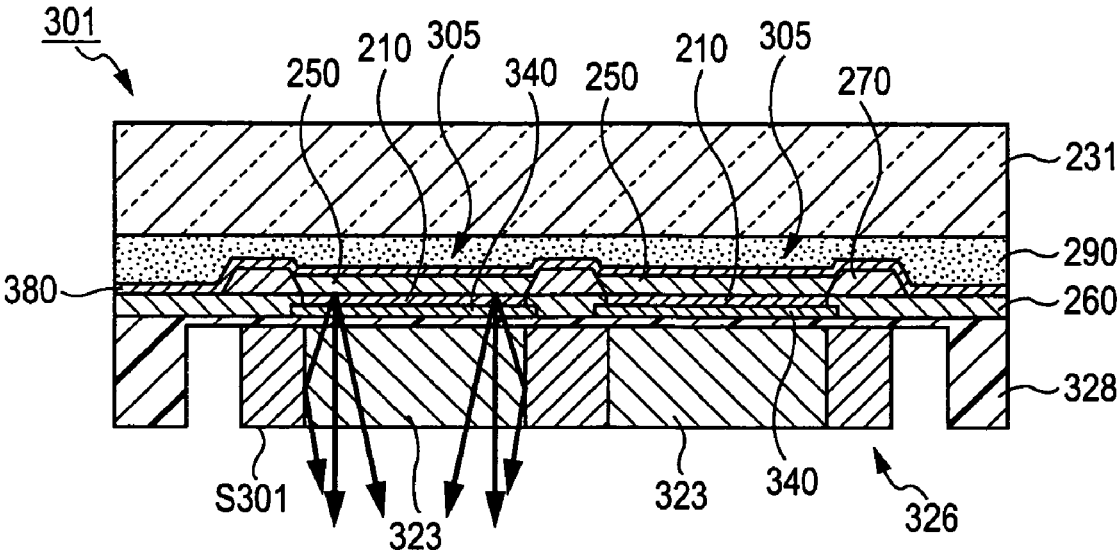
FIG. 63 is a cross-sectional view illustrating an optical operation of the head 301.

FIG. 63 is a cross-sectional view illustrating the optical operation of the head 301. In the head 301, when a voltage is applied by the transparent electrode 340 and the electrode 380, the light emitting layer 210 interposed therebetween emits light. Most of light components emitted from the light emitting layer 210 to the main substrate 328 travels substantially in a direction perpendicular to the main substrate 328 and is then incident on the main substrate 328 through the transparent electrode 340.

Since a portion of the main substrate 328 covering the light emitting elements 305 has a relatively small thickness, all the light components incident on the main substrate 328 reach the front surface of the main substrate 328 (the bottom of the groove 329). More specifically, the light components reach the end surfaces of the optical waveguides 323 facing the light emitting elements 305. Since the refractive index of a material forming the optical waveguides 323 is equal to or higher than that of a material forming the main substrate 328, it is easy for all the light components reached the end surface to be incident on the optical waveguide 323. Therefore, most of the reached light components are incident on the optical waveguide 323 and then travel in the optical waveguide 323. Since the optical waveguide 323 functions as a core of an optical fiber having a large diameter, most of the light incident on the optical waveguide 323 travels in the optical waveguide 323 and is then emitted from the end surface of the optical waveguide 323 on the side of the light emission surface S301.

The image forming apparatus of the thirteenth embodiment can obtain the same effects as those obtained from the image forming apparatus of the twelfth embodiment. However, since the optical waveguides are formed in the main substrate, the effects obtained by forming the optical waveguides in the sealing substrate are not obtained.

Further, in the image forming apparatus according to the thirteenth embodiment, since the optical waveguides 323 are formed in the main substrate 328, a distance between the light emitting layer and the optical waveguide is smaller than that in the image forming apparatus according to the twelfth embodiment. This contributes to an improvement in the brightness of a spot image.

Modifications of Tenth to Thirteenth Embodiments

Various modifications of the above-mentioned tenth to thirteenth embodiments can be made. The modifications thereof will be described in detail. The following modifications may be appropriately combined.

First Modification

In the tenth to thirteenth embodiments, a cylindrical optical waveguide is used, but the shape of the optical waveguide is not limited thereto. For example, the optical waveguide may be formed in a prismatic shape or a pillar shape having a hemispherical end surface. That is, the optical waveguide can have any pillar shapes.

Second Modification

In the tenth to thirteenth embodiments, organic EL elements are used as light emitting elements. However, inorganic EL elements may be used as light emitting elements.

Third Modification

Figure 64:
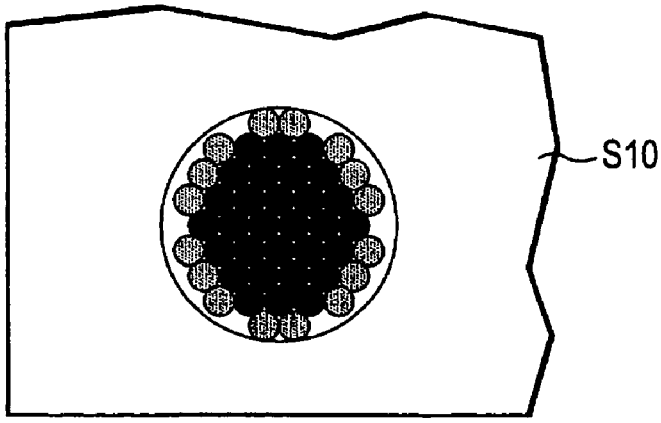
FIG. 64 is a diagram illustrating a spot image formed by an image forming apparatus according to a third embodiment of the tenth to thirteenth embodiments.

In the tenth to thirteenth embodiments, the optical waveguide serving as an optical fiber is used. An optical fiber array composed of a bundle of optical fibers may be used as the optical waveguide. In this case, one end surface of the fiber array constitutes a portion of a light emission surface (contact surface), and the other end surface thereof covers the light emitting layer 210. Light incident on one end of the optical fiber travels toward the other end of the optical fiber while being specularly reflected from the inner circumferential surface of the optical fiber. The one end of each optical fiber constitutes a portion of the one end surface of the fiber array, and the other end thereof constitutes a portion of the other end surface of the fiber array. FIG. 64 shows a spot image obtained from this modification. As shown in FIG. 64, the spot image formed on the contact surface S10 by using the fiber array slightly has a slightly different shape from that of the light emitting layer 210, and has non-uniform distribution of brightness. However, in this modification, except this point, the same effects as those in the tenth to thirteenth embodiments are obtained.

Overall Structure of Image Forming Apparatus

Figure 65:
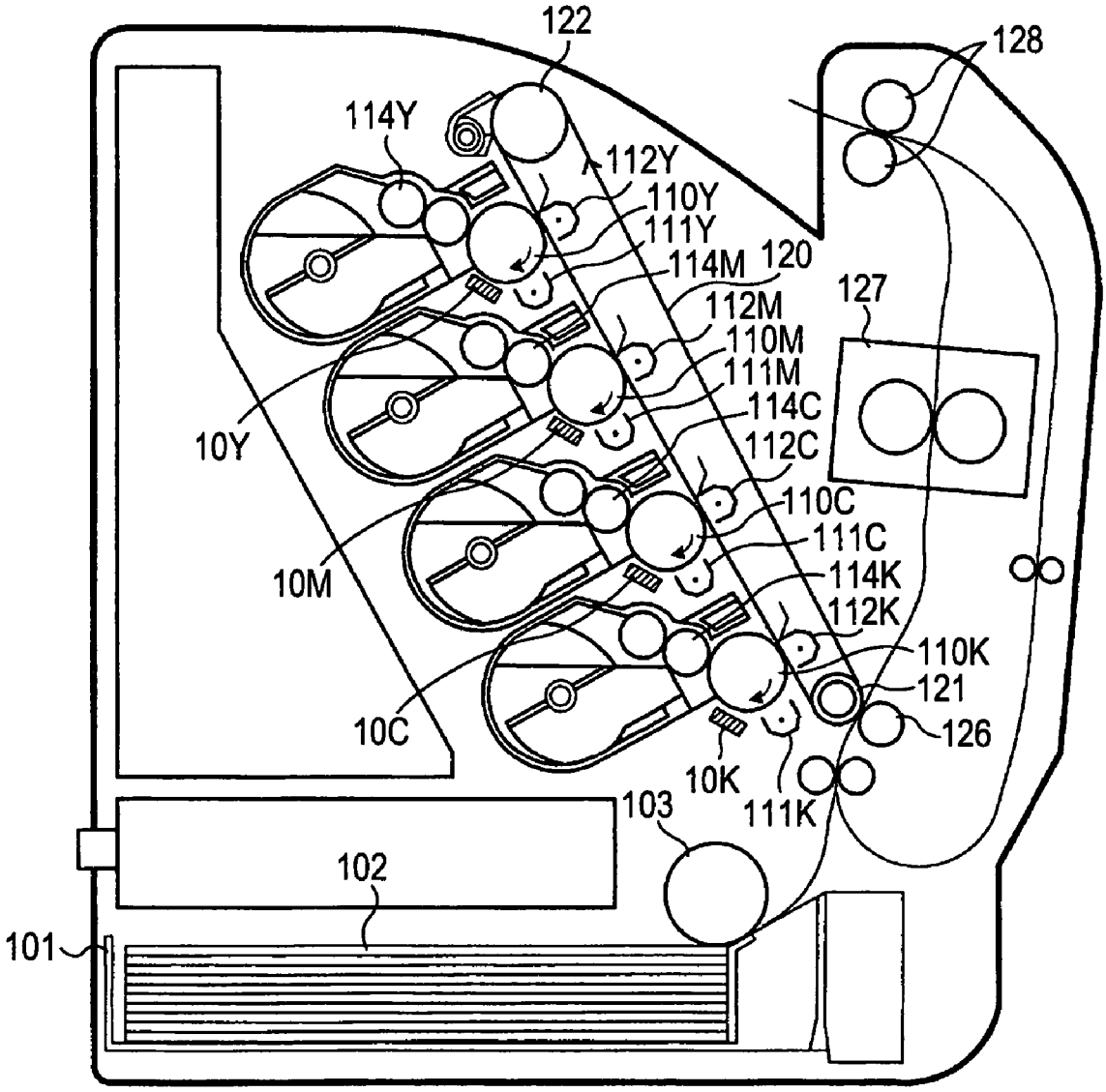
FIG. 65 is a longitudinal sectional view illustrating an example of the overall structure of the image forming apparatus according each embodiment of the invention.

FIG. 65 is a longitudinal cross-sectional view illustrating an example of the overall structure of an image forming apparatus according to the invention. This image forming apparatus is a tandem-type full color image forming apparatus using a belt intermediate transfer method.

In this image forming apparatus, four heads 10K, 10C, 10M, and 10Y having the same structure are arranged at exposure positions of four photoreceptor drums (image carriers) 110K, 110C, 110M, and 110Y having the same structure. The heads 10K, 10C, 10M, and 10Y correspond to any one of the heads of the image forming apparatuses according to the above-described embodiments, and are organic EL array exposure heads in which organic EL elements, each including a light emitting layer formed of an organic EL material, are arranged as light emitting elements.

As shown in FIG. 65, the image forming apparatus has a driving roller 121, a driven roller 122, an endless intermediate transfer belt 120 wound around the driving roller 121 and the driven roller 122, and the intermediate transfer belt 122 circulates around the rollers 121 and 122 in the direction of arrow shown in FIG. 65. Although not shown in FIG. 65, a tension applying unit for applying tension to the intermediate transfer belt 120, such as a tension roller, may be provided.

The four photoreceptor drums 110K, 110C, 110M, and 110Y are disposed at predetermined intervals around the intermediate transfer belt 120. Each photoreceptor drum has a photosensitive layer on the outer peripheral surface thereof. These photoreceptor drums correspond to the photoreceptor drums (image carriers) of the image forming apparatuses according to the above-described embodiments, and suffixes 'K', 'C', 'M', and 'Y' added to reference numerals indicate black, cyan, magenta, and yellow which are used for forming a toner image, respectively. This is similarly applied to other members. The photoreceptor drums 110K, 110C, 110M, and 110Y are rotated in synchronism with the driving of the intermediate transfer belt 120.

A corona charger 111 (K, C, M, and Y), the head 10 (K, C, M, and Y), and a developing device 114 (K, C, M, and Y) are arranged around each photoreceptor drum 110 (K, C, M, and Y). The corona charger 111 (K, C, M, and Y) uniformly charges the outer peripheral surface of the corresponding photoreceptor drum 110 (K, C, M, and Y). The head 10 (K, C, M, and Y) writes a latent image on the charged outer peripheral surface of the photoreceptor drum. Each head 10 (K, C, M, and Y) is arranged such that a plurality of light emitting elements is arranged along a bus (the main scanning direction) of the photoreceptor drum 110 (K, C, M, and Y). The writing of the latent image is performed by radiating light emitted from the plurality of light emitting elements on the photoreceptor drum. The developing device 114 (K, C, M, and Y) applies toner, as a developer, onto the latent image to form a toner image, that is, a visible image on the photoreceptor drum.

Black, cyan, magenta, and yellow toner images formed by single-color toner image forming stations for the four colors are sequentially primarily transferred onto the intermediate transfer belt 120 so as to be superimposed on the intermediate transfer belt 120, thereby forming a full-color toner image. Four primary transfer corotrons (transfer devices) 112 (K, C, M, and Y) are arranged inside the intermediate transfer belt 120. The primary transfer corotrons 112 (K, C, M, and Y) are arranged in the vicinities of the photoreceptor drums 110 (K, C, M, and Y), respectively, and electrostatically attract the toner images from the photoreceptor drums 110 (K, C, M, and Y) to transfer the toner images onto the intermediate transfer belt 120 passing between the photoreceptor drums and the primary transfer corotrons.

Finally, sheets 102, which are image forming targets, are fed one by one from a paper feed cassette 101 to a nip between a secondary transfer roller 126 and the intermediate transfer belt 120 coming into contact with the driving roller 121 by a pick-up roller 103. The full-color toner image on the intermediate transfer belt 120 are collectively secondary-transferred onto one surface of the sheet 102 by the secondary transfer roller 126 and are then fixed on the sheet 102 by a pair of fixing rollers 127 serving as a fixing unit. Then, the sheet 102 is discharged onto a paper discharge cassette formed on the upper side of the apparatus by a pair of paper discharge rollers 128.

Figure 66:
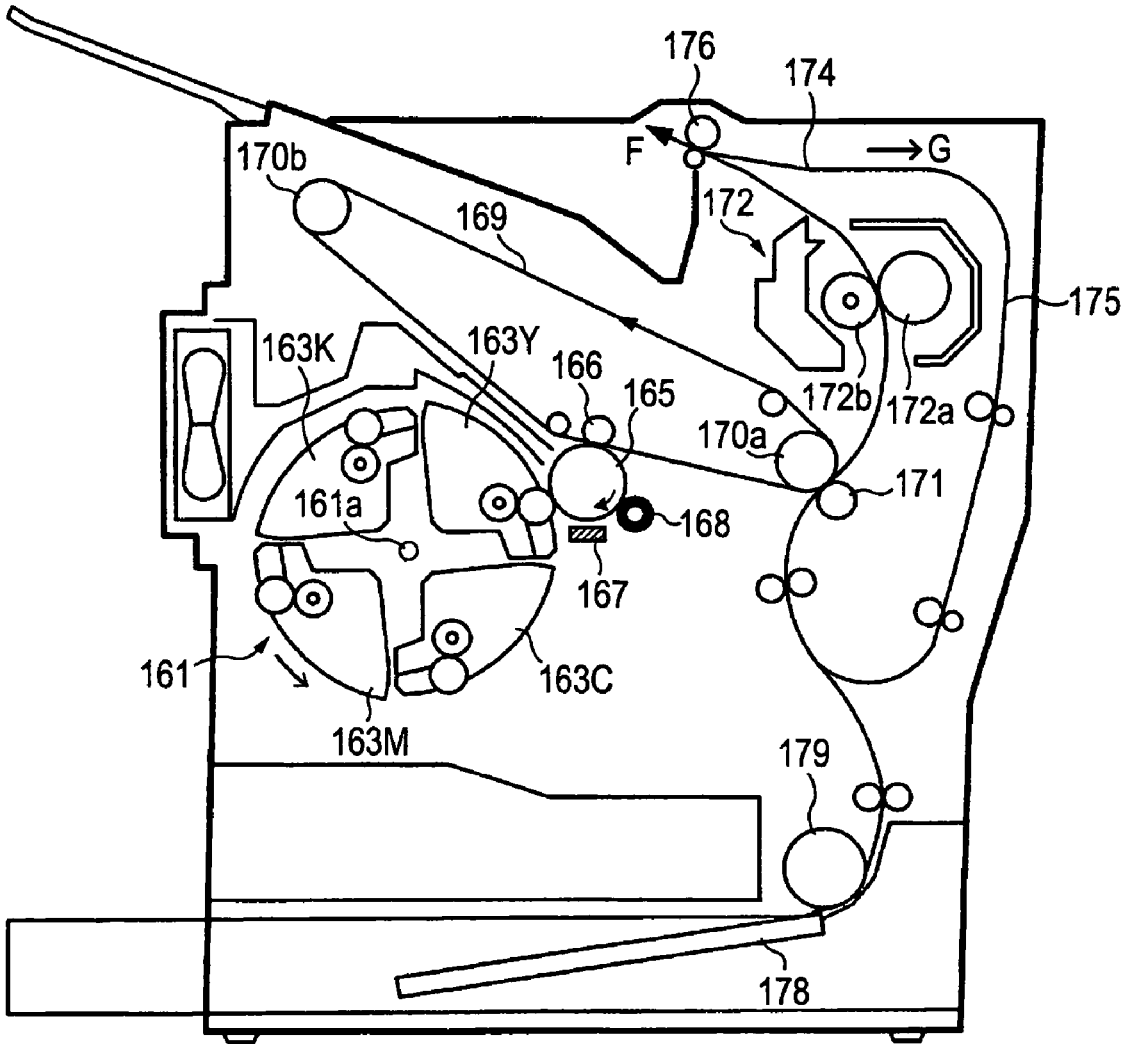
FIG. 66 is a longitudinal sectional view illustrating another example of the overall structure of the image forming apparatus according each embodiment of the invention.

FIG. 66 is a longitudinal sectional view illustrating another example of the overall structure of the image forming apparatus according to any one of the above-described embodiments. This image forming apparatus is a rotary-development-type full color image forming apparatus using a belt intermediate transfer method. In the image forming apparatus shown in FIG. 66, a corona charger 168, a rotary developing unit 161, a head 167, and an intermediate transfer belt 169 are provided around a photoreceptor drum 165.

The corona charger 168 uniformly charges the outer peripheral surface of the photoreceptor drum 165. The head 167 writes a latent image on the charged outer peripheral surface of the photoreceptor drum 165. The photoreceptor drum 165 corresponds to any one of the photoreceptor drums (image carriers) of the image forming apparatuses according to the above-described embodiments. The head 167 corresponds to any one of the heads of the image forming apparatuses according to the above-described embodiments, and is an organic EL array exposure head in which organic EL elements, each including a light emitting layer formed of an organic EL material, are arranged as light emitting elements. The head 167 is provided such that a plurality of light emitting elements is arranged along a bus (the main scanning direction) of the photoreceptor drum 165. The writing of the latent image is performed by radiating light emitted from the plurality of light emitting elements on the photoreceptor drum 165.

The developing unit 161 is a drum including four developing devices 163Y, 163C, 163M, and 163K arranged at right angles to each other, and can be rotated on a shaft 161*a* in the counterclockwise direction. The developing devices 163Y, 163C, 163M, and 163K respectively supply yellow, cyan, magenta, and black toners to the photoreceptor drum 165 to attach the toners, as developing agents, onto the latent image, thereby forming a toner image, that is, a visible image on the photoreceptor drum 165.

The endless intermediate transfer belt 169 is wound around a driving roller 170*a*, a driven roller 170*b*, a primary transfer roller 166, and a tension roller, and circulates around these rollers in the direction of arrow shown in FIG. 66. The primary transfer roller 166 electrostatically attracts the toner image from the photoreceptor drum 165 to transfer the toner image onto the intermediate transfer belt 169 passing between the photoreceptor drum and the primary transfer roller 166.

More specifically, at the first rotation of the photoreceptor drum 165, a latent image for a yellow (Y) image is written by the head 167, and a toner image having the same color is formed by the developing device 163Y and is then transferred onto the intermediate transfer belt 169. At the next rotation thereof, a latent image for a cyan (C) image is written by the head 167, and a toner image having the same color is formed by the developing device 163C and is then transferred onto the intermediate transfer belt 169 so as to overlap the yellow toner image. When the photoreceptor drum 165 makes four rotations in this way, yellow, cyan, magenta, and black toner images sequentially overlap each other on the intermediate transfer belt 169, thereby forming a full-color toner image on the intermediate transfer belt 169. Finally, when images are formed on both surfaces of a sheet, which is an image forming target, a toner image having a color common to the front and rear surfaces is transferred onto the intermediate transfer belt 169, and then a toner image having the next color common to the front and rear surfaces is transferred thereon, thereby forming a full-color toner image on the intermediate transfer belt 169.

A sheet transfer path 174 through which sheets pass is provided in the image forming apparatus. The sheets are fed one by one from the paper feed cassette 178 by the pick-up roller 179 and are then transferred along the sheet transfer path 174 by a transfer roller. Then, the sheets pass through a nip between a secondary transfer roller 171 and the intermediate transfer belt 169 coming into contact with the driving roller 170*a*. The secondary transfer roller 171 collectively and electrostatically attracts the full-color toner image from the intermediate transfer belt 169 to transfer the toner image onto one surface of the sheet. The secondary transfer roller 171 approaches or is separated from the intermediate transfer belt 169 by a clutch (not shown). When a full-color toner image is transferred onto a sheet, the secondary transfer roller 171 abuts on the intermediate transfer belt 169. On the other hand, when the toner images are superposed on the intermediate transfer belt 169, the secondary transfer roller 171 is separated therefrom.

In this way, the sheet having an image thereon is transferred to a fixing device 172 and passes between a heating roller 172*a* and a pressing roller 172*b* of the fixing device 172, thereby fixing a toner image on the sheet. The sheet having the fixed toner image is transferred to the pair of paper discharge rollers 176 to be carried in the direction of arrow F. In a case in which printing is performed on both sides of a sheet, after most of the sheet passes through the paper discharge rollers 176, the pair of paper discharge rollers 176 is reversely rotated to transfer the sheet in a double-sided printing transfer path 175 as represented by an arrow G. Subsequently, a toner image is transferred onto the other surface of the sheet by the secondary transfer roller 171, and is then fixed by the fixing device 172. Then, the sheet is discharged to the outside by the pair of paper discharge rollers 176.

In the image forming apparatuses shown in FIGS. 65 and 66, the organic EL elements are used as writing units (exposure units). Therefore, even when a laser scanning optical system is used, it is possible to reduce the size of an image forming apparatus. In addition, the head according to any one of the above-described embodiments can be applied to electrophotographic image forming apparatuses having structures other than the above-described structures. For example, these heads according to the above-described embodiments can be applied to an image forming apparatus which directly transfers a toner image on a photoreceptor drum without using the intermediate transfer belt, an image forming apparatus capable of forming monochrome images, and an image forming apparatus including a photoreceptor belt instead of the photoreceptor drum.

What is claimed is:

1. An image forming apparatus, comprising:

an image carrier having a curved image carrier surface, the image carrier being movable in a direction;

a transmissive sliding member having a sliding surface that contacts the curved image carrier surface and a top surface opposite the sliding surface, the sliding surface having a curvature substantially equal to a curvature of the curved image carrier surface, and a side surface and an inclined surface, the inclined surface being disposed between the sliding surface of the transmissive sliding member and the side surface, located on an upstream side, in a rotational direction, of the image carrier, and angled such that an elevation angle between the inclined surface and a tangent of the curved image carrier surface is an acute angle; and light emitting elements fixed to the top surface of the transmissive sliding member, the light emitting elements emitting light to the curved image carrier surface to form a latent image on the image carrier.

2. The image forming apparatus of claim 1, the image carrier being a substantially cylindrical member, the curved image carrier surface being an outer circumferential surface of the substantially cylindrical member, and the transmissive sliding member being disposed on an outside of the image carrier such that the sliding surface of the transmissive sliding member contacts the curved image carrier surface.

3. The image forming apparatus of claim 1, the image carrier being a substantially cylindrical member, the curved image carrier surface being an inner circumferential surface of the substantially cylindrical member, and the transmissive sliding member being disposed on an inside of the image carrier such that the sliding surface of the transmissive sliding member contacts the curved image carrier surface.

4. The image forming apparatus of claim 1, further comprising:

an urging unit that urges the transmissive sliding member toward the image carrier.

5. The image forming apparatus of claim 1, further comprising:

a sealing member formed on the top surface of the transmissive sliding member, the sealing member covering the light emitting elements.

6. The image forming apparatus of claim 1, the transmissive sliding member having a first portion, the light emitting elements being formed on the first portion, and the transmissive sliding member having second portions disposed at opposite sides of the first portion in a direction along the image carrier surface, the second portions protruding from the first portion toward the image carrier surface, the second portions each having a surface facing the image carrier surface and constituting the sliding surface of the transmissive sliding member.

7. An image forming apparatus, comprising:

an image carrier having an image-carrier surface, the image carrier being movable in a direction;

a substrate having a surface facing the image-carrier surface;

light emitting elements formed on the surface of the substrate; and a sliding member fixed to the substrate and interposed between the light emitting elements and the image carrier, the sliding member having a sliding surface, a side surface and an inclined surface, the inclined surface being disposed between the sliding surface and the side surface, located on an upstream side, in a rotational direction, of the image carrier, and angled such that an elevation angle between the inclined surface and a tangent of the image-carrier surface is an acute angle.

8. The image forming apparatus of claim 7, the sliding member being a sealing member that covers the light emitting elements.

* * * * *